US010347067B2

(12) United States Patent
Onishi

(10) Patent No.: US 10,347,067 B2
(45) Date of Patent: Jul. 9, 2019

(54) COIN DEPOSITING AND DISPENSING MACHINE

(71) Applicant: GLORY LTD., Himeji-shi, Hyogo-ken (JP)

(72) Inventor: Shuji Onishi, Himeji (JP)

(73) Assignee: GLORY LTD., Himeji-shi, Hyogo-Ken (JP)

( * ) Notice: Subject to any disclaimer, the term of this patent is extended or adjusted under 35 U.S.C. 154(b) by 0 days.

(21) Appl. No.: 15/078,191

(22) Filed: Mar. 23, 2016

(65) Prior Publication Data

US 2016/0240027 A1 Aug. 18, 2016

Related U.S. Application Data

(63) Continuation of application No. 14/000,929, filed as application No. PCT/JP2012/053915 on Feb. 20, 2012.

(30) Foreign Application Priority Data

Feb. 22, 2011 (JP) ..... 2011-035974
Feb. 20, 2012 (WO) ..... PCT/JP2012/053915

(51) Int. Cl.
*G07D 3/00* (2006.01)
*G07D 1/00* (2006.01)
(Continued)

(52) U.S. Cl.
CPC ..... *G07D 1/00* (2013.01); *G07D 3/00* (2013.01); *G07D 3/128* (2013.01); *G07D 3/14* (2013.01); *G07D 9/008* (2013.01)

(58) Field of Classification Search
CPC .. G07D 1/00; G07D 1/02; G07D 1/04; G07D 1/06; G07D 1/08; G07D 3/00; G07D 3/02;
(Continued)

(56) References Cited

U.S. PATENT DOCUMENTS 3,788,334 A * 1/1974 Saraceno ..... G07D 9/008 221/182
4,558,711 A 12/1985 Ikuta Yoshiaki et al.
(Continued)

FOREIGN PATENT DOCUMENTS

EP 1 927 955 A1 6/2008
EP 2 116 979 A1 11/2009
(Continued)

OTHER PUBLICATIONS

Japanese Office Action with English translation (JP Application No. 2015-134527) (9 pages—dated Apr. 19, 2016).
(Continued)

*Primary Examiner* — Jeffrey A Shapiro
(74) *Attorney, Agent, or Firm* — Renner, Kenner, Greive, Bobak, Taylor & Weber

(57) ABSTRACT

In a coin depositing and dispensing machine 10, a plurality of storing and feeding apparatuses 50 disposed below a deposited-coin transport unit 20 are arranged vertically on plural levels. A transport direction in which a coin is transported by the deposited-coin transport unit and a feeding direction in which a coin is fed out from each storing and feeding unit are substantially perpendicular to each other.

8 Claims, 25 Drawing Sheets

(51) Int. Cl.
*G07D 3/14* (2006.01)
*G07D 9/00* (2006.01)
*G07D 3/12* (2006.01)

(58) Field of Classification Search
CPC ..... G07D 3/06; G07D 3/08; G07D 3/128; G07D 7/128; G07D 9/06; G07D 13/00; G07D 2201/00; G07D 3/14; G07D 9/008; G07F 3/04; G07F 5/24; G07F 9/08; G07F 19/203
USPC ..... 453/6, 10, 12, 13, 33–35, 49, 57
See application file for complete search history.

(56) References Cited

U.S. PATENT DOCUMENTS 5,295,900 A 3/1994 Tsuchida et al.
6,171,182 B1 1/2001 Geib et al.
7,066,807 B2 6/2006 Abe et al.
7,255,639 B2 8/2007 Abe et al.
7,766,229 B2 * 8/2010 Uehara ..... G06Q 20/102 235/379
8,100,246 B2 * 1/2012 Nishida ..... G07D 3/14 194/302
8,210,336 B2 * 7/2012 Nishida ..... G07D 9/008 194/302
8,216,032 B2 * 7/2012 Komoto ..... G07D 1/02 453/29
8,261,904 B2 * 9/2012 Nakazumi ..... G07D 1/00 194/344
8,371,911 B2 * 2/2013 Tsubota ..... G07D 9/008 194/200
8,465,349 B2 * 6/2013 Nishida ..... G07D 1/00 453/57
8,498,736 B2 * 7/2013 Nakazumi ..... G07D 3/14 194/216
8,720,665 B2 * 5/2014 Itou ..... G07D 9/008 194/334
8,986,083 B2 * 3/2015 Tanaka ..... G07D 9/008 453/49
8,998,686 B2 * 4/2015 Fischer ..... G07D 3/14 194/302
9,189,905 B2 * 11/2015 Nishida ..... G07D 9/008
2002/0072319 A1 6/2002 Abe
2003/0024791 A1 2/2003 Kurosawa et al.
2003/0148729 A1 8/2003 Abe et al.
2003/0201146 A1 10/2003 Abe et al.
2004/0072528 A1 4/2004 Kurosawa
2005/0006197 A1 1/2005 Wendell et al.
2005/0277378 A1 * 12/2005 Schimpl ..... G07D 9/008 453/18
2006/0019591 A1 1/2006 Abe et al.
2006/0040604 A1 * 2/2006 Wei ..... G07D 9/008 453/34
2008/0085671 A1 * 4/2008 Nishida ..... G07D 1/00 453/57
2009/0004959 A2 * 1/2009 Nishida ..... G07D 1/00 453/57
2009/0047888 A1 * 2/2009 Nishida ..... G07D 1/00 453/3
2009/0101723 A1 * 4/2009 Uehara ..... G06Q 20/102 235/7 A
2010/0029188 A1 * 2/2010 Komoto ..... G07D 1/02 453/29
2010/0042250 A1 * 2/2010 Nishida ..... G07D 1/00 700/218
2010/0062700 A1 * 3/2010 Nakazumi ..... G07D 1/00 453/19
2010/0062701 A1 * 3/2010 Ohno ..... G07D 1/02 453/57
2010/0261421 A1 10/2010 Wendell et al.
2010/0311315 A1 * 12/2010 Tsubota ..... G07D 9/00 453/57
2010/0312378 A1 * 12/2010 Nakazumi ..... G07D 1/00 700/223
2011/0039487 A1 * 2/2011 Nishida ..... G07D 9/008 453/3
2011/0130083 A1 * 6/2011 Tanaka ..... G07D 3/125 453/57
2012/0295528 A1 * 11/2012 Itou ..... G07D 3/14 453/57

FOREIGN PATENT DOCUMENTS

GB 2 386 734 A 9/2003
JP 58-36472 U 8/1981
JP 59-168588 A 9/1984
JP 59-172090 A 9/1984
JP 60-16266 U 2/1985
JP 62-58392 A 3/1987
JP 63-59199 B2 11/1988
JP 6-51962 U 7/1994
JP 6-70052 U 9/1994
JP 8-212407 A 8/1996
JP 8-212408 A 8/1996
JP 2002-298188 A 10/2002
JP 2002-298189 A 10/2002
JP 2003-196695 A 7/2003
JP 2004-110632 A 4/2004
JP 2004-246531 A 9/2004
JP 2009-160225 A 7/2009
WO WO 2007/034699 A1 3/2007
WO WO 2008/093420 A1 8/2008
WO WO 2008/120344 A1 10/2008
WO WO 2009/125482 A1 10/2009
WO WO 2010/010614 A1 * 1/2010

OTHER PUBLICATIONS

Japanese Office Action with English translation (JP Application No. 2016-137441) (8 pages—dated Jun. 27, 2017).
Japanese Office Action with English translation (JP Application No. 2015-047458) (14 pages—dated May 20, 2016).
European Office Action (Application No. 12 748 914.4) (5 pages—dated Feb. 15, 2017).
European Search Report (Application No. 12748914.4—PCT/JP2012/053915) (9 pages—dated Jan. 7, 2014).
Japanese Office Action (Application No. 2011-035974) with English Translation (8 pages—dated Aug. 29, 2014).
Japanese Office Action (Application No. 2011-036005) with English Translation (11 pages—dated Aug. 29, 2014).
Japanese Office Action (Application No. 2011-212868 with English Translation (4 pages—dated Feb. 27, 2015).
Japanese Office Action (Application No. 2015-047458) with English Translation (9 pages—dated Feb. 23, 2016).
U.S. Office Action (U.S. Appl. No. 14/000,929) (12 pages—dated Aug. 14, 2014).
U.S. Office Action (U.S. Appl. No. 14/000,929) (9 pages—dated May 13, 2015).
U.S. Office Action (U.S. Appl. No. 14/000,929) (24 pages—dated Nov. 5, 2015).
U.S. Office Action (U.S. Appl. No. 14/000,929) (19 pages—dated May 18, 2016).
U.S. Office Action (U.S. Appl. No. 14/000,929) (18 pages—dated Aug. 4, 2016).
U.S. Office Action (U.S. Appl. No. 14/000,929) (10 pages—dated Mar. 15, 2017).
U.S. Office Action (U.S. Appl. No. 14/000,929) (19 pages—dated Dec. 22, 2017).
U.S. Office Action (U.S. Appl. No. 14/000,929) (23 pages—dated Apr. 2, 2018).
U.S. Office Action (U.S. Appl. No. 15/078,396) (22 pages—dated Jun. 28, 2016).
U.S. Office Action (U.S. Appl. No. 15/078,396) (21 pages—dated Jan. 26, 2017).
U.S. Office Action (U.S. Appl. No. 15/078,396) (27 pages—dated Dec. 27, 2017).

(56) References Cited

OTHER PUBLICATIONS

U.S. Office Action (U.S. Appl. No. 14/000,929) (19 pages—dated Aug. 8, 2018).
U.S. Office Action (U.S. Appl. No. 15/078,396) (38 pages—dated Sep. 20, 2018).
European Search Report (Application No. 17176627.2) (10 pages—dated Aug. 11, 2017).
European Search Report (Application No. 17176630.6) (11 pages—dated Jul. 12, 2017).
European Office Action (Application No. 12 748 914.4) (9 pages—dated Nov. 20, 2018).
European Office Action (Application No. 12 748 914.4) (9 pages—dated May 17, 2019).

* cited by examiner

COIN DEPOSITING AND DISPENSING MACHINE

CROSS-REFERENCE TO RELATED APPLICATION

This application is a continuation of U.S. patent application Ser. No. 14/000,929 filed on Dec. 2, 2013, which is incorporated herein by reference, which was based upon and claimed the benefit of priority from the prior PCT/JP2012/053915 filed on Feb. 20, 2012, and Japanese Patent Application No. JP2011-035974 filed on Feb. 22, 2011, the entire contents of which are incorporated herein by reference.

FIELD OF THE INVENTION

The present invention relates to a coin depositing and dispensing machine capable of depositing and dispensing a coin.

BACKGROUND ART

As a coin depositing and dispensing machine capable of depositing and dispensing a coin, coin depositing and dispensing machines disclosed in, for example, Patent Documents 1 to 4 have been conventionally known. Patent Document 1 discloses a coin depositing and dispensing machine in which a coin having been put into a machine body from a coin receiving opening is sorted by denomination, the coin is stored into one of storing and feeding units of a corresponding denomination, and the coin stored in the storing and feeding unit is fed out from the storing and feeding unit so as to be dispensed to an outside of the machine body. The plurality of storing and feeding units disposed for respective denominations are of a belt type in which a coin is fed out by a belt. The plurality of storing and feeding units are arranged along a coin transport path extending in a depth direction of the machine body.

In addition, Patent Document 2 discloses a coin depositing and dispensing machine in which a coin having been put into a machine body from a coin receiving opening is sorted by denomination, the coin is stored into one of storing and feeding units of a corresponding denomination, and the coin stored in the storing and feeding unit is fed out from the storing and feeding unit so as to be dispensed to an outside of the machine body. The storing and feeding unit of the coin depositing and dispensing machine disclosed in Patent Document 2 is of a rotating-disk type using a rotating disk that is inclined at a predetermined angle relative to the vertical direction and is configured to be rotated in an inclined posture. Similarly to the coin depositing and dispensing machine disclosed in Patent Document 1, in the coin depositing and dispensing machine disclosed in Patent Document 2, the plurality of storing and feeding units are arranged along a coin transport path extending in a depth direction of the machine body.

In addition, in a coin depositing and dispensing machine disclosed in Patent Document 3, a machine body includes a coin feeding apparatus configured to store a coin having been put into the machine body from a coin receiving opening, and to feed out the coin stored therein. As such a coin feeding apparatus, there is used an apparatus having a rotating disk that is inclined at a predetermined angle relative to the vertical direction and is configured to be rotated in an inclined posture. More specifically, in the coin feeding apparatus of the coin depositing and dispensing machine disclosed in Patent Document 3, a plurality of projecting members are disposed on positions near to a peripheral portion of a surface of the rotating disk. A coin in a lower area of the rotating disk is caught by any of the projecting members, and the coin is transported from the lower area of the rotating disk to an upper area thereof by the rotation of the rotating disk. A guide member is disposed on the upper area of the rotating disk, and the coin having been transported by the projecting member to the upper area of the rotating disk is fed out by the guide member to an outside of the rotating disk. In addition, a delivery disk having a diameter smaller than that of the rotating disk is disposed above the rotating disk. The coin having been transported to the upper area of the rotating disk by the projecting member is fed out by the delivery disk to an outside of the coin feeding apparatus.

In the coin feeding apparatus of the coin depositing and dispensing machine disclosed in Patent Document 3, the delivery disk of a smaller diameter is configured to be rotated at a higher speed than the rotating disk of a larger diameter. When coins are sent from the rotating disk to the delivery disk, a gap between a coin and a coin succeeding thereto increases. After coins of the preset number have been fed out from the coin feeding apparatus by the delivery disk, a stop pin is projected toward a gap between the coin of an order equal to the preset number and a succeeding coin, so that no more coin is fed out from the coin feeding apparatus.

In addition, a conventional coin depositing and dispensing machine disclosed in Patent Document 4 includes: a coin storing and feeding unit configured to store a recyclable coin; a collection box configured to store a non-recyclable coin as a collection coin; and an overflow box configured to store an overflow coin that is recyclable but cannot be stored in the coin storing and feeding unit because this coin storing and feeding unit is full. The collection coin stored in the collection box is collected together with the collection box from the coin depositing and dispensing machine, after opening hours of a shop. In such a coin depositing and dispensing machine, when the coin storing and feeding unit comes short of coins, the overflow box is removed from the machine body, and coins in the overflow box are put into a coin receiving opening so that the coin storing and feeding unit is replenished with the overflow coins.

Patent Document 1: WO2008/093420A1
Patent Document 2: JP63-59199A
Patent Document 3: WO2007/034699A1
Patent Document 4: JP06-051962U

SUMMARY OF THE INVENTION

In the conventional coin depositing and dispensing machines disclosed in Patent Document 1, Patent Document 2 and so on, since the plurality of storing and feeding units are arranged along the coin transport path extending in the depth direction of the machine body, the following problems occurs. Namely, the size of the machine body in the depth direction is large, whereby an installation space of the coin depositing and dispensing machine is limited. On the other hand, when the size of the machine body of the conventional coin depositing and dispensing machine is reduced in the depth direction, the storing and feeding units of a belt type or a rotating-disk type should be made smaller, which invites decrease in coin storing capacity.

In addition, in the coin feeding apparatus of the conventional coin depositing and dispensing machine disclosed in Patent Document 3 and so on, when coins having widely different diameters depending on denominations, e.g., Euro coins are fed out, there is a possibility that two or more coins of a relatively smaller diameter might be caught by one projecting member. In this case, when the two or more coins having been caught by the one projecting member are simultaneously fed out by the guide member to the outside of the rotating disk, a problem such as jam might occur in a coin transporting mechanism provided on a downstream side of the coin feeding apparatus, resulting in apparatus error. In addition, when the two or more coins are simultaneously fed out to the outside of the rotating disk, a count sensor disposed on an outlet of the coin feeding apparatus may possibly count the number of coins as one, which leads excessive feeding and miscount. Namely, even when coins have widely different diameters depending on denominations, there is desired a coin feeding out apparatus capable of not simultaneously feeding out two or more coins having relatively a smaller diameter to the outside of the rotating disk.

In addition, in the conventional coin depositing and dispensing machine disclosed in Patent Document 4, since the three storing means, i.e., the coin storing and feeding unit, the collection box and the overflow box should be provided, there are problems in that the structure inside the machine body is complicated as well as an outer shape of the coin depositing and dispensing machine is large. Thus, in the conventional coin depositing and dispensing machine, in order to make smaller the machine and to reduce cost, there is used a countermeasure in which the collection box is omitted and an overflow coin and a collection coin are stored in a mixed state in the overflow box. However, in a case where such a countermeasure is employed, when the coin storing and feeding unit is replenished with coins in the overflow box, a collection coin is again returned to the overflow box. Thus, even when the operation for replenishing the coin storing and feeding unit with the coins in the overflow box is performed plural times, the collection coin remains forever in the overflow box, whereby the collection coin cannot be suitably collected.

In addition, in the conventional coin feeding apparatus disclosed in Patent Document 3, since the delivery disk should be provided above the rotating disk, an installation space of the delivery disk is needed, which increases an installation space of the apparatus as a whole. Moreover, the installation of the delivery disk increases cost. On the other hand, when the installation of the delivery disk is omitted, the coin feeding operation must be precisely controlled by using certain means in place of the stop pin, lest a coin in excess of the preset number is fed out from the coin feeding apparatus.

The present invention has been made in view of the above circumferences. The object of the present invention is to provide a coin depositing and dispensing machine in which a plurality of storing and feeding units are vertically arranged on plural levels, and the respective storing and feeding units are arranged such that a transport direction in which a coin is transported by a deposited-coin transport unit and a feeding direction in which a coin is fed out from each storing and feeding unit are substantially perpendicular to each other, whereby a size of a machine body in a depth direction can be reduced, without decrease in coin storing capacities of the respective storing and feeding units.

Another object of the present invention is to provide a coin feeding apparatus in which a rotating disk is provided with a coin elimination unit so that two or more coins are prevented from being simultaneously fed out by a guide member to an outside of the rotating disk, and a coin depositing and dispensing machine including the coin feeding apparatus.

Yet another object of the present invention is to provide a money handling apparatus in which installation of a collection box can be omitted, the money handling apparatus being capable of suitably performing a collection operation for collecting collection money other than overflow money, by selectively performing any one of a first mode in which collection money is sent from a transport unit to an overflow unit and a second mode in which collection money is sent from the transport unit to a money dispensing opening.

Still another object of the present invention is to provide a coin feeding apparatus, a coin depositing and dispensing machine and a coin feeding method which are capable of preventing an excessive coin from being fed to an outside from the coin feeding apparatus by a simple structure without providing any additional member such as a delivery disk, in which, when coins of the preset number have been fed to an outside through a coin outlet, a rotating disk is stopped at a position where a projecting member disposed on the rotating disk blocks the coin outlet, whereby a coin in excess of the preset number can be reliably prevented from being fed out to the outside from the coin outlet.

A coin depositing and dispensing machine of the present invention is a coin depositing and dispensing machine including: a coin receiving opening configured to receive a coin from an outside of a machine body; a pooling and feeding apparatus to which the coin having been received through the coin receiving opening is sent to be pooled, the pooling and feeding apparatus configured to feed out, one by one, a coin pooled therein; a deposited-coin transport unit configured to transport, one by one, the coin having been fed out by the pooling and feeding apparatus; a recognition unit disposed on the deposited-coin transport unit, the recognition unit configured to recognize the coin transported by the deposited-coin transport unit; and a plurality of coin storing and feeding units disposed below the deposited-coin transport unit, the coin being sent from the deposited-coin transport unit to any of the coin storing and feeding units to be stored therein, by a sorting unit disposed on the deposited-coin transport unit based on a coin recognition result by the recognition unit, and the storing and feeding units configured to feed out, one by one, the coin stored therein; wherein: the plurality of storing and feeding units are vertically arranged on plural levels; and a transport direction in which a coin is transported by the deposited-coin transport unit and a feeding direction in which a coin is fed out from each storing and feeding unit are substantially perpendicular to each other.

According to such a coin depositing machine, the plurality of storing and feeding units are vertically arranged on plural levels; and a transport direction in which a coin is transported by the deposited-coin transport unit and a feeding direction in which a coin is fed out from each storing and feeding unit are substantially perpendicular to each other. Since the plurality of storing and feeding units are vertically arranged on plural levels, a size of the machine body of the coin depositing and dispensing machine in a depth direction can be reduced, as compared with a case in which the plurality of storing and feeding units are transversely arranged in a line below the deposited-coin transport unit. In addition, if the transport direction in which a coin is transported by the deposited-coin transport unit and the feeding direction in which a coin is fed out from each storing and feeding unit are in parallel with each other, since the storing and feeding unit has a somewhat large length in a right and left direction and a dispensing space is needed between the respective storing and feeding units, the machine body of the coin depositing and dispensing machine is large in the transport direction in which a coin is transported by the deposited-coin transport unit, i.e., in the depth direction. On the other hand, in the coin depositing and dispensing machine of the present invention, since the transport direction in which a coin is transported by the deposited-coin transport unit and the feeding direction in which a coin is fed out from each storing and feeding unit are substantially perpendicular to each other, the size of the machine body of the coin depositing and dispensing machine can be reduced in the depth direction. Namely, according to the coin depositing and dispensing machine of the present invention, the size of the machine body in the depth direction can be reduced without decrease in coin storing capacities of the respective storing and feeding units.

In the aforementioned coin depositing and dispensing machine, each storing and feeding unit may include: a rotating disk that is inclined at a predetermined angle relative to the vertical direction, and is configured to be rotated in an inclined posture; and a cover member forming a coin storing space for storing a coin, between a surface of the rotating disk and the cover member.

The aforementioned coin depositing and dispensing machine may further include a coin dispensing opening configured to dispense a coin to an outside of the machine body; and a coin-to-be-dispensed transport unit configured to transport a coin having been fed out from each storing and feeding unit to the coin dispensing opening.

At this time, the coin-to-be-dispensed transport unit may include a first coin-to-be-dispensed transport portion disposed below the plurality of storing and feeding units to extend in substantially a horizontal direction, and a second coin-to-be-dispensed transport portion configured to transport a coin having been sent from the first coin-to-be-dispensed transport portion to the coin dispensing opening; a coin dispensing space along which a coin having been fed out from each storing and feeding unit may drop onto the first coin-to-be-dispensed transport portion, is formed on one lateral side of the plurality of storing and feeding units; and a chute configured to transport a coin from the sorting unit disposed on the deposited-coin transport unit to each storing and feeding unit, may be formed on the other lateral side of the plurality of storing and feeding units.

In the aforementioned coin depositing and dispensing machine, the deposited-coin transport unit may include a first deposited-coin transport portion extending in substantially a horizontal direction, a returning deposited-coin transport portion configured to transport a coin having been sent from the first deposited-coin transport portion and to change a transport direction of the coin to a reverse direction, and a second deposited-coin transport portion extending in substantially the horizontal direction, the second deposited-coin transport portion configured to transport the coin having been sent from the returning deposited-coin transport portion; and the sorting units may be disposed on the first deposited-coin transport portion and the second deposited-coin transport portion, respectively.

In the aforementioned coin depositing and dispensing machine, the plurality of storing and feeding units may be vertically arranged on three levels or more.

In the aforementioned coin depositing and dispensing machine, the plurality of storing and feeding units may be of the same structure.

A coin feeding apparatus of the present invention includes:

a rotating disk that is inclined at a predetermined angle relative to a vertical direction, and is configured to be rotated in an inclined posture;

a cover member forming a coin storing space for storing a coin, between a surface of the rotating disk and the cover member;

a plurality of transport projecting members disposed on the surface of the rotating disk on a side of the coin storing space, the respective transport projecting members disposed on positions near to a peripheral portion of the rotating disk, and each transport projecting member configured to catch a coin on the surface of the rotating disk and to transport the coin in a lower area of the rotating disk to an upper area of the rotating disk by the rotation of the rotating disk;

a guide member disposed to be opposed to the surface of the rotating disk in the upper area on the side of the coin storing space, the guide member configured to guide the coin having been transported to the upper area of the rotating disk with the transport projecting member by the rotation of the rotating disk to be present on the surface of the rotating disk, such that the coin is fed to an outside of the rotating disk; and a coin elimination unit disposed on the rotating disk, the coin elimination unit configured, if two or more coins are caught by one of the transport projecting members and the coins are guided by the guide member in the upper area of the rotating disk, to cause only one of the coins caught by the one transport projecting member not to float up from the surface of the rotating disk and to cause one or more coins other than the only one coin to float up from the surface of the rotating disk, so that the other coins are caught by the guide member to drop to the lower area of the rotating disk.

According to such a coin feeding apparatus, the coin elimination unit is disposed on the rotating disk, and the coin elimination unit is configured, if two or more coins are caught by one of the transport projecting members and the coins are guided by the guide member in the upper area of the rotating disk, to cause only one of the coins caught by the one transport projecting member not to float up from the surface of the rotating disk and to cause one or more coins other than the only one coin to float up from the surface of the rotating disk, so that the other coins are caught by the guide member to drop to the lower area of the rotating disk. Due to the provision of the coin elimination unit, it can be prevented that two or more coins are simultaneously fed out by the guide member from the rotating disk to an outlet of the coin feeding apparatus through a guide channel.

In the aforementioned coin feeding apparatus, the coin elimination unit may be configured such that, when one coin having a largest diameter, among coins of various denominations to be fed out by the coin feeding apparatus, is transported with one of the transport projecting members by the rotation of the rotating disk, the coin is caused not to float up from the surface of the rotating disk.

In addition, the coin elimination unit may be configured such that, when two or more coins are caught by one of the transport projecting members, and each of the second coin and a coin succeeding thereto is caused to float up from the surface of the rotating disk, a front part of each coin is caused to float up in the rotating direction of the rotating disk, wherein the front part of each of the second coin and a coin succeeding thereto floating up from the surface of the rotating disk is caught by the guide member to drop to the lower area of the rotating disk, without being fed out by the guide member to the outside of the rotating disk.

At this time, when two or more coins are caught by the one transport projecting member, a height at which the front part of each of the second coin and a coin succeeding thereto floats up from the rotating disk, may be larger than a height of a position at which the guide member should catch the second coin and a coin succeeding thereto.

In the aforementioned coin feeding apparatus, the coin elimination unit may be a plurality of elimination projecting members disposed on the surface of the rotating disk on the side of the coin storing space.

At this time, the respective elimination projecting members may be located closer to the center of the rotating disk than the respective transport projecting members.

Alternatively, each elimination projecting member may be formed integrally with each transport projecting member.

In the aforementioned coin feeding apparatus, the coin elimination unit may be movable between a projecting position projecting into the coin storing space from the surface of the rotating disk on the side of the coin storing space, and a withdrawn position withdrawn from the coin storing space into the rotating disk. When the coin elimination unit comes close to the guide member by the rotation of the rotating disk, the coin elimination unit may be moved from the withdrawn position to the projecting position.

A coin depositing and dispensing machine of the present invention includes:

a coin receiving opening configured to receive a coin from an outside of a machine body;

a coin dispensing opening configured to dispense a coin to the outside of the machine body; and the aforementioned coin feeding apparatus to which the coin having been received through the coin receiving opening is sent to be stored therein;

wherein a coin having been fed out from the coin feeding apparatus is sent to the coin dispensing opening.

A money handling apparatus of the present invention is a money handling apparatus configured to handle money, including:

a money receiving opening configured to receive money from an outside of an apparatus body;

a money dispensing opening configured to dispense money to the outside of the apparatus body;

a transport unit configured to transport the money having been received through the money receiving opening from the outside of the apparatus body;

a recognition unit disposed on the transport unit, the recognition unit configured to recognize the money transported by the transport unit;

a plurality of storing and dispensing units to which the money is sent from the transport unit based on a money recognition result by the recognition unit, each storing and dispensing unit configured to store the money and to dispense the money stored therein;

an overflow unit configured to store overflow money incapable of being stored in each storing and dispensing unit, and collection money to be collected from the money handling apparatus; and a control unit for controlling the transport unit, the control unit configured to selectively perform any one of a first mode in which the collection money is sent from the transport unit to the overflow unit, and a second mode in which the collection money is transported from the transport unit to the money dispensing opening.

According to such a money handling apparatus, there is provided the overflow unit configured to store overflow money incapable of being stored in each storing and dispensing unit, and collection money to be collected from the money handling apparatus, and the control unit is configured to selectively perform any one of a first mode in which the collection money is sent from the transport unit to the overflow unit, and a second mode in which the collection money is transported from the transport unit to the money dispensing opening. Thus, installation of a collection box can be omitted. In addition, since the control unit performs the second mode in which collection money is sent from the transport unit to the money dispensing opening, a collection operation for collecting collection money other than overflow money can be suitably performed. Namely, upon replenishment of the storing and dispensing units with overflow money in the overflow unit, if the control unit performs the second mode, there is no possibility that collection money is again returned to the overflow unit. Thus, it can be prevented that collection money remains forever in the overflow unit even when a replenishing operation for replenishing the storing and dispensing units with overflow money in the overflow unit is performed plural times.

In the aforementioned money handling apparatus, the control unit may be configured to usually control the transport unit by the first mode, and when the money stored in the overflow unit is put into the money receiving opening, the control unit may be configured to control the transport unit by the second mode.

In the aforementioned money handling apparatus, the control unit may set beforehand a type of the collection money.

The aforementioned money handling apparatus may further include a mode input unit configured to input to the control unit which of the first mode or the second mode is to be performed.

The aforementioned money handling apparatus may further include a type input unit configured to input to the control unit a type of the collection money to be sent from the transport unit to the money dispensing opening, wherein, when a performance of the second mode is inputted to the control unit through the mode input unit, a type of the collection money to be sent from the transport unit to the money dispensing opening may be inputted to the control unit through the type input unit.

The aforementioned money handling apparatus may further include an operator-information input unit configured to input to the control unit operator's information, wherein only when operator's information having been inputted to the control unit through the operator-information input unit satisfies a predetermined condition set by the control unit beforehand, a performance of the second mode can be inputted to the control unit through the mode input unit.

The aforementioned money handling apparatus may further include an announcement unit configured to give an announcement to an operator, wherein while the first mode is performed by the control unit, when the collection coin is sent to the overflow unit, the announcement unit announces that the collection coin is sent to the overflow unit.

The aforementioned money handling apparatus may further include an announcement unit configured to give an announcement to an operator, wherein, while the second mode is performed by the control unit, when the collection money is sent to the money dispensing opening, the announcement unit announces that the the collection money is sent to the money dispensing opening.

In the aforementioned money handling apparatus, the overflow unit may be removable from the machine body of the money handling apparatus.

The aforementioned money handling apparatus may further include a feeding unit configured to feed out the money stored in the overflow unit from the overflow unit, and a replenishment transport unit configured to send the money fed out by the feeding unit to the transport unit.

In the aforementioned money handling apparatus, the transport unit may be provided with an overflow-money sorting unit, whereby the overflow money and the collection money are directly sent from the transport unit to the overflow unit by the overflow-money sorting unit.

A coin feeding apparatus of the present invention includes:

a rotating disk that is inclined at a predetermined angle relative to a vertical direction, and is configured to be rotated in an inclined posture;

a cover member forming a coin storing space for storing a coin, between a surface of the rotating disk and the cover member;

a plurality of transport projecting members disposed on the surface of the rotating disk on a side of the coin storing space, each projecting member configured to catch a coin on the surface of the rotating disk and to transport the coin in a lower area of the rotating disk to an upper area of the rotating disk by the rotation of the rotating disk;

a coin outlet disposed near to the upper area of the rotating disk, through which the coin having been transported to the upper area of the rotating disk by one of the projecting members is dispensed from the coin storing space to an outside;

a rotating-disk drive unit configured to drive the rotating disk in rotation; and a control unit for controlling the rotating-disk drive unit, the control unit configured to stop the rotating disk at a position where one of the projecting members blocks the coin outlet, when coins of the preset number have been dispensed from the coin storing space to the outside through the coin outlet.

According to the coin feeding apparatus, the control unit for controlling the rotating-disk drive unit is configured to stop the rotating disk at a position where one of the projecting members blocks the coin outlet, when coins of the preset number have been dispensed from the coin storing space to the outside through the coin outlet Since the rotating disk is stopped at a position where a projecting member disposed on the rotating disk blocks the coin outlet, when coins of the preset number have been dispensed to the outside through the coin outlet, the projecting member does not allow a coin to be sent from the coin storing space to the coin outlet, whereby a coin in excess of the preset number can be reliably prevented from being dispensed from the coin outlet to the outside. Thus, an excessive coin can be prevented from being fed out from the coin feeding apparatus to the outside, by a simple structure without providing any additional member such as a delivery disk.

In the aforementioned coin feeding apparatus, when the coins of the preset number have been fed out from the coin storing space to the outside through the coin outlet, the control unit may be configured to control the rotating-disk drive unit such that the rotating disk is stopped at a position where a projecting member having transported the coin of an order equal to the preset number blocks the coin outlet.

The aforementioned coin feeding apparatus may further include a coin passage along which a coin having been dispensed from the coin storing space to the outside through the coin outlet is transported, wherein:

the coin passage is provided with a first coin detection unit configured to detect the coin having been dispensed from the coin storing space to the outside through the coin outlet; and the control unit controls the rotating-disk drive unit such that the rotating disk is stopped after the coin of an order equal to the preset number has been detected by the first coin detection unit.

Alternatively, a guide lever may be movably disposed near to the coin outlet, the guide lever configured to guide a coin having been dispensed from the coin storing space to the outside through the coin outlet. When a coin is dispensed from the coin storing space to the outside through the coin outlet, the guide lever may be configured to come into contact with the coin to guide the coin. There may be further disposed a guide-lever detection unit configured to detect that the guide lever has been moved. Based on a detection of the movement of the guide lever by the guide-lever detection unit, the control unit may be configured to control the rotating-disk drive unit such that the rotating disk is stopped after it has been detected that coins of the preset number have been dispensed from the coin storing space to the outside through the coin outlet.

Alternatively, there may be disposed a second coin detection unit configured to detect that, when a coin on the rotating disk has been transported by the projecting member to reach a predetermined position on the rotating disk, the coin has reached the predetermined position. The control unit may be configured to control the rotating-disk drive unit such that the rotating disk is stopped after the coin of an order equal to the preset number has been detected by the second coin detection unit.

Alternatively, there may be further disposed a rotating-disk position detection unit configured to detect a rotating position of the rotating disk. The control unit may be configured to control the rotating-disk drive unit such that the rotating disk is stopped, after a predetermined period of time has passed from when the rotating-disk position detection unit detected that the rotating disk reached a predetermined rotating position after coins of the preset number had been dispensed from the coin storing space to the outside through the coin outlet.

Alternatively, there may be further disposed a rotating member configured to be rotated synchronically with the rotating disk, and a rotating-member position detection unit configured to detect a rotating position of the rotating member. The control unit may be configured to control the rotating-disk drive unit such that the rotating disk is stopped, after a predetermined period of time has passed from when the rotating-member position detection unit detected that the rotating member reached a predetermined rotating position after coins of the preset number had been dispensed from the coin storing space to the outside through the coin outlet.

Alternatively, there may be further disposed a projecting-member detection unit configured to detect a projecting member disposed on the rotating disk. The control unit may be configured to control the rotating-disk drive unit such that the rotating disk is stopped, after a predetermined period of time has passed from when the projecting-member detection unit detected that the projecting member reached a predetermined position after coins of the preset number had been dispensed from the coin storing space to the outside through the coin outlet.

In the aforementioned coin feeding apparatus, each projecting member may have a projecting portion for transporting configured to catch a coin on the surface of the rotating disk and to transport the coin, and a projecting portion for closing configured to close the coin outlet.

At this time, the projecting portion for transporting of each projecting member and the projecting portion for closing thereof may be integrally provided.

Alternatively, the projecting portion for transporting of each projecting member and the projecting portion for closing thereof may be separately provided from each other.

In the aforementioned coin feeding apparatus, the rotating-disk drive unit may be formed of a stepping motor.

In the aforementioned coin feeding apparatus, the control unit may be configured to control the rotating-disk drive unit such that, after the rotating disk has been once stopped, the rotating disk is rotated reversely to the coin feeding direction, and the rotating disk is stopped again at a position where the projecting member blocks the coin outlet.

A coin feeding apparatus of the present invention includes:

a rotating disk with a coin storing space for storing a coin being formed thereabove;

a guide member disposed on the rotating disk;

a coin outlet disposed near to the rotating disk, through which a coin on the rotating disk that is guided by the guide member is dispensed from the coin storing space to an outside;

a rotating-disk drive unit configured to drive the rotating disk in rotation; and a control unit for controlling the rotating-disk drive unit, the control unit configured to control the rotating-disk drive unit such that the rotating disk is stopped at a position where the guide member blocks the coin outlet, when coins of the preset number have been dispensed from the coin storing space to the outside through the coin outlet.

According to the coin feeding apparatus, the control unit for controlling the rotating-disk drive unit is configured to control the rotating-disk drive unit such that the rotating disk is stopped at a position where the guide member blocks the coin outlet, when coins of the preset number have been dispensed from the coin storing space to the outside through the coin outlet. Since the rotating disk is stopped at a position where the guide member disposed on the rotating disk blocks the coin outlet when coins of the preset number have been dispensed from the coin storing space to the outside through the coin outlet, the guide member does not allow a coin to be sent from the coin storing space to the coin outlet, whereby a coin in excess of the preset number can be reliably prevented from being dispensed from the coin outlet to the outside. Thus, an excessive coin can be prevented from being fed out from the coin feeding apparatus to the outside, by a simple structure without providing any additional member such as a delivery disk.

A coin depositing and dispensing machine of the present invention includes:

a coin receiving opening configured to receive a coin from an outside of a machine body;

a coin feeding apparatus to which the coin having been received through the coin receiving opening is sent to be stored;

a coin dispensing opening configured to dispense a coin to the outside of the machine body; and a control unit configured to control the coin feeding apparatus;

wherein:

the coin feeding apparatus includes:

a rotating disk that is inclined at a predetermined angle relative to a vertical direction, and is configured to be rotated in an inclined posture;

a cover member forming a coin storing space for storing a coin, between a surface of the rotating disk and the cover member;

a plurality of projecting members disposed on the surface of the rotating disk on a side of the coin storing space, each projecting member configured to catch a coin on the surface of the rotating disk and to transport the coin in a lower area of the rotating disk to an upper area of the rotating disk by the rotation of the rotating disk;

a coin outlet disposed near to the upper area of the rotating disk, through which the coin having been transported to the upper area of the rotating disk by one of the projecting members is dispensed from the coin storing space to the outside; and a rotating-disk drive unit configured to drive the rotating disk in rotation;

the coin having been fed out from the coin feeding apparatus is sent to the coin dispensing opening; and the control unit is configured to control the rotating-disk drive unit of the coin feeding apparatus such that the rotating disk is stopped at a position where one of the projecting members blocks the coin outlet, when coins of the preset number have been dispensed from the coin storing space in the coin feeding apparatus to the outside through the coin outlet.

A coin feeding method of the present invention includes:

rotating a rotating disk to transport a coin on the rotating disk by catching the coin with a projecting member disposed on a surface of the rotating disk so as to dispense the coin having been transported by the projecting member to an outside through a coin outlet; and stopping the rotating disk at a position where the projecting member blocks the coin outlet when coins of the preset number have been dispensed to the outside through the coin outlet.

BRIEF DESCRIPTION OF THE DRAWINGS

FIG. 3 is a structural view showing a structure of a pooling and feeding apparatus in the coin depositing and dispensing machine shown in FIG. 1 and so on;

FIGS. 5(A) and 5(B) are sectional views showing a structure of a sorting unit in the coin depositing and dispensing machine shown in FIG. 1 and so on;

FIG. 6 is a structural view showing a structure of a storing and feeding apparatus in the coin depositing and dispensing machine shown in FIG. 1 and so on;

FIG. 13 is a functional block view of the coin depositing and dispensing machine shown in FIG. 11 and so on;

FIG. 14 is a flowchart showing a depositing operation in the coin depositing and dispensing machine shown in FIG. 11 and so on;

FIG. 20 is a functional block view of the coin depositing and dispensing machine shown in FIG. 18 and so on;

FIG. 21 is a structural view showing a structure of a storing and feeding apparatus in the coin depositing and dispensing machine shown in FIG. 18 and so on;

FIG. 24 is a functional block view of the storing and feeding apparatus shown in FIG. 21 and so on;

FIG. 29 is a structural view showing structures of a delivery disk and a deposited-coin transport unit in the coin depositing and dispensing machine shown in FIG. 18 and so on;

DETAILED DESCRIPTION OF THE INVENTION

First Embodiment

Figure 1:
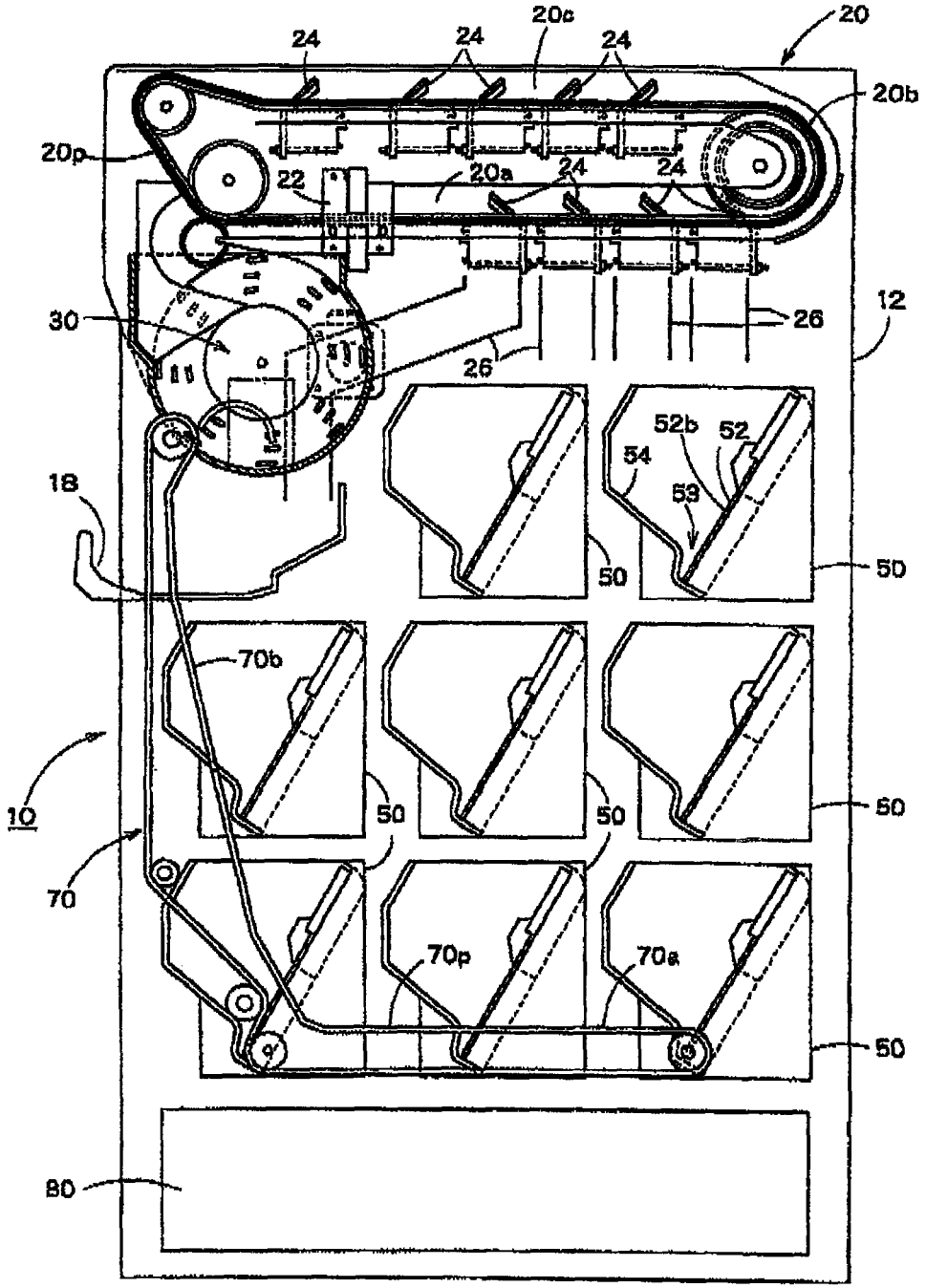
FIG. 1 a side view schematically showing an inside structure of a coin depositing and dispensing machine in a first embodiment of the present invention.
Figure 2:
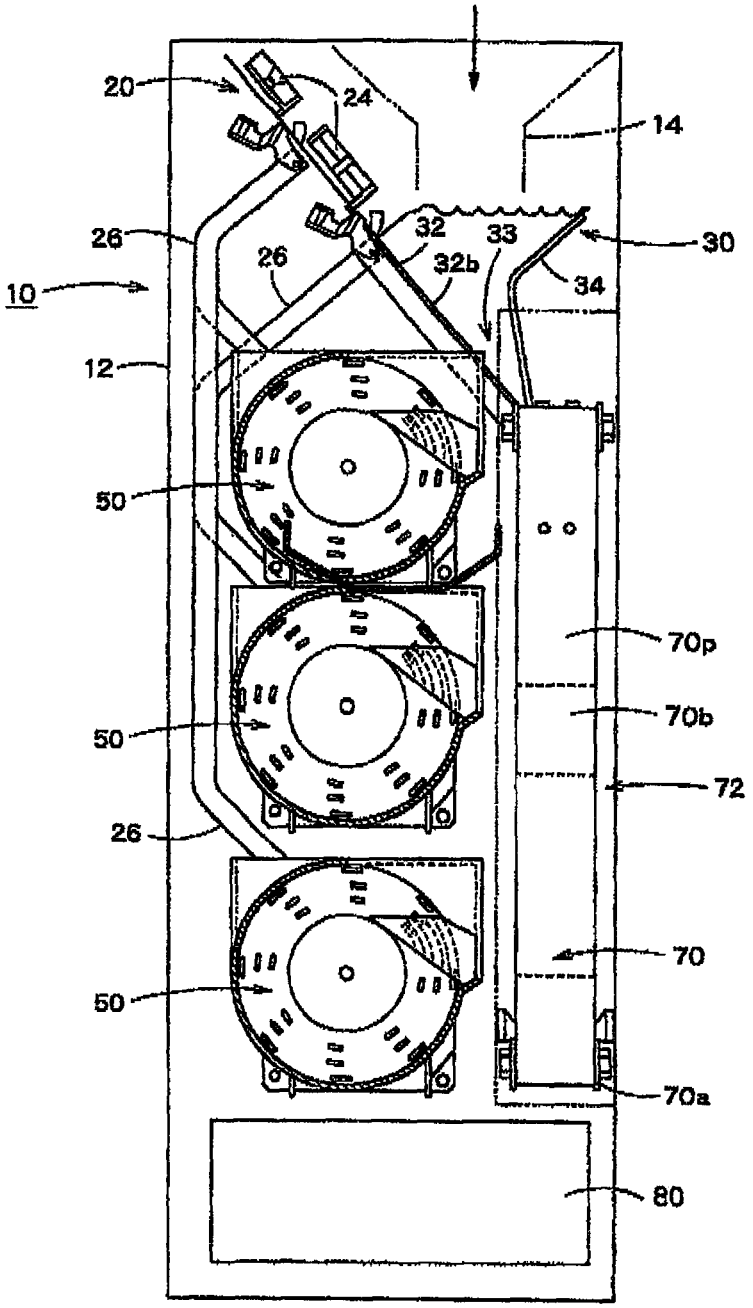
FIG. 2 is a front view of the coin depositing and dispensing machine shown in FIG. 1.
Figure 3:
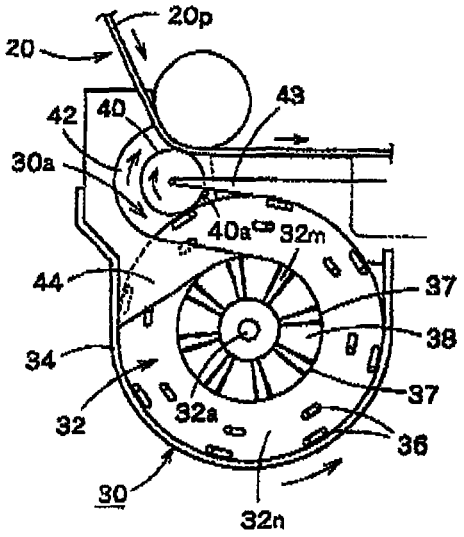
Figure 4A:
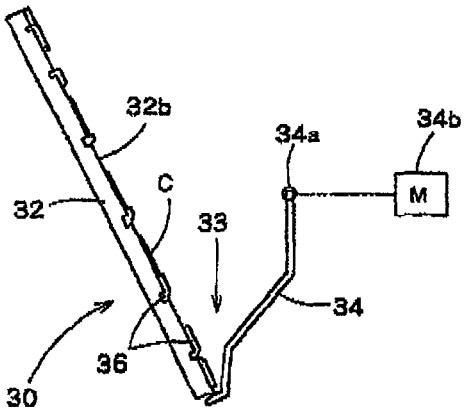
FIG. 4(A) is a side view of the pooling and feeding apparatus shown in FIG. 3, showing a state where a cover member is closed so that a coin storing space is formed between the cover member and a surface of a rotating disk.
Figure 4B:
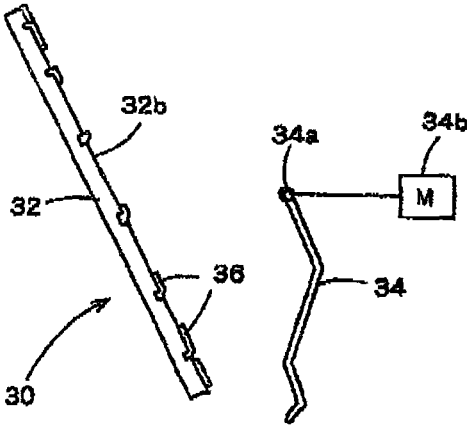
FIG. 4(B) is a side view of the pooling and feeding apparatus shown in FIG. 3, showing a state where the cover member is opened.
Figure 5A:
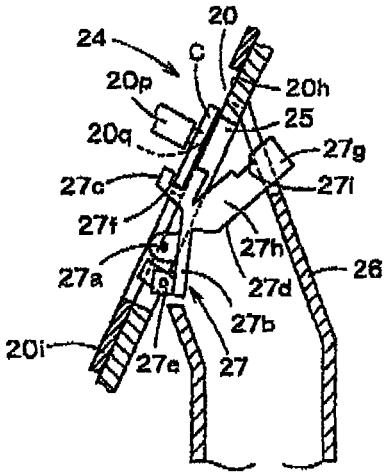
Figure 5B:
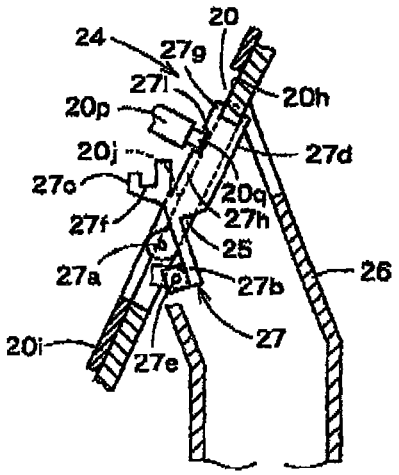
Figure 6:
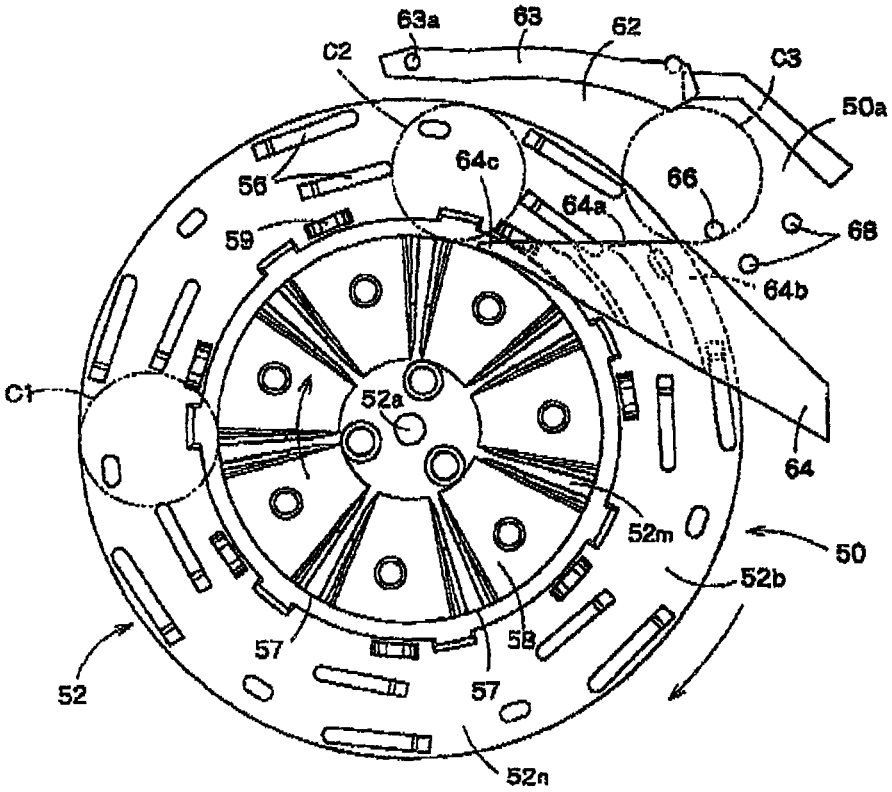
Figure 7:
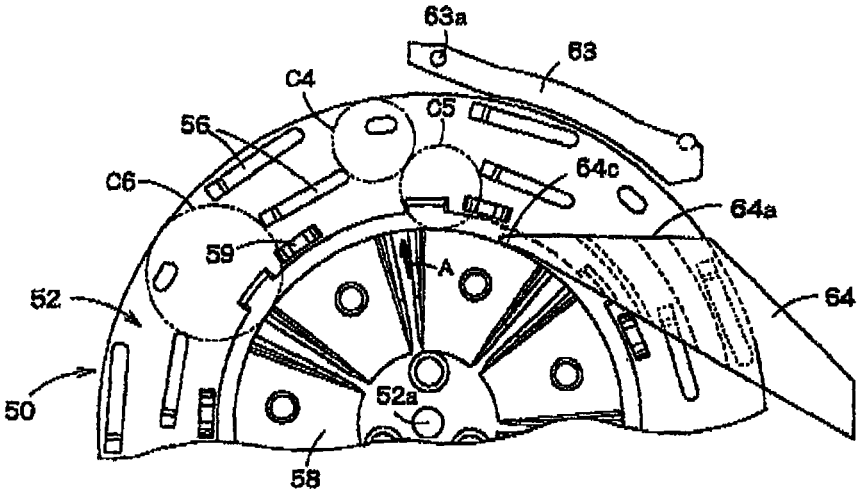
FIG. 7 is a view showing a state where two coins are caught by one transport projecting member in the storing and feeding apparatus shown in FIG. 6.
Figure 8:
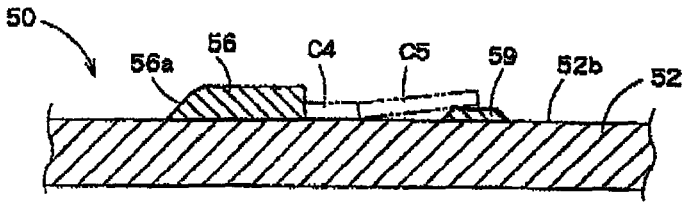
FIG. 8 is a vertical sectional view showing a structure of an elimination projecting member and so on taken in a direction A in FIG. 7.

A first embodiment of the present invention will be described herebelow with reference to the drawings. FIGS. 1 to 8 show a coin depositing and dispensing machine in the first embodiment. FIG. 1 is a side view schematically showing an inside structure of the coin depositing and dispensing machine in the first embodiment, and FIG. 2 is a front view of the coin depositing and dispensing machine shown in FIG. 1. FIGS. 3 and 4(A) and 4(B) are structural views showing a structure of a pooling and feeding apparatus in the coin depositing and dispensing machine shown in FIG. 1 and so on. FIGS. 5(A) and 5(B) are_sectional views showing a structure of a sorting unit in the coin depositing and dispensing machine shown in FIG. 1 and so on. FIGS. 6 to 8 are structural views showing a structure of a storing and feeding apparatus of the coin depositing and dispensing machine shown in FIG. 1 and so on.

As shown in FIGS. 1 and 2, a coin depositing and dispensing machine 10 includes: a housing 12 of substantially a parallelepiped shape; a coin receiving opening 14 configured to receive coins from an outside of the housing 12; and a pooling and feeding apparatus 30 to which the coin having been received through the coin receiving opening 14 is sent to be pooled therein, the pooling and feeding apparatus 30 configured to feed out, one by one, coins pooled therein. In the housing 12, there is provided a deposited-coin transport unit 20 configured to transport, one by one, the coins having been fed out from the pooling and feeding apparatus 30. The deposited-coin transport unit 20 is provided with a recognition unit 22 configured to recognize each of the coins transported by the deposited-coin transport unit 20.

In the housing 12, a plurality of (specifically eight) storing and feeding apparatuses 50 are provided below the deposited-coin transport unit 20. Based on a coin recognition result by the recognition unit 22, a coin is sent from the deposited-coin transport unit 20 to one of the storing and feeding apparatuses 50 by a sorting unit 24 (described hereafter) disposed on the deposited-coin transport unit 20. In addition, each of the storing and feeding apparatuses 50 is configured to feed out, one by one, coins stored therein. The plurality of storing and feeding apparatuses 50 are vertically arranged on plural levels.

In addition, the coin depositing and dispensing machine 10 is provided with a coin dispensing opening 18 configured to dispense coins to the outside of the housing 12. In the housing 12, there is disposed a coin-to-be-dispensed transport unit 70 configured to transport coins having been fed out from one of the storing and feeding apparatuses 50 to the coin dispensing opening 18. In addition, in the housing 12, a collection box 80 is disposed below the coin-to-be-dispensed transport unit 70.

Herebelow, details of the respective constituent elements of the coin depositing and dispensing machine 10 as structured above are described.

As shown in FIG. 2, the coin receiving opening 14 configured to receive coins having been put thereinto from the outside of the housing 12 is formed in an upper part of the housing 12. A coin having been received through the coin receiving opening 14 is sent, by an own weight thereof, to the pooling and feeding apparatus 30. The coin having been sent from the coin receiving opening 14 to the pooling and feeding apparatus 30 is temporarily pooled in the pooling and feeding apparatus 30.

The pooling and feeding apparatus 30 includes: a rotating disk 32 that is inclined at a predetermined angle relative to the vertical direction, and is configured to be rotated in an inclined posture; and a cover member 34 forming a coin pooling space 33 for pooling a coin, between a surface 32*b* of the rotating disk 32 and the cover member 34. A structure of the pooling and feeding apparatus 30 will be described in detail hereafter.

The deposited-coin transport unit 20 includes a first deposited-coin transport portion 20*a*, a returning deposited-coin transport portion 20*b*, and a second deposited-coin transport portion 20*c*. The first deposited-coin transport portion 20*a* extends in substantially a horizontal direction, and is configured to transport a coin having been fed out from the pooling and feeding apparatus 30. The returning deposited-coin transport portion 20*b* is configured to transport the coin having been sent from the first deposited-coin transport portion 20*a* and to change a transport direction of the coin to a reverse direction. The second deposited-coin transport portion 20*c* extends substantially in the horizontal direction, and is configured to transport the coin having been sent from the returning deposited-coin transport portion 20*b*. The first deposited-coin transport portion 20*a* is configured to transport a coin, one by one, in a right direction in FIG. 1. The second deposited-coin transport portion 20*c* is configured to transport a coin, one by one, in a left direction in FIG. 1. The returning deposited-coin transport portion 20*b* has a curved shape extending along a semicircle so as to change the coin transport direction from the right direction to the left direction in FIG. 1.

The deposited-coin transport unit 20 composed of the first deposited-coin transport portion 20*a*, the returning deposited-coin transport portion 20*b* and the second deposited-coin transport portion 20*c* is formed of an aisle surface 20*h* (not shown in FIGS. 1 and 2) and an endless belt 20*p* disposed along the aisle surface 20*h*. The endless belt 20*p* is wound around a plurality of pulleys. The endless belt 20*p* is cyclically moved in a counterclockwise direction in FIG. 1, by a motor disposed on one of the pulleys. In addition, the endless belt 20*p* is provided with a plurality of projecting members (not shown in FIG. 1) at equal intervals therebetween. Since one coin is caught by one of the projecting members, coins are transported, one by one, on the transport surface.

As shown in FIGS. 1 and 2, the first deposited-coin transport portion 20*a* and the second deposited-coin transport portion 20*c* are provided with a plurality of sorting units 24, respectively. More specifically, the first deposited-coin transport portion 20*a* has the four sorting units 24, and the second deposited-coin transport portion 20*c* has the five sorting units 24. In addition, as shown in FIG. 1, the recognition unit 22 is disposed on an upstream side of the respective sorting units 24 in the first deposited-coin transport portion 20*a*. The recognition unit 22 is configured to recognize a denomination, an authenticity and a fitness of a coin having been fed out from the pooling and feeding apparatus 30. Based on a coin recognition result by the recognition unit 22, the respective sorting units 24 disposed on the first deposited-coin transport portion 20*a* and the second deposited-coin transport portion 20*c* are configured to sort coins transported by the first deposited-coin transport portion 20*a* and the second deposited-coin transport portion 20*c*, and to send the coins to the coin dispensing opening 18 and the respective storing and feeding apparatuses 50. To be specific, one sorting unit 24, among the nine sorting units 24 disposed on the first deposited-coin transport portion 20*a* and the second deposited-coin transport portion 20*c*, is configured to function as a reject sorting unit. A reject coin is sorted by the sorting unit 24 and is sent to the coin dispensing opening 18. On the other hand, the eight sorting units 24, other than the sorting unit 24 functioning as the reject sorting unit, correspond to the respective storing and feeding apparatuses 50. Each sorting unit 24 is provided with a corresponding chute 26. A coin having been sorted by the sorting unit 24 is sent, through the chute 26 disposed on this sorting unit 24, to the coin dispensing opening 18 or the corresponding storing and feeding apparatus 50.

More specifically, one sorting unit 24 among the nine sorting units 24, which is located on the most upstream position in the first deposited-coin transport portion 20*a* (i.e., the sorting unit 24 located on the leftmost position among the four sorting units 24 which are disposed on the first deposited-coin transport portion 20*a* in FIG. 1) is configured to function as the reject sorting unit for sorting a reject coin. Namely, a coin that has been recognized as a reject coin, among coins having been recognized by the recognition unit 22, is sorted by the reject sorting unit and is sent to the coin dispensing opening 18. On the other hand, the eight sorting units 24 among the nine sorting units 24, which are other than the sorting unit 24 serving as the aforementioned reject sorting unit, respectively function as denomination sorting units configured to sort a coin by denomination. That is to say, based on a denomination of each coin having been recognized by the recognition unit 22, coins are sent by denomination by the respective sorting units 24 to the respective storing and feeding apparatuses 50. A concrete structure of the sorting unit 24 will be described hereafter.

The plurality of, specifically, eight storing and feeding apparatuses 50 are disposed below the deposited-coin transport unit 20. The plurality of storing and feeding apparatuses 50 are of the same structure. Specifically, each storing and feeding apparatus 50 is configured to store a coin having been sorted by the sorting unit 24 and sent from the deposited-coin transport unit 20, and to feed out, one by one, a coin stored therein to an outside of the storing and feeding apparatus 50. Each storing and feeding apparatus 50 includes: a rotating disk 52 that is inclined at a predetermined angle relative to the vertical direction, and is configured to be rotated in an inclined posture; and a cover member 54 forming a coin storing space 53 for storing a coin, between the surface 52*b* of the rotating disk 52 and the cover member 54. In the coin depositing and dispensing machine 10 in this embodiment, as shown in FIGS. 1 and 2, the plurality of storing and feeding apparatuses 50 are vertically arranged on plural levels (specifically, three levels, for example). In addition, a transport direction in which a coin is transported by the deposited-coin transport unit 20 and a feeding direction in which a coin is fed out from each storing and feeding apparatus 50 are substantially perpendicular to each other. Specifically, the transport direction in which a coin is transported by the deposited-coin transport unit 20 is a direction in parallel with a sheet surface of FIG. 1, while the feeding direction in which a coin is fed out from each storing and feeding apparatus 50 is a direction perpendicular to the sheet surface of FIG. 1. A structure of the storing and feeding apparatus 50 will be described in detail hereafter.

As described above, the coin-to-be-dispensed transport unit 70 is disposed in the housing 12. The coin-to-be-dispensed transport unit 70 is configured to transport a coin having been fed out from one of the storing and feeding apparatuses 50 to the coin dispensing opening 18. The coin-to-be-dispensed transport unit 70 includes a first coin-to-be-dispensed transport portion 70*a* disposed below the respective storing and feeding apparatuses 50 to extend in substantially the horizontal direction, and a second coin-to-be-dispensed transport portion 70*b* configured to transport a coin having been sent from the first coin-to-be-dispensed transport portion 70*a* to the coin dispensing opening 18.

The coin-to-be-dispensed transport unit 70 composed of the first coin-to-be-dispensed transport portion 70*a* and the second coin-to-be-dispensed transport portion 70*b* is formed of an endless belt 70*p* wound around a plurality of pulleys. The endless belt 70*p* is cyclically moved in the clockwise direction and the counterclockwise direction in FIG. 1, by a motor disposed on one of the pulleys. In addition, the endless belt 70*p* is provided with a plurality of projecting members (not shown) at equal intervals therebetween. Since one coin is caught by one of the projecting members, coins are transported, one by one, by the endless belt 70*p*. In addition, as shown in FIG. 2, a coin-to-be-dispensed space 72 is formed on one lateral side (right side in FIG. 2) of the respective storing and feeding apparatuses 50. A coin having been fed out from one of the storing and feeding apparatuses 50 drops through the coin-to-be-dispensed space 72 onto the endless belt 70*p* in the first coin-to-be-dispensed transport portion 70*a* of the coin-to-be-dispensed transport unit 70. In addition, on the other side of the respective storing and feeding apparatuses 50 (left side in FIG. 2), there are disposed the chutes 26 configured to transport a coin from the sorting units 24 disposed on the deposited-coin transport unit 20 to the respective storing and feeding apparatuses 50. Namely, the coin-to-be-dispensed space 72 and the chutes 26 are located on opposed positions in the right and left direction with respect to the respective storing and feeding apparatuses 50.

In the coin-to-be-dispensed transport unit 70, when the endless belt 70*p* is cyclically moved in the counterclockwise direction in FIG. 1, a coin having been fed out from one of the storing and feeding apparatuses 50 drops, by an own weight thereof, onto the endless belt 70*p* in the first coin-to-be-dispensed transport portion 70*a*, through the coin-to-be-dispensed space 72. Then, the coin on the endless belt 70*p* is sent from the first coin-to-be-dispensed transport portion 70*a* to the second coin-to-be-dispensed transport portion 70*b*. Thereafter, the coin caught by one of the projecting members of the endless belt 70*p* in the second coin-to-be-dispensed transport portion 70*b* is moved upward in FIG. 1, and is finally sent from an upper end portion of the second coin-to-be-dispensed transport portion 70*b* to the coin dispensing opening 18. On the other hand, when the endless belt 70*p* is cyclically moved in the clockwise direction in FIG. 1, a coin having been fed out from each storing and feeding apparatus 50 drops, by an own weight thereof, onto the endless belt 70*p* in the first coin-to-be-dispensed transport portion 70*a*, through the coin-to-be-dispensed space 72. Then, the coin on the endless belt 70*p* is sent from the first coin-to-be-dispensed transport portion 70*a* to the below-described collection box 80 so as to be finally stored in the collection box 80.

As described above, the collection box 80 is provided below the respective storing and feeding apparatuses 50 in the housing 12. The collection box 80 is disposed removably from the housing 12. In addition, as described above, a coin to be collected is sent to the collection box 80 from the first coin-to-be-dispensed transport portion 70*a* of the coin-to-be-dispensed transport unit 70. After a coin has been stored in the collection box 80, the coin together with the collection box 80 can be collected by an operator who takes the collection box 80 from the housing 12.

Next, the structure of the pooling and feeding apparatus 30 is described in detail with reference to FIGS. 3 and 4.

As described above, the pooling and feeding apparatus 30 includes: the rotating disk 32 that is inclined at a predetermined angle relative to the vertical direction, and is configured to be rotated in an inclined posture; and a cover member 34 forming a coin storing space for storing a coin, between the surface 32*b* of the rotating disk 32 and the cover member 34. As shown in FIGS. 4(A) and 4(B), the rotating disk 32 has a rotating shaft 32*a*. The rotating disk 32 is configured to be rotated about the rotating shaft 32*a* in the counterclockwise direction in FIG. 3 (direction shown by the arrow in FIG. 3) in a state where the rotating disk 32 is inclined at a predetermined angle relative to the vertical direction.

In the surface of the rotating disk 32, a circular higher portion 32*m* is formed in a central region, and an annular lower portion 32*n* is formed around an outer circumference of the higher portion 32*m*. Between the higher portion 32*m* of the rotating disk 32 and the lower portion 32*n* thereof, there is formed a stepped coin-periphery holding unit 37 having a size slightly smaller than a minimum thickness of a coin among coins to be handled. A periphery of the coin can be placed in a thickness direction on the coin-periphery holding unit 37. The thickness of the coin-periphery holding unit 37 may be almost the same as the minimum coin thickness.

The lower portion 32*n* of the rotating disk 32 is provided with a plurality of transport projecting members 36 projecting from the surface 32*b* of the rotating disk 32. The transport projecting members 36 are arranged at predetermined pitches along two circumferential directions, i.e., an inner circumferential direction and an outer circumferential direction. Each transport projecting member 36 on the outer circumferential side is disposed on the upstream side of each transport projecting member 36 on the inner circumferential side in the rotating direction of the rotating disk 32 (counterclockwise direction in FIG. 3). When the rotating disk 32 is rotated, the transport projecting member 36 on the inner circumferential side brings one coin from a lower area of the rotating disk 32 to the upper area thereof, in such a manner that the coin is held between the transport projecting member 36 and the cover member 34. The coin is then delivered to the transport projecting member 36 on the inner circumferential side and the coin-periphery holding unit 37. Then, the coin, which has been brought up to the upper area of the rotating disk 32 by the transport projecting member 36 on the inner circumferential side, is pushed out toward an outlet 30*a* of the pooling and feeding apparatus 30 by the transport projecting member 36 on the outer circumferential side so as to be delivered to the below-described delivery disk 40.

The coin-periphery holding unit 37 is located on a position where one coin can be held between the coin-periphery holding unit 37 and each transport projecting member 36 on the inner circumferential side. Specifically, a plurality of the coin-periphery holding units 37 are circumferentially disposed at equal intervals therebetween. Between the coin-periphery holding units 37, there is formed a sliding unit 38 along which a coin that is not held by the transport projecting member 36 on the inner circumferential side and the coin-periphery holding unit 37 slides down by an own weight of the coin. The sliding unit 38 includes a step between the higher portion 32*m* and the lower portion 32*n* as an inclined surface.

In the upper area of the rotating disk 32 of the pooling and feeding apparatus 30, there is formed a guide channel 42 configured to feed out a coin, which has been brought up to the upper area of the rotating disk 32 by the transport projecting member 36, toward the outlet 30*a* of the pooling and feeding apparatus 30. The guide channel 42 is formed between an upper guide member 43 and a lower guide member 44 in coplanar with the surface 32*b* of the rotating disk 32. The upper guide member 43 extends from the upper area of the rotating disk 32 to one peripheral portion of the outlet 30*a* of the pooling and feeding apparatus 30, in such a manner that the upper guide member 43 is slightly spaced apart from the surface 32*b* of the rotating disk 32 with a position of the upper guide member 43 being fixed. The lower guide member 44 extends from the side of the coin-periphery holding unit 37 to the other peripheral portion of the outlet 30*a* of the pooling and feeding apparatus 30, in such a manner that the lower guide member 44 is slightly spaced apart from the surface 32*b* of the rotating disk 32 with a position of the lower guide member being fixed, lest a coin enters a space between the guide member 44 and a surface of the lower portion 32*n* of the rotating disk 32. As shown in FIG. 3, an inner periphery of the lower guide member 44 facing the guide channel 42 has a curved shape. In addition, in a surface of the guide member 44 opposed to the lower portion 32*n* of the rotating disk 32, a groove (not shown) through which the rotated transport projecting members 36 can pass is formed. A coin, which has been brought by the transport projecting member 36 and so on from the lower area of the rotating disk 32 to the upper area thereof, is received by the guide member 44 from the coin-periphery holding unit 37 so as to be guided to the outlet 30*a* of the pooling and feeding apparatus 30.

In the upper area of the rotating disk 32 of the pooling and feeding apparatus 30, the delivery disk 40 is rotatably disposed such that a surface of the delivery disk 40 is in substantially coplanar with the surface 32*b* of the rotating disk 32. A projection 40*a* configured to come into contact with a coin to feed out the coin from the side of the rotating disk 32 to the guide channel 42 is disposed on an outer periphery of the delivery disk 40. The delivery disk 40 is rotated in cooperation with the endless belt 20*p* of the deposited-coin transport unit 20. When the endless belt 20*p* is rotated in the direction shown by the arrow in FIG. 3, the delivery disk 40 is rotated in the clockwise direction in FIG. 3. A coin having sent from the rotating disk 32 to the guide channel 42 is transported by the projection 40*a* of the delivery disk 40 between the upper and lower guide members 43 and 44 in the direction shown by the arrow in FIG. 3, and is finally sent to the endless belt 20*p* of the deposited-coin transport unit 20.

As shown in FIGS. 4(A) and 4(B), a bottom part of the cover member 34 forming the coin pooling space 33 between the rotating disk 32 and the cover member 34 can be opened and closed. FIG. 4(A) is a side view of the pooling and feeding apparatus 30 show in FIG. 3, showing a state where the cover member 34 closed so that the coin pooling space is formed between the cover member 34 and the surface of the rotating disk 32. FIG. 4(B) is a side view of the pooling and feeding apparatus 30 shown in FIG. 3, showing a state where the cover member is opened. As shown in FIGS. 4(A) and 4(B), the cover member 34 is rotated about a shaft 34*a*. The shaft 34*a* is provided with a drive motor 34*b* configured to rotate the shaft 34*a* in a normal direction and in a reverse direction. By the drive motor 34*b* that rotates the shaft 34*a*, the cover member 34 is reciprocated between a closed position as shown in FIG. 4(A), and an opened position as shown in FIG. 4(B).

When the cover member 34 is located at the closed position as shown in FIG. 4(A), the coin pooling space 33 is formed between the cover member 34 and the surface 32*b* of the rotating disk 32, and a plurality of coins are pooled in a mixed state in the coin pooling space 33. On the other hand, when the cover member 34 is moved from the closed position as shown in FIG. 4(A) to the opened position as shown in FIG. 4(B), various objects including a coin in the coin pooling space 33 drop from the coin pooling space 33 so as to be sent to the coin dispensing opening 18.

Next, the structure of the sorting unit 24 is described in detail with reference to FIGS. 5(A) and 5(B). FIGS. 5(A) and 5(B) are sectional views showing the sorting unit 24 disposed on the deposited-coin transport unit 20. The sorting unit 24 has an opening 25 extending from the aisle surface 20*h* of the deposited-coin transport unit 20 to a lower coin guide member 20*i*. A branching member 27 is disposed in the opening 25 such that the branching member 27 can be swung in the back and forth direction about a shaft 27*a* in parallel with an aisle direction (transport direction).

The branching member 27 includes a support portion 27*b* supported by the shaft 27*a*. On an upper end portion of the support portion 27*b*, there is provided a passage guide portion 27*c* that allows a not-branched coin to pass therethrough. In addition, a branching guide portion 27*d* is disposed on a rear part of the support portion 27*b*. The branching guide portion 27*d* is configured to take a coin to be branched into the rear side of the opening 25 so as to be branched. A drive force of each branching drive element, not shown, is transmitted to the support portion 27*b* of the branching member 27 through each arm 27*e*, so that a passage position (see FIG. 5(A)) at which the passage guide portion 27*c* is located in the opening 25 and a branched position (see FIG. 5(B)) at which the branching guide portion 27*d* is located in the opening 25 are switched to each other.

The passage guide portion 27*c* has a passage groove 27*f* of substantially a U shape in section when viewed from the coin transport direction. The passage groove 27*f* is configured to support a coin and to allow the coin to pass therethrough. When the passage guide portion 27*c* is located on the passage position shown in FIG. 5(A), a right surface of the passage groove 27*f* and a bottom surface thereof are substantially coplanar with the aisle surface 20*h* and a coin support peripheral portion 20*j* of the coin guide member 20*i*, so that the aisle surface 20*h* and the coin support peripheral portion 20*j* of the coin guide member 20*i* guide a back surface and a periphery of a lower portion of a coin to allow passage of the coin. In FIG. 5(A), a coin passing through the sorting unit 24 is indicated by a reference symbol C. A left surface of the passage groove 27*f* is spaced apart from a right surface thereof by a distance that is slightly larger than a maximum coin thickness so as to allow passage of a coin. In the branched position as shown in FIG. 5(B), the passage guide portion 27*c* is withdrawn to a front surface side of the opening 25.

The branching guide portion 27*d* is of substantially an L shape in section when viewed from the front surface. The branching guide portion 27*b* has an inclined portion 27*g* whose upper portion side is located on the upstream side in the coin transport direction in the deposited-coin transport unit 20 so as to be diagonally disposed with respect to the deposited-coin transport unit 20, and a perpendicular portion 27*h* extending from the inclined portion 27*g* perpendicularly to the coin transport direction in the deposited-coin transport unit 20. A cutout portion 27*i* is formed in the branching guide portion 27*d* in order to prevent interference between the branching guide portion 27*d* and a projecting member 20*q* of the endless belt 20*p* of the deposited-coin transport unit 20. In the branched position shown in FIG. 5(B), the branching guide portion 27*d* takes a coin, which projects from the aisle surface 20*h* toward the front side and is transported by the deposited-coin transport unit 20, into the opening 25 through the inclined portion 27*g*, the perpendicular portion 27*h* and further the rear side of the support portion 27*b*. The coin having been taken into the opening 25 is sent to the coin dispensing opening 18 or one of the storing and feeding apparatuses 50 through the chute 26. In the passage position shown in FIG. 5(A), the inclined portion 27*g* and the perpendicular portion 27*h* are withdrawn to the rear side of the opening 25.

Next, the structure of the storing and feeding apparatus 50 is described in detail herebelow with reference to FIGS. 1, 6, 7 and 8.

As shown in FIG. 1, the storing and feeding apparatus 50 includes: a rotating disk 52 that is inclined at a predetermined angle relative to the vertical direction, and is configured to be rotated in an inclined posture; and the cover member 54 forming a coin storing space 53 for storing a coin, between the surface 52*b* of the rotating disk 52 and the cover member 54. As shown in FIG. 6, the rotating disk 52 has a rotating shaft 52*a*. The rotating disk 52 is configured to be rotated about the rotating shaft 52*a* in the clockwise direction in FIG. 6 (direction shown by the arrow in FIG. 6) in a state where the rotating disk 52 is inclined at a predetermined angle relative to the vertical direction.

In the surface of the rotating disk 52, a circular higher portion 52*m* is formed in a central region, and an annular lower portion 52*n* is formed around an outer circumference of the higher portion 52*m*. Between the higher portion 52*m* of the rotating disk 52 and the lower portion 52*n* thereof, there is formed a stepped coin-periphery holding unit 57 having a size slightly smaller than a minimum thickness of a coin among coins to be handled. A periphery of the coin can be placed in a thickness direction on the coin-periphery holding unit 57.

The lower portion 52*n* of the rotating disk 52 is provided with a plurality of transport projecting members 56 projecting from the surface 52*b* of the rotating disk 52. The transport projecting members 56 are arranged at predetermined pitches along two circumferential directions, i.e., an inner circumferential direction and an outer circumferential direction. Each transport projecting member 56 on the outer circumferential side is disposed on the upstream side of each transport projecting member 56 on the inner circumferential side in the rotating direction of the rotating disk 52 (clockwise direction in FIG. 6). When the rotating disk 52 is rotated, the transport projecting member 56 on the inner circumferential side brings one coin from a lower area of the rotating disk 52 to an upper area thereof, in such a manner that the coin is held between the transport projecting member 56 and the cover member 54 (see a coin C1 in FIG. 6). The coin is then delivered to the transport projecting member 56 on the inner circumferential side and the coin-periphery holding unit 57. Then, the coin, which has been brought up to the upper area of the rotating disk 52 (see coin C2 in FIG. 6) by the transport projecting member 56 on the inner circumferential side, is pushed out toward an outlet 50*a* of the storing and feeding apparatus 50 by the transport projecting member 56 on the outer circumferential side (see coin C3 in FIG. 6).

The coin-periphery holding unit 57 is located on a position where one coin can be held between the coin-periphery holding unit 57 and each transport projecting member 56 on the inner circumferential side (see coin C1 in FIG. 6). Specifically, a plurality of the coin-periphery holding units 57 are circumferentially disposed at equal intervals therebetween. Between the coin-periphery holding units 57, there is formed a sliding unit 58 along which a coin that is not held by the transport projecting member 56 on the inner circumferential side and the coin-periphery holding unit 57 slides down by an own weight of the coin. The sliding unit 58 includes a step between the higher portion 52*m* and the lower portion 52*n* as an inclined surface.

In the upper area of the rotating disk 52 of the storing and feeding apparatus 50, there is formed a guide channel 62 configured to feed out a coin (see coin C2 in FIG. 6), which has been brought up to the upper area of the rotating disk 52, toward the outlet 50*a* of the storing and feeding apparatus 50. The guide channel 62 is provided at a position slightly lower than the surface 52*b* of the rotating disk 52 (for example, at a position lower than the surface 52*b* of the rotating disk 52 by 0.5 mm). Near to the upper area of the rotating disk 52 of the storing and feeding apparatus 50, an aligning lever 63 and a guide member 64 are disposed. The guide channel 62 is formed between the aligning lever 63 and the guide member 64.

The aligning lever 63 is located on one peripheral side of the outlet 50*a* of the storing and feeding apparatus 50. The aligning lever 63 is configured to be swung about a shaft 63*a*. When no force is applied to the aligning lever 63, a force is urged by a torsion spring (not shown) disposed on the shaft 63*a* to the aligning lever 63 in the clockwise direction about the shaft 63*a*. At this time, the aligning lever 63 is maintained at a position shown in FIG. 7. On the other hand, when a coin passes through the guide channel 62, the aligning lever 63 is configured to be pushed by the coin in the counterclockwise direction about the shaft 63*a* against the force applied by the torsion spring (see coin C3 in FIG. 6).

The guide member 64 extends from the side of the coin-periphery holding unit 57 to the other peripheral side of the outlet 50*a* of the storing and feeding apparatus 50, in such a manner that a slight gap is formed between the guide member 64 and the surface 52*b* of the rotating disk 52 lest a coin enters a space between the guide member 64 and a surface of the lower portion 52*n* of the rotating disk 52. In addition, a groove portion 64*b* is formed in a surface of the guide member 64 facing the lower portion 52*n* of the rotating disk 52. The respective rotating transport projecting members 56 and a below-described elimination projecting members 59 pass through the groove portion 64*b*. A coin, which has been brought up from the lower area of the rotating disk 52 to the upper area thereof by the transport projecting member 56, is received by the guide member 64 from the coin-periphery holding unit 57 so as to be guided to the outlet 50*a* of the storing and feeding apparatus 50. A thickness of a distal end portion 64*c* of the guide member 64 is slightly smaller than a minimum thickness of a coin among coins to be handled. The thickness of a distal end portion 64*c* of the guide member 64 will be described in detail herebelow.

A passage sensor 66 and a pair of count sensors 68 are disposed on the outlet 50*a* of the storing and feeding apparatus 50. When a coin, which has been brought up from the lower area of the rotating disk 52 to the upper area thereof and sent to the outlet 50*a* of the storing and feeding apparatus 50, passes the passage sensor 66, the passage sensor 66 is configured to detect that the coin has passed through the passage sensor 66. Meanwhile, the pair of count sensor 68 are configured to count the number of coins fed out from the outlet 50*a* of the storing and feeding apparatus 50.

In the coin depositing and dispensing machine 10 in this embodiment, the rotating disk 52 of the storing and feeding apparatus 50 is provided with the elimination projecting member 59. The elimination projecting member 59 is configured, if two or more coins are caught by one of the transport projecting members and the coins are guided by the guide member in the upper area of the rotating disk 52, to cause only one of the coins caught by the transport projecting member 56 not to float up from the surface of the rotating disk 52 and to cause one or more coins other than the only one coin to float up from the surface of the rotating disk 52. The second and succeeding coins having floated up from the surface of the rotating disk 52 are caught by the distal end portion 64*c* of the guide member 64 to drop to the lower area of the rotating disk 52. The structure of the elimination projecting member 59 is described in detail below.

As shown in FIGS. 6 and 7, a plurality of elimination projecting members 59 are circumferentially disposed at predetermined pitches on positions closer to the center of the rotating disk 52 than the respective transport projecting members 56. More specifically, a set of projection assembly is formed by one transport projecting member 56 disposed along the inner circumferential direction, the one transport projecting member 56 corresponding to the transport projecting member 56 on the inner circumferential side, which is disposed along the outer circumferential direction, and the one elimination projecting member 59 corresponding to the transport projecting member 56 on the inner circumferential side. Plural sets of the projection assemblies are located along the circumferential direction of the rotating disk 52.

A case where two coins are caught by one of the transport projecting members 56 on the inner circumferential side is described with reference to FIGS. 7 and 8. FIG. 7 is a view showing a state where two coins are caught by the one transport projecting member 56 on the inner circumferential side in the storing and feeding apparatus shown in FIG. 6. FIG. 8 is a vertical sectional view showing a structure of the elimination projecting member 59 and so on taken in a direction A in FIG. 7. FIG. 7 shows that two coins C4 and C5 are caught by the one transport projecting member 56 and brought up to the upper area of the rotating disk 52. At this time, as shown in FIG. 8, the elimination projecting member 59 corresponding to the transport projecting member 56 is configured to cause only the one coin C4 not to float up from the surface 52*b* of the rotating disk 52 and to cause the coin C5 other than the coin C4 to float up from the surface 52*b* of the rotating disk 52. To be specific, a front part (right part in FIG. 8) of each of the second coin C5 and a coin (or coins) succeeding thereto floats up from the surface 52*b* of the rotating disk 52 in the rotating direction of the rotating disk 52 (clockwise direction in FIG. 7). When the two coins C4 and C5 caught by the one of the transport projecting members 56 reach the guide member 64 in the upper area of the rotating disk 52, the coin C4 which does not float up from the surface 52*b* of the rotating disk 52 is guided to the outlet 50*a* of the storing and feeding apparatus 50 along an upper peripheral portion 64*a* of the guide member 64, while the coin C5 floating up from the surface 52*b* of the rotating disk 52 is caught by the distal end portion 64*c* of the guide member 64 so that the coin C5 is not guided by the guide member 64 but drops, by an own weight of the coin C5, to the lower area of the rotating disk 52. More specifically, since a front part of each of the second coin C5 and a coin (or coins) succeeding thereto floating up from the surface 52*b* of the rotating disk 52 is caught by the distal end portion 64*c* of the guide member 64, the coin C5 is not fed out by the guide member 64 to an outside of the rotating disk 52 but drops, by an own weight thereof, to the lower area of the rotating disk 52.

When the two coins C4 and C5 are caught by the one of the transport projecting members 56, a height at which the front part of each of the second coin C5 and a coin (or coins) succeeding thereto is caused to float up by the elimination projecting member 59 from the surface 52*b* of the rotating disk 52 is larger than a height at which the front part of each of the second coin C5 and a coin or coins) succeeding thereto should be caught by the guide member 64, specifically, a thickness of the distal end portion 64*c* of the guide member 64. To be specific, a height at which the front part of each of the second coin C5 and a coin (or coins) succeeding thereto is caused to float up from the surface 52*b* of the rotating disk 52 is 1 mm, for example, while a height at which the second coin C5 and a coin (or coins) succeeding thereto should be caught by the guide member 64 (a thickness of the distal end portion 64*c* of the guide member 64) is 0.8 mm, for example. Thus, the second coin C5 and a coin (or coins) succeeding thereto can be reliably caught by the distal end portion 64*c* of the guide member 64.

In FIG. 7, a coin having a largest diameter among coins to be handled is indicated by the reference symbol C6. As shown in FIG. 7, a position, a shape and a size of each elimination projecting member 59 are configured such that, when the coin C6 of the largest diameter is transported with the transport projecting member 56 by the rotation of the rotating disk 52, the coin C6 is caused not to float up from the surface of the rotating disk 52.

In the coin depositing and dispensing machine 10 in this embodiment, as shown in FIG. 8, the transport projecting member 56 has an inclined portion 56*a* on a rear end portion in the transport direction by the rotating disk 52. Since such an inclined portion 56*a* is formed on the transport projecting member 56, even if two or more coins are caught by one of the transport projecting members 56 on the inner circumferential side, and each of the second and a coin (or coins) succeeding thereto does not fully float up from the surface 52*b* of the rotating disk 52 so that the coin(s) cannot be caught by the distal end portion 64*c* of the guide member 64, each of the second coin and a coin (or coins) succeeding thereto is subjected to a downward force in FIG. 7 by the aligning lever 63 when being guided by the upper peripheral portion 64*a* of the guide member 64, so that the coin(s) runs on the inclined portion 56*a* on the rear end portion of the preceding transport projecting member 56 on the inner circumferential side. Thus, each of the second and a coin (or coins) succeeding thereto is caused to float up by the inclined portion 56*a* from the surface 52*b* of the rotating disk 52, so that the coin is caught by the upper peripheral portion 64*a* of the guide member 64 to drop, by an own weight of the coin, to the lower area of the rotating disk 52.

Next, an operation of the coin depositing and dispensing machine 10 as structured above is described.

When an operator puts a coin into the coin receiving opening 14 of the coin depositing and dispensing machine 10, the coin drops, by an own weight thereof, to be sent to the pooling and feeding apparatus 30. When the rotating disk 32 is rotated in the pooling and feeding apparatus 30 in the counterclockwise direction in FIG. 3, a coin pooled in the coin pooling space 33 to be present in the lower area of the rotating disk 32 is held, one by one, between the transport projecting member 36 on the inner circumferential side and the cover member 34, and is brought up from the lower area of the rotating disk 32 to the upper area thereof. Thereafter, the coin is delivered to the transport projecting member 36 on the inner circumferential side and the coin-periphery holding unit 37. The coin, which has been brought up to the upper area of the rotating disk 32 by the transport projecting member 36 on the inner circumferential side, is pushed out toward the outlet 30*a* of the pooling and feeding apparatus 30 by the transport projecting member 36 on the outer circumferential side so as to be delivered to the delivery disk 40. Then, the coin is fed out from the rotating disk 32 to the guide channel 42 by the projection 40*a* provided on the outer circumferential periphery of the delivery disk 40. The coin having been sent to the guide channel 42 is then transported by the projection 40*a* of the delivery disk 40 between the upper and lower guide members 43 and 44 in the direction shown by the arrow in FIG. 3. Finally, the coin is sent to the endless belt 20*p* of the deposited-coin transport unit 20.

The coin having been fed out from the pooling and feeding apparatus 30 to the upper transport unit 20 is transported by the endless belt 20*p* of the upper transport unit 20. Specifically, the coin is firstly recognized by the recognition unit 22. A coin that is recognized as a reject coin is sorted by the sorting unit 24 functioning as the reject sorting unit, which is located on the most upstream position in the first deposited-coin transport portion 20*a*, and the coin is sent to the coin dispensing opening 18. On the other hand, a normal coin which is not a reject coin is sorted by denomination by each sorting unit 24, based on a coin denomination having been recognized by the recognition unit 22, and is sent to be stored in the storing and feeding apparatus 50 corresponding to the sorting unit 24.

When a coin is dispensed or collected from the coin depositing and dispensing machine 10, a coin to be dispensed or collected is fed out from the storing and feeding apparatus 50 corresponding to a denomination of the coin to be dispensed or collected, and is sent to the coin-to-be-dispensed transport unit 70. Specifically, since the rotating disk 52 is rotated in the storing and feeding apparatus 50 in the clockwise direction in FIG. 6, a coin stored in the coin storing space 53 to be present in the lower area of the rotating disk 52 is brought up, one by one, from the lower area of the rotating disk 52 to the upper area thereof, in such a manner that the coin is held between the transport projecting member 56 on the inner circumferential side and the cover member 54. Thereafter, the coin is delivered to the transport projecting member 56 on the inner circumferential side and the coin-periphery holding unit 57. The coin, which has been brought up to the upper area of the rotating disk 52 by the transport projecting member 56 on the inner circumferential side, is pushed out toward the outlet 50*a* of the storing and feeding apparatus 50 by the transport projecting member 56 on the outer circumferential side (see coin C3 in FIG. 6) so as to be sent to the guide channel 62. At this time, the coin on the surface 52*b* of the rotating disk 52 is guided by the guide member 64 to the outside of the rotating disk 52. Then, the coin, which has been sent from the guide channel 62 to the outlet 50*a* of the storing and feeding apparatus 50 drops, by an own weight thereof, onto the endless belt 70*p* in the first coin-to-be-dispensed transport portion 70*a*, through the coin dispensing space 72. At this time, the coin is fed out from the storing and feeding apparatus 50 in the right direction in FIG. 2. Namely, the direction in which the coin is fed out from the storing and feeding apparatus 50 is substantially perpendicular to the sheet surface of FIG. 1. In FIG. 6 and so on, although the coin is finally fed out by the guide member 64 in the lower right direction, the coin may be horizontally fed out.

When a coin is fed out from the storing and feeding apparatus 50, if two or more coins are caught by one of the transport projecting members 56 on the inner circumferential side, only one (see coin C4 in FIGS. 7 and 8) of the coins caught by the one of the transport projecting members 56 is caused not to float up from the surface 52*b* of the rotating disk 52, and one or more coins other than the only one coin (see coin C5 in FIGS. 7 and 8) are caused to float up by the elimination projecting member 59 from the surface 52*b* of the rotating disk 52. When the two or more coins caught by the one transport projecting member 56 on the inner circumferential side reach the guide member 64, the coin that does not float up from the surface 52*b* of the rotating disk 52 (coin C4 in FIGS. 7 and 8) is guided to the outlet 50*a* of the storing and feeding apparatus 50 along the upper peripheral portion 64*a* of the guide member 64. On the other hand, since the front part of each of the second coin (coin C5 in FIGS. 7 and 8) and a coin (or coins) succeeding thereto, which floats up from the surface 52*b* of the rotating disk 52, is caught by the distal end portion 64*c* of the guide member 64, the coin is not fed out to the outside of the rotating disk 52 by the guide member 64 but drops, by an own weight of the coin, to the lower area of the rotating disk 52. In this manner, it can be prevented that two or more coins are simultaneously fed out by the guide member 64 from the rotating disk 52 to the outlet 50*a* of the storing and feeding apparatus 50 through the guide channel 62.

When a coin is dispensed from the coin depositing and dispensing machine 10, the endless belt 70*p* of the coin-to-be-dispensed transport unit 70 is cyclically moved in the counterclockwise direction in FIG. 1. Thus, a coin having been fed out from each of the storing and feeding apparatuses 50 drops, by an own weight of the coin, onto the endless belt 70*p* in the first coin-to-be-dispensed transport portion 70*a* through the coin dispensing space 72. Thereafter, the coin on the endless belt 70*p* is sent from the first coin-to-be-dispensed transport portion 70*a* to the second coin-to-be-dispensed transport portion 70*b*. The coin caught by one of the projecting members of the endless belt 70*p* in the second coin-to-be-dispensed transport portion 70*b* is moved upward in FIG. 1 so as to be finally sent from the upper end portion of the second coin-to-be-dispensed transport portion 70*b* to the coin dispensing opening 18.

On the other hand, when a coin is collected from the coin depositing and dispensing machine 10, the endless belt 70*p* of the coin-to-be-dispensed transport unit 70 is cyclically moved in the clockwise direction in FIG. 1. Thus, a coin having been fed out from each of the storing and feeding apparatuses 50 drops, by an own weight of the coin, onto the endless belt 70*p* in the first coin-to-be-dispensed transport portion 70*a* through the coin dispensing space 72. Thereafter, the coin on the endless belt 70*p* is sent from the first coin-to-be-dispensed transport portion 70*a* to the collection box 80 so as to be stored in the collection box 80. After the coin has been stored in the collection box 80, an operator takes out the collection box 80 from the housing 12 so that the coin together with the collection box 80 is collected.

As described above, according to the coin depositing and dispensing machine 10 in this embodiment, the plurality of storing and feeding apparatuses 50 disposed below the deposited-coin transport unit 20 are vertically arranged on plural levels, and the transport direction in which a coin is transported by the deposited-coin transport unit 20 and the feeding direction in which a coin is fed out from each storing and feeding apparatus 50 are substantially perpendicular to each other. Since the plurality of storing and feeding apparatuses 50 are vertically arranged on plural levels, a size of the housing 12 of the coin depositing and dispensing machine 10 in the depth direction (right and left direction in FIG. 1) can be reduced, as compared with a case in which the plurality of storing and feeding apparatuses 50 are transversely arranged in a line below the deposited-coin transport unit 20. In addition, if the transport direction in which a coin is transported by the deposited-coin transport unit 20 and the feeding direction in which a coin is fed out from each storing and feeding apparatus 50 are in parallel with each other, since the rotating disk 52 of the storing and feeding apparatus 50 has a somewhat large length in the right and left direction, as shown in FIG. 2, and a dispensing space is needed between the respective storing and feeding apparatuses 50, the housing 12 of the coin depositing and dispensing machine 10 is large in the transport direction in which a coin is transported by the deposited-coin transport unit 20, i.e., in the depth direction. On the other hand, in the coin depositing and dispensing machine 10 of the present embodiment, since the transport direction in which a coin is transported by the deposited-coin transport unit 20 and the feeding direction in which a coin is fed out from each storing and feeding apparatus 50 are substantially perpendicular to each other, the size of the housing 12 of the coin depositing and dispensing machine 10 in the depth direction can be reduced. Namely, according to the coin deposing and dispensing machine 10 of the present embodiment, the size of the housing 12 in the depth direction can be reduced without decrease in coin storing capacities of the respective storing and feeding apparatuses 50.

In the example of the coin depositing and dispensing machine 10 as shown in FIG. 1 and so on, the plurality of storing and feeding apparatuses 50 are vertically arranged on three levels. However, not limited to this arrangement example, the plurality of storing and feeding apparatuses 50 may be vertically arranged on two levels or not less than four levels.

In the example of the coin depositing and dispensing machine as shown in FIG. 1 and so on, the plurality of storing and feeding apparatuses 50 are of the same structure. However, not limited to this example, the plurality of storing and feeding apparatuses 50 may be of structures different from each other.

In the coin depositing and dispensing machine 10 in this embodiment, as described above, each storing and feeding apparatus 50 includes: the rotating disk 52 that is inclined at a predetermined angle relative to the vertical direction, and is rotated in an inclined posture; and the cover member 54 forming the coin storing space 53 for storing a coin, between the rotating disk 52 and the cover member 54.

In addition, in the coin depositing and dispensing machine 10 in this embodiment, there are provided the coin dispensing opening 18 configured to dispense a coin to the outside of the housing 12, and the coin-to-be-dispensed transport unit 70 configured to transport a coin having been fed out from one of the storing and feeding apparatuses 50 to the coin dispensing opening 18. The coin-to-be-dispensed transport unit 70 includes the first coin-to-be-dispensed transport portion 70*a* disposed below the plurality of storing and feeding apparatuses 50 to extend in substantially the horizontal direction, and the second coin-to-be-dispensed transport portion 70*b* configured to transport a coin having been sent from the first coin-to-be-dispensed transport portion 70*a* to the coin dispensing opening 18. In addition, on one lateral side of the plurality of storing and feeding apparatuses 50, there is disposed the coin dispensing space 72 along which a coin having been fed out from one of the storing and feeding apparatuses 50 drops onto the first coin-to-be-dispensed transport portion 70*a*. On the other hand, on the other side of the plurality of storing and feeding apparatuses 50, there are disposed the chutes 26 each of which is configured to transport a coin from the sorting unit 24 disposed on the deposited-coin transport unit 20 to each storing and feeding apparatus 50. Due to such a structure, the size of the storing and feeding apparatus 50 in the width direction of the housing 12 (right and left direction in FIG. 2) can be also reduced.

In addition, in the coin depositing and dispensing machine 10 in this embodiment, as described above, the deposited-coin transport unit 20 includes: the first deposited-coin transport portion 20*a* extending in substantially the horizontal direction; the returning deposited-coin transport portion 20*b* configured to transport a coin having been sent from the first deposited-coin transport portion 20*a* and to change a transport direction of the coin to a reverse direction; and the second deposited-coin transport portion 20*c* extending in substantially the horizontal direction, the second deposited-coin transport portion 20*c* configured to transport the coin having been sent from the returning deposited-coin transport portion 20*b*. The sorting units 24 are disposed on the first deposited-coin transport portion 20*a* and the second deposited-coin transport portion 20*c*, respectively. According to such a coin depositing and dispensing machine 10, the size of the housing 12 in the depth direction can be further reduced, as compared with a machine in which the deposited-coin transport unit is linearly disposed in the horizontal direction.

In addition, according to the storing and feeding apparatus 50 in this embodiment, the coin elimination unit formed of, e.g., the elimination projecting members 59 is provided on the rotating disk 52. The coin elimination unit (elimination projecting member 59) is configured, if two or more coins are caught by one of the transport projecting members 56 on the inner circumferential side and the coins are guided by the guide member 64 in the upper area of the rotating disk 52, to cause only one of the coins caught by the transport projecting member 56 not to float up from the surface 52*b* of the rotating disk 52 and to cause one or more coins other than the only one coin to float up from the surface 52*b* of the rotating disk 52, so that the other coins are caught by the guide member 64 to drop to the lower area of the rotating disk 52. Due to the provision of the coin elimination unit, it can be prevented that two or more coins are simultaneously fed out by the guide member 64 from the rotating disk 52 to the outlet 50 of the coin feeding apparatus 50 through the guide channel 62.

As described above, the coin elimination unit is formed of the plurality of elimination projecting members 59 provided on the surface 52*b* of the rotating disk 52 on the side of the coin storing space 53. The respective elimination projecting members 59 are located closer to the center of the rotating disk 52 than the respective transport projecting members 56.

In addition, in the storing and feeding apparatus 50 in this embodiment, the coin elimination unit formed of, e.g., the elimination projecting members 59, is configured such that, when one coin having a largest diameter (coin indicated by reference symbol C6 in FIG. 7), among coins of various denominations to be fed out by the storing and feeding apparatus 50, is transported with the transport projecting member 56 by the rotation of the rotating disk 52, the coin is caused not to float up from the surface 52*b* of the rotating disk 52. Thus, any coin of any diameter can be prevented from floating up from the surface 52*b* of the rotating disk 52 by the elimination projecting member 59, when the coin is solely caught by the transport projecting member 56 on the inner circumferential side.

In addition, in the storing and feeding apparatus 50 in this embodiment, the coin elimination unit formed of, e.g., the elimination projecting members 59, is configured such that, when two or more coins are caught by one of the transport projecting members 56 and each of the second coin (coin indicated by reference symbol C5 in FIGS. 7 and 8) and a coin (or coins) succeeding thereto is caused to float up from the surface 52*b* of the rotating disk 52, a front part of the coin in the rotating direction of the rotating disk 52 is caused to float up. Then, the front part of each of the second coin and a coin (or coins) succeeding thereto, which has been caused to float up from the surface 52*b* of the rotating disk 52, is caught by the guide member 64, so that the coin is not fed out by the guide member 64 to the outside of the rotating disk 52 but drops to the lower area of the rotating disk 52. When two or more coins are caught by one of the transport projecting members 56, the height at which the front part of each of the second coin and a coin (or coins) succeeding thereto is caused to float up by the elimination projecting unit from the surface 52*b* of the rotating disk 52 is larger than the height at which the second coin and a coin (or coins) succeeding thereto should be caught by the guide member 64 (specifically, the upper peripheral portion 64*a* of the guide member 64).

The coin depositing and dispensing machine 10 in this embodiment is not limited to the above manner, and can be variously modified.

Figure 9:
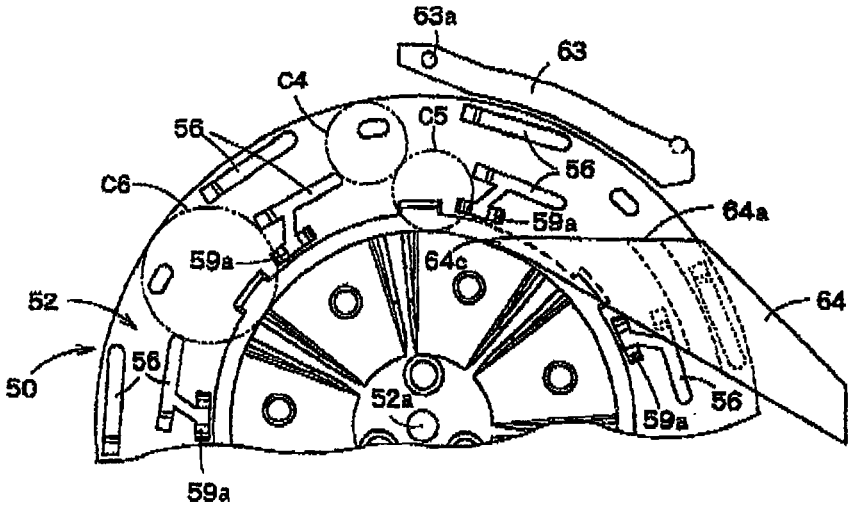
FIG. 9 is a structural view showing another structure of a coin elimination unit disposed on the storing and feeding apparatus.

For example, the elimination projecting member disposed on the rotating disk 52 of the storing and feeding apparatus 50 is not limited to the elimination projecting member as shown in FIGS. 6 to 8. As the elimination projecting member to be disposed on the rotating disk 52 of the storing and feeding apparatus 50, a member as shown in FIG. 9 may be used, for example. The elimination projecting member 59*a* disposed on the rotating disk 52 shown in FIG. 9 is integrally formed with the transport projecting member 56 on the inner circumferential side. Even when the elimination projecting member 59*a* is integral with the transport projecting member 56 corresponding to the elimination projecting member 59*a*, if two or more coins are caught by one of the transport projecting members 56 and the coins are guided by the guide member 64 in the upper area of the rotating disk 52, only one of the two or more coins caught by the transport projecting member 56 is caused not to float up from the surface 52*b* of the rotating disk 52 and one or more coins other than the only one coin are caused to float up from the surface 52*b* of the rotating disk 52, whereby the other coins can be caught by the distal end portion 64*c* of the guide member 64 so as to drop to the lower area of the rotating disk 52.

Figure 10A:
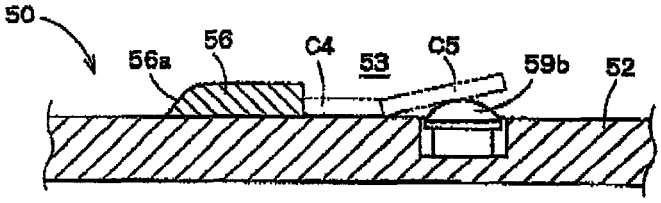
FIGS. 10(A) and 10(B) are structural views showing yet another structure of the coin elimination unit disposed on the storing and feeding apparatus.
Figure 10B:
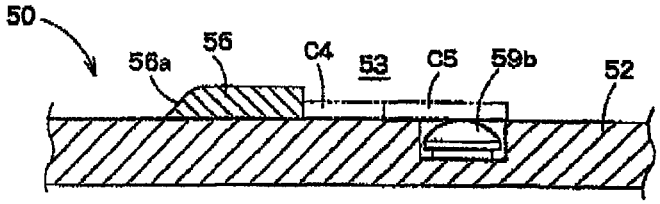

In addition, the coin elimination unit to be used in the storing and feeding apparatus 50 is not limited to the projecting member disposed on the surface 52*b* of the rotating disk 52, and the coin elimination unit of another structure may be used. For example, as shown in FIGS. 10(A) and 10(B), as the coin elimination unit to be used in the storing and feeding apparatus 50, there may be used a moving member 59*b* that is movable between a projecting position at which the moving member 59*b* is projected into the coin storing space 53 from the surface 52*b* of the rotating disk 52 on the side of the coin storing space 53 (see FIG. 10(A)), and a withdrawn position at which the moving member 59*b* is withdrawn from the coin storing space 53 into the rotating disk 52 (see FIG. 10(B)). Similarly to the elimination projecting members 59 shown in FIGS. 6 to 8, a plurality of moving members 59*b* are circumferentially disposed at predetermined pitches on positions closer to the center of the rotating disk 52 than the respective transport projecting members 56. More specifically, a set of projection assembly is formed by one transport projecting member 56 disposed along the inner circumferential direction, the one transport projecting member 56 corresponding to the transport projecting member 56 on the inner circumferential side, which is disposed along the outer circumferential direction, and the one moving member 59*b* corresponding to the transport projecting member 56 on the inner circumferential side. Plural sets of the projection assemblies are located along the circumferential direction of the rotating disk 52.

The moving member 59*b* shown in FIGS. 10(A) and 10(B) are generally located on the withdrawn position as shown in FIG. 10(B), when the rotating disk 52 is rotated. When the moving member 59*b* comes close to the guide member 64 by the rotation of the rotating disk 52, the moving member 59*b* is moved from the withdrawn position as shown in FIG. 10(B) to the projecting position as shown in FIG. 10(B). Thus, when two or more coins are caught by one of the transport projecting members 56 and the coins are guided by the guide member 64 in the upper area of the rotating disk 52, the moving member 59*b* is configured to cause only one of the coins caught by the transport projecting member 56 not to float up from the surface of the rotating disk 52 and to cause one or more coin other than the only one coin to float up from the surface of the rotating disk 52. Then, each of the second coin and a coin (or coins) succeeding thereto floating up from the surface of the rotating disk 52 is caught by the distal end portion 64*c* of the guide member 64 so as to drop to the lower area of the rotating disk 52.

Also when the moving member 59*b* as shown in FIGS. 10(A) and 10(B) are used as the coin elimination unit, similarly to the elimination projecting member 59 as shown in FIGS. 6 to 8, it can be prevented that two or more coins are simultaneously fed out by the guide member 64 from the rotating disk 52 to the outlet 50*a* of the storing and feeding apparatus 50 through the guide channel 62.

Alternatively, in the rotating disk 52 of the storing and feeding apparatus 50, the elimination projecting members 59 may not be located closer to the center of the rotating disk 52 than the respective transport projecting members 56, but may be located outside the respective transport projecting members 56.

In addition, the coin elimination unit such as the elimination projecting members 59 and so on that are disposed on the rotating disk 52 of the storing and feeding apparatus 50 may be disposed on the rotating disk 32 of the pooling and feeding apparatus 30. When the coin elimination unit is provided on the rotating disk 32 of the pooling and feeding apparatus 30, it can be prevented that two or more coins are simultaneously fed out to the outlet 30*a* of the pooling and feeding apparatus 30.

Second Embodiment

Figure 11:
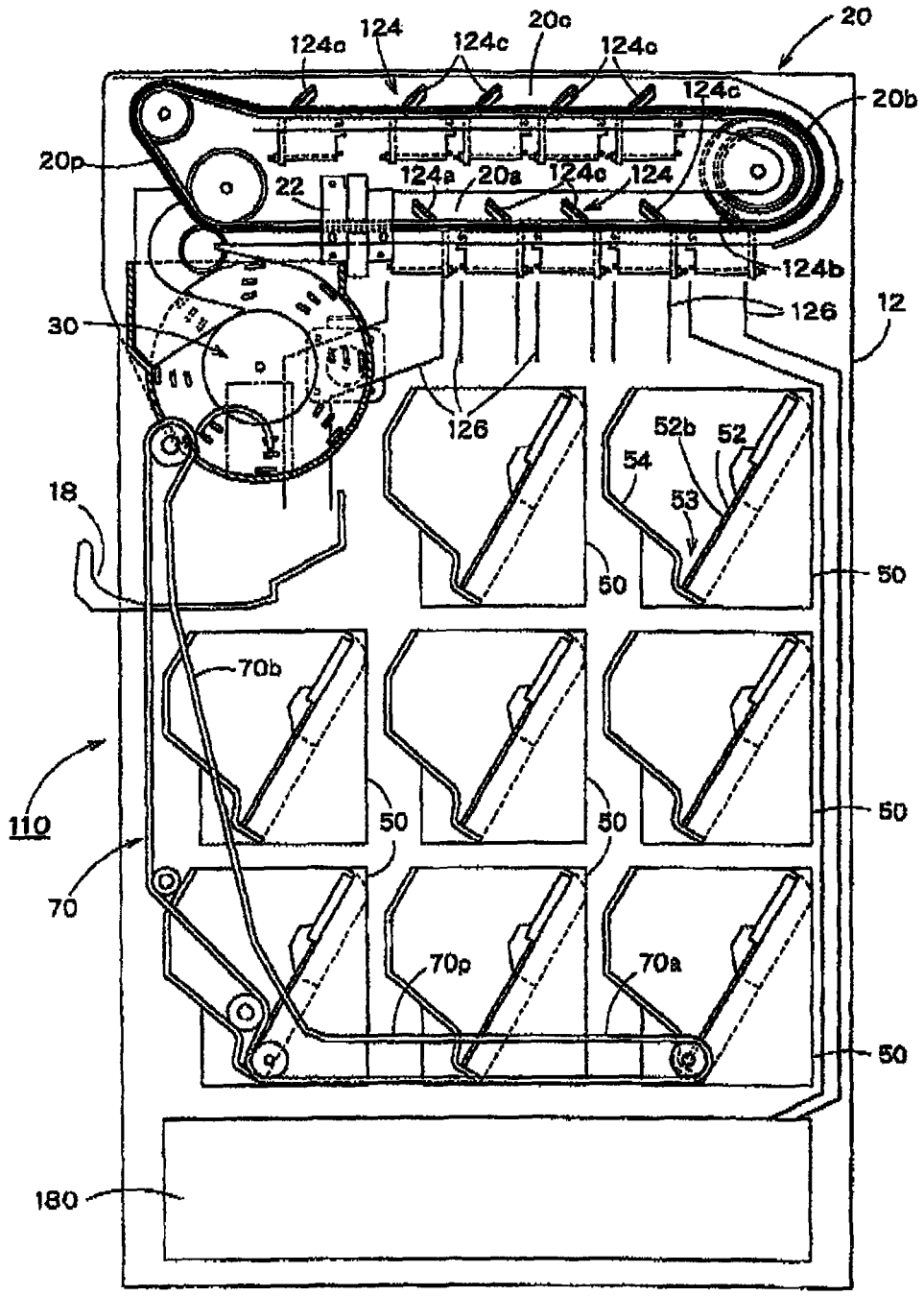
FIG. 11 is a side view schematically showing an inside structure of the coin depositing and dispensing machine in a second embodiment of the present invention.
Figure 12:
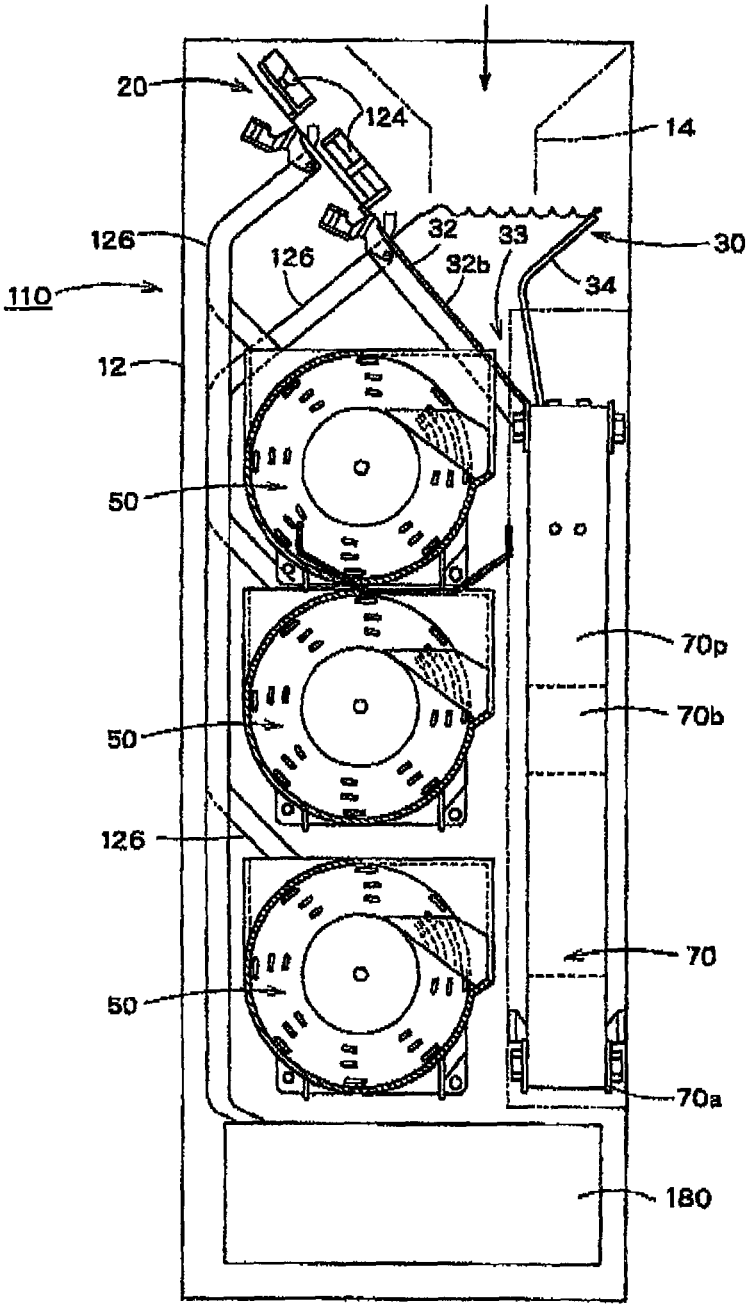
FIG. 12 is a front view schematically showing the inside structure of the coin depositing and dispensing machine shown in FIG. 11.
Figure 13:
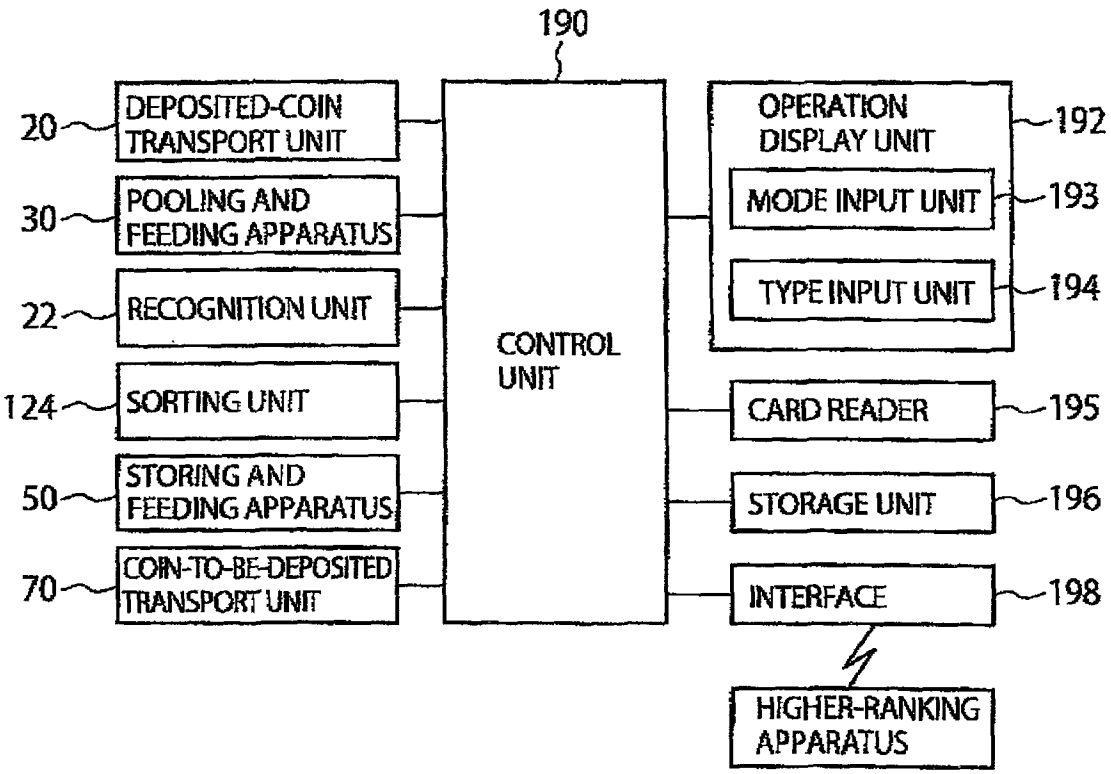
Figure 14:
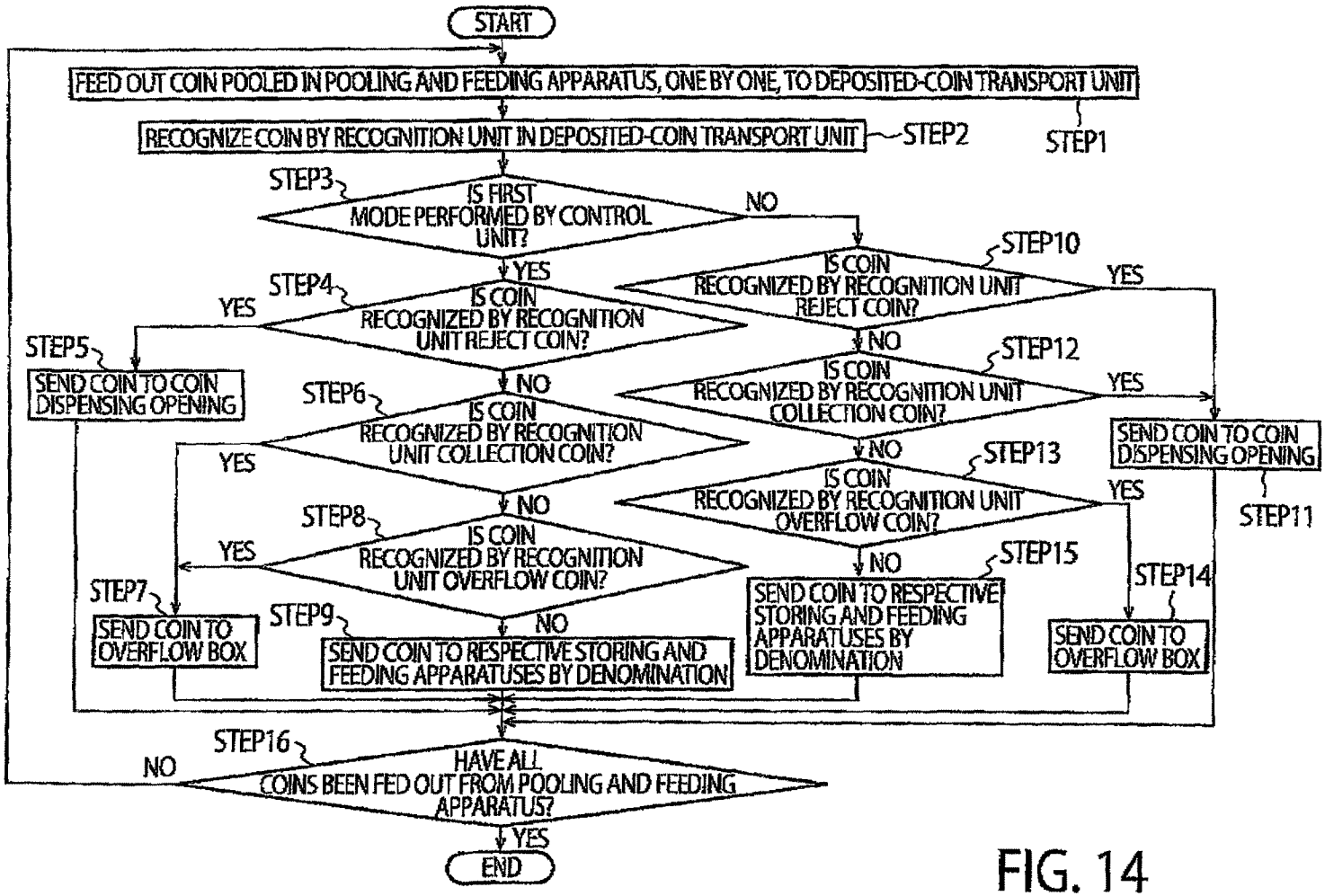

Herebelow, a second embodiment of the present invention will be described with reference to the drawings. FIGS. 11 to 14 are views showing a coin depositing and dispensing machine in the second embodiment. FIG. 11 is a side view schematically showing an inside structure of the coin depositing and dispensing machine in the second embodiment. FIG. 12 is a front view schematically showing the inside structure of the coin depositing and dispensing machine shown in FIG. 11. FIG. 13 is a functional block view of the coin depositing and dispensing machine shown in FIG. 11 and so on. FIG. 14 is a flowchart showing a depositing operation in the coin depositing and dispensing machine shown in FIG. 11 and so on. In describing the coin depositing and dispensing machine in the second embodiment, a constituent element identical to that of the coin depositing and dispensing machine in the first embodiment is shown by the same reference symbol and description thereof is omitted.

As shown in FIGS. 11 and 12, a coin depositing and dispensing machine 110 includes: a housing 12 of substantially a parallelepiped shape, a coin receiving unit 14 configured to receive coins from an outside of the housing 12; and a pooling and feeding apparatus 30 to which the coin having been received through the coin receiving opening 14 is sent to be pooled therein, the pooling and feeding apparatus 30 configured to feed out, one by one, coins pooled therein. In the housing 12, there is provided a deposited-coin transport unit 20 configured to transport, one by one, the coin having been fed out from the pooling and feeding apparatus 30. The deposited-coin transport unit 20 is provided with a recognition unit 22 configured to recognize each of the coins transported by the deposited-coin transport unit 20.

In the housing 12, a plurality of (specifically eight) storing and feeding apparatuses 50 are disposed below the deposited-coin transport unit 20. Based on a coin recognition result by the recognition unit 22, a coin is sent by denomination from the deposited-coin transport unit 20 to one of the storing ad feeding apparatuses 50 by a sorting unit 124 (described hereafter) disposed on the deposited-coin transport unit 20. In addition, each of the storing and feeding apparatuses 50 is configured to feed out, one by one, coins stored therein.

In addition, the coin depositing and dispensing machine 110 is provided with a coin dispensing opening 18 configured to dispense coins to the outside of the housing 12. In the housing 12, there is disposed a coin-to-be-dispensed transport unit 70 configured to transport coins having been fed out from one of the storing and feeding apparatuses 50 to the coin dispensing opening 18. In addition, in the housing 12, an overflow box 180 is disposed below the coin-to-be-dispensed transport unit 70. The overflow box 180 is configured to store an overflow coin (or overflow coins), which cannot be stored in the storing and feeding apparatus 50 of a corresponding denomination because this storing and feeding apparatus 50 is full, and a collection coin (or collection coins), which is to be collected from the coin depositing and dispensing machine 110, in a denomination mixed state. The overflow coin and the collection coin will be described in detail hereafter.

As shown in FIGS. 11 and 12, the first deposited-coin transport portion 20*a* and the second deposited-coin transport portion 20*c* are provided with a plurality of sorting units 124 (124*a* to 124*c*), respectively. More specifically, the first deposited-coin transport portion 20*a* has the five sorting units 124, and the second deposited-coin transport portion 20*c* also has the five sorting units 124. In addition, as shown in FIG. 11, the recognition unit 22 is disposed on an upstream side of the respective sorting units 124 in the first deposited-coin transport portion 20*a*. The recognition unit 22 is configured to recognize a denomination, an authenticity and a fitness of a coin having been fed out from the pooling and feeding apparatus 30. Based on a coin recognition result by the recognition unit 22, the respective sorting units 124 disposed on the first deposited-coin transport portion 20*a* and the second deposited-coin transport portion 20*c* are configured to sort coins transported by the first deposited-coin transport portion 20*a* and the second deposited-coin transport portion 20*c* so as to send the coins to the coin dispensing opening 18, the respective storing and feeding apparatuses 50, and the overflow box 180. To be specific, one sorting unit 124*a*, among the ten sorting units 124 disposed on the first deposited-coin transport portion 20*a* and the second deposited-coin transport portion 20*c*, is configured to function as a reject-coin sorting unit. A reject coin is sorted by the sorting unit 124*a* and is sent to the coin dispensing opening 18. In addition, one sorting unit 124*b*, among the ten sorting units 124, is configured to function as an overflow-coin sorting unit. An overflow coin and a collection coin are sorted by the sorting unit 124*b* and are sent to the overflow box 180. The remaining eight sorting units 124*c*, other than the sorting unit 124*a* functioning as the reject-coin sorting unit and the sorting unit 124*b* functioning as the overflow-coin sorting unit, correspond to the respective storing and feeding apparatuses 50. Each sorting unit 124 is provided with a corresponding chute 126. A coin having been sorted by the sorting unit 124 is sent, through the chute 126 disposed on this sorting unit 124, to the coin dispensing opening 18, one of the corresponding storing and feeding apparatuses 50 or the overflow box 180.

More specifically, one sorting unit 124*a* among the ten sorting units 124, which is located on the most upstream position in the first deposited-coin transport portion 20*a* (i.e., the sorting unit 124*a* located on the leftmost position among the five sorting units 124 disposed on the first deposited-coin transport portion 20*a* in FIG. 11), is configured to function as the reject-coin sorting unit for sorting a reject coin. Namely, a coin that has been recognized as a reject coin, among coins having been recognized by the recognition unit 22, is sorted by the reject-coin sorting unit 124*a* so as to be sent to the coin dispensing opening 18. In addition, the sorting unit 124*b* located on the most downstream position in the first deposited-coin transport portion 20*a* (i.e., the sorting unit 124*b* located on the rightmost position among the five sorting units 124 disposed on the first deposited-coin transport portion 20*a* in FIG. 11), is configured to function as the overflow-coin sorting unit for sorting an overflow coin and a collection coin. Namely, a coin that has been recognized as an overflow coin or a collection coin, among coins having been recognized by the recognition unit 22, is sorted by the overflow-coin sorting unit 124*b* so as to be sent to the overflow box 180. As described below, when a coin having been recognized by the recognition unit 22 is a collection coin, there is a case in which the collection coin is sorted by the reject-coin sorting unit 124*b* so as to be sent to coin dispensing opening 18, instead of being sorted by the overflow-coin sorting unit 124*b* so as to be sent to the overflow box 180.

On the other hand, the eight sorting units 124*c* among the ten sorting units 124, which are other than the sorting unit 124*a* functioning as the reject-coin sorting unit and the sorting unit 124*b* functioning as the overflow-coin sorting unit, are configured to function as coin denomination sorting units for sorting coins by denomination. Namely, based on a coin denomination having been recognized by the recognition unit 22, coins are sorted by denomination by the respective coin denomination sorting units 124*c* so as to be sent to the corresponding storing and feeding apparatuses 50.

In the coin-to-be-dispensed transport unit 70, when the endless belt 70*p* is cyclically moved in the counterclockwise direction in FIG. 11, a coin having been fed out from one of the storing and feeding apparatuses 50 drops, by an own weight of the coin, onto the endless belt 70*p* in the first coin-to-be-dispensed transport portion 70*a*, and the coin on the endless belt 70*p* is then sent from the first coin-to-be-dispensed transport portion 70*a* to the second coin-to-be-dispensed transport portion 70*b*. Thereafter, the coin caught by one of the projecting members of the endless belt 70*p* in the second coin-to-be-dispensed transport portion 70*b* is moved upward in FIG. 11, so as to be sent from the upper end portion of the second coin-to-be-dispensed transport portion 70*b* to the coin dispensing opening 18. On the other hand, when the endless belt 70*p* is cyclically moved in the clockwise direction in FIG. 11, a coin having been fed out from one of the storing and feeding apparatuses 50 drops, by an own weight thereof, onto the endless belt 70*p* in the first coin-to-be-dispensed transport portion 70*a*, but the coin on the endless belt 70*p* is sent from the first coin-to-be-dispensed transport portion 70*a* to the below-described overflow box 180 so as to be finally stored in the overflow box 180.

As described above, the overflow box 180 is provided below the respective storing and feeding apparatuses 50 in the housing 12. The overflow box 180 is disposed removably from the housing 12. In addition, as described above, a coin is sent to the overflow box 180 from the first coin-to-be-dispensed transport portion 70*a* in the coin-to-be-dispensed transport unit 70. There is a case in which a coin sorted by the overflow-coin sorting unit 124*b* in the deposited-coin transport unit 20 is directly sent to the overflow box 180. As described above, the overflow box 180 is configured to store an overflow coin, which cannot be stored in the storing and feeding apparatus 50 of a corresponding denomination because this storing and feeding apparatus 50 is full, and a collection coin, which has been received by the coin depositing and dispensing machine 110 but is to be collected from the coin depositing and dispensing machine 110.

In addition, in the coin depositing and dispensing machine 110, there is provided a control unit 190 configured to control the respective constituent elements of the coin depositing and dispensing machine 110. A structure of the control unit 190 is described with reference to FIG. 13. As shown in FIG. 13, the control unit 190 is connected to the deposited-coin transport unit 20, the pooling and feeding apparatus 30, the recognition unit 22, the sorting units 124, the storing and feeding apparatuses 50, the coin-to-be-dispensed transport unit 70 and so on. A coin recognition result by the recognition unit 22 is sent to the control unit 190. The control unit 190 is configured to give respective commands to the deposited-coin transport unit 20, the pooling and feeding apparatus 30, the sorting units 124, the storing and feeding apparatuses 50, the coin-to-be-dispensed transport unit 70 and so on, so as to control these constituent elements.

In addition, an operation display unit 192 (not shown in FIGS. 11 and 12) is provided on an upper surface or a front surface of the housing 12 of the coin depositing and dispensing machine 110. The operation display unit 192 is connected to the control unit 190. The operation display unit 192 is formed of a display of a touch-panel type, for example. Information inputted by an operator through the operation display unit 192 is transmitted to the control unit 190. In addition, the control unit 190 transmits information to the operation display unit 192 so as to cause the operation display unit 192 to display various information. In addition, a card reader 195 (not shown in FIGS. 11 and 12) is provided on the upper surface or the front surface of the housing 12 of the coin depositing and dispensing machine 110. ID information of an ID card brought by an operator is read by the card reader 195. The card reader 195 is connected to the control unit 190, so that ID information of an operator read by the card reader 195 is transmitted to the control unit 190. Further, a storage unit 196 is connected to the control unit 190. The storage unit 196 is configured to store various setting information of the coin depositing and dispensing machine 110 and storing information such as the number of coins for each denomination stored in the respective storing and feeding apparatuses 50. Furthermore, an interface 198 is connected to the control unit 190. Through the interface 198, the control unit 190 can transmit and receive information to and from an external apparatus (e.g., higher-ranking apparatus) other than the coin depositing and dispensing machine 110.

In addition, in the coin depositing and dispensing machine 110 in this embodiment, the control unit 190 is configured to select and perform any one of a first mode in which a collection coin is sent from the deposited-coin transport unit 20 to the overflow box 180 by the overflow-coin sorting unit 124*b*, and a second mode in which a collection coin is sent from the deposited-coin transport unit 20 to the coin dispensing opening 18 by the reject-coin sorting unit 124*a*. More specifically, as shown in FIG. 13, the operation display unit 192 is provided with a mode input unit 193. An operator can input, through the mode input unit 193, which of the first mode or the second mode to be performed, to the control unit 190. In addition, the control unit 190 is configured to set a type of a collection coin beforehand. Specifically, the control unit 190 sets, as a collection coin, a coin of a denomination that is not assigned to the respective storing and feeding apparatuses 50, a foreign coin, an unfit coin, a memory coin, an old coin and so on.

More specifically, the control unit 190 is configured to usually control the respective sorting units 124 in the deposited-coin transport unit 20 according to the first mode. On the other hand, when the overflow box 180 is taken out from the coin depositing and dispensing machine 110 and a coin having been stored in the overflow box 180 is put into the coin receiving opening 14, the control unit 190 is configured to control the respective sorting units 124 in the deposited-coin transport unit 20 according to the second mode. Namely, a collection coin is usually sent from the deposited-coin transport unit 20 to the overflow box 180 by the overflow-coin sorting unit 124*b*. On the other hand, when a coin having been stored in the overflow box 180 is put into the coin receiving opening 14, the collection coin is sent from the deposited-coin transport unit 20 to the coin dispensing opening 18 by the reject-coin sorting unit 124*a*. However, the coin depositing and dispensing machine 110 in this embodiment is not limited to the above manner. Even in a case where the overflow box 180 is taken out from the coin depositing and dispensing machine 110 and a coin having been stored in the overflow box 180 is put into the coin receiving opening 14, when an operator selects the first mode through the mode input unit 193, the control unit 190 performs the first mode.

As shown in FIG. 13, the operation display unit 192 is provided with a type input unit 194 through which a type of a collection coin to be sent from the deposited-coin transport unit 20 to the coin dispensing opening 18 by the reject-coin sorting unit 124*a* is inputted to the control unit 190, when the control unit 190 performs the second mode. When an operator inputs a performance of the second mode into the control unit 190 through the mode input unit 193, the type of a collection coin to be sent from the deposited-coin transport unit 20 to the coin dispensing opening 18 by the reject-coin sorting unit 124*a* is inputted by the operator to the control unit 190 through the type input unit 194.

Next, an operation of the coin depositing and dispensing machine 110 as structured above is described. The below-described operation of the coin depositing and dispensing machine 110 is performed by the control unit 190 that controls the respective constituent elements of the coin depositing and dispensing machine 110.

At first, a depositing operation for depositing a coin to the coin depositing and dispensing machine 110 is described with reference to the flowchart shown in FIG. 14. When the depositing operation is performed, an operator inputs which of the first mode or the second mode to be performed to the control unit 190 through the mode input unit 193 of the operation display unit 192. In general, the operator usually selects the first mode. On the other hand, when the overflow box 180 is removed from the housing 12 of the coin depositing and dispensing machine 110 and a coin having been stored in the overflow box 180 is put into the coin receiving opening 14, the operator selects the second mode. Note that, even in the latter case, the operator may select the first mode. When a performance of the second mode is inputted to the control unit 190 through the mode input unit 193, the operator inputs a type of a collection coin to be sent from the deposited-coin transport unit 20 to the coin dispensing opening 18 through the type input unit 194. In addition, before the depositing operation is performed, the operator causes the card reader 195 to read an ID card of the operator, so that the ID information of the operator is transmitted to the control unit 190. Then, only when the ID information of the operator having been inputted to the control unit 190 through the card reader 195 satisfies a predetermined condition preset in the control unit 190, specifically, only when the operator has a predetermined authority, a performance of the second mode can be inputted to the control unit 190 through the mode input unit 193. Namely, an operator who does not have a predetermined authority cannot input a performance of the second mode to the control unit 190 through the mode input unit 193, whereby the operator can perform only the first mode.

After the operator has inputted which of the first mode or the second mode to be performed to the control unit 190 through the mode input unit 193, a coin is inputted to the coin receiving opening 14 of the coin depositing and dispensing machine 110. Then, the coin drops, by an own weight thereof, so as to be sent to the pooling and feeding apparatus 30. In the pooling and feeding apparatus 30, when the rotating disk 32 is rotated in the counterclockwise direction in FIG. 11, a coin stored in the coin pooling space 33 to be present in the lower area of the rotating disk 32 is brought up from the lower area of the rotating disk 32 to the upper area thereof. Thereafter, the coin having been brought up to the upper area of the rotating disk 32 is pushed out toward the outlet of the pooling and feeding apparatus 30 so as to be finally sent to the endless belt 20*p* of deposited-coin transport unit 20. In this manner, coins pooled in the pooling and feeding apparatus 30 are fed out, one by one, to the deposited-coin transport unit 20 (STEP 1 of FIG. 14).

The coin having been fed out from the pooling and feeding apparatus 30 to the deposited-coin transport unit 20 is transported by the endless belt 20*p* of the deposited-coin transport unit 20. Specifically, the coin is recognized by the recognition unit 22 (STEP 2 of FIG. 14). When the first mode is performed by the control unit 190 ("YES" in STEP 3 of FIG. 14), a coin that has been recognized as a reject coin by the recognition unit 22 ("YES" in STEP 4 of FIG. 14) is sorted by the reject-coin sorting unit 124*a* so as to be sent from the deposited-coin transport unit 20 to the coin dispensing opening 18 (STEP 5 of FIG. 14). In addition, when the first mode is performed in the control unit 190 ("YES" in STEP 3 of FIG. 14), a coin that has been recognized as a collection coin by the recognition unit 22 ("YES" in STEP 6 of FIG. 14) is sorted by the overflow-coin sorting unit 124*b* so as to be sent from the deposited-coin transport unit 20 to the overflow box 180 (STEP 7 of FIG. 14). As described above, a type of a collection coin has been set in the control unit 190 beforehand. Specifically, in the control unit 190, as a collection coin, a coin of a denomination that is not assigned to the respective storing and feeding apparatuses 50, a foreign coin, an unfit coin, a memory coin, an old coin and so on has been set. A coin that has been recognized as a coin corresponding to any of these types by the recognition unit 22 is sent to the overflow box 180 as a collection coin. In addition, when the first mode is performed by the control unit 190 ("YES" in STEP 3 of FIG. 14), a coin that has been recognized as an overflow coin by the recognition unit 22 ("YES" in STEP 8 of FIG. 14) is sorted by the overflow-coin sorting unit 124*b* so as to be sent from the deposited-coin transport unit 20 to the overflow box 180 (STEP 7 of FIG. 14). An overflow coin is a normal coin that is not a reject coin or a collection coin but cannot be stored in the storing and feeding apparatus 50 of a corresponding denomination because this storing and feeding apparatus 50 is full. In addition, when the first mode is performed in the control unit 190 ("YES" in STEP 3 of FIG. 14), a coin that has been recognized as a normal coin by the recognition unit 22 and that is not an overflow coin ("NO" in STEP 8 of FIG. 14) is sorted by denomination by one of the coin denomination sorting units 124*c*, based on a coin denomination having been recognized by the recognition unit 22, so as to be sent to one of the storing and feeding apparatuses 50 corresponding to this coin denomination sorting unit 124*c* and stored therein (STEP 9 of FIG. 14).

On the other hand, when the first mode is not performed by the control unit 190, i.e., the second mode is performed ("NO" in STEP 3 of FIG. 14), a coin that has been recognized as a reject coin by the recognition unit 22 ("YES" in STEP 10 of FIG. 14) is sorted by the reject-coin sorting unit 124*a* so as to be sent from the deposited-coin transport unit 20 to the coin dispensing opening 18 (STEP 11 of FIG. 14). In addition, when the second mode is performed by the control unit 190 ("NO" in STEP 3 of FIG. 14), a coin that has been recognized as a collection coin by the recognition unit 22 ("YES" in STEP 12 of FIG. 14) is sorted by the reject-coin sorting unit 124*a* so as to be sent from the deposited-coin transport unit 20 to the coin dispensing opening 18 (STEP 11 of FIG. 14). A collection coin to be sent to the coin dispensing opening 18 is limited to a collection coin of the type having been inputted to the control unit 190 through the type input unit 194. A collection coin of another type is sorted by the overflow-coin sorting unit 124*b* so as to be sent from the deposited-coin transport unit 20 to the overflow box 180.

When the second mode is performed by the control unit 190 ("NO" in STEP 3 of FIG. 14), a coin that has been recognized as an overflow coin by the recognition unit 22 ("YES" in STEP 13 of FIG. 14) is sorted by the overflow-coin sorting unit 124*b* so as to be sent from the deposited-coin transport unit 20 to the overflow box 180 (STEP 14 of FIG. 14). In addition, when the second mode is performed by the control unit 190 ("NO" in STEP 3 of FIG. 14), a coin that has been recognized as a normal coin by the recognition unit 22 and that is not an overflow coin ("NO" in STEP 13 of FIGS. 4(A) and 4(B)) is sorted by denomination by one of the coin denomination sorting units 124*c* so as to be sent to be stored in one of the storing and feeding apparatuses 50 corresponding to this coin denomination sorting unit 124*c* (STEP 15 of FIG. 14).

In addition, in a case where first mode is performed by the control unit 190 ("YES" in STEP 3 of FIG. 14), when a collection coin is sent to the overflow box 180 (STEP 7 in FIG. 14), the operation display unit 192 is configured to display that the collection coin has been sent to the overflow box 180. In a case where the second mode is performed by the control unit 190 ("NO" in STEP 3 of FIG. 14), when a collection coin is sent to the coin dispensing opening 18 (STEP 11 of FIG. 14), the operation display unit 192 is configured to display that the collection coin has been sent to the coin dispensing opening 18. That is to say, the operation display unit 192 functions as a notifying unit which is configured, when a collection coin is sent to the overflow box 180 or the coin dispensing opening 18, to notify an operator that the collection coin has been sent to the overflow box 180 or the coin dispensing opening 18.

The aforementioned operations shown in the STEP 1 to STEP 15 of FIG. 14 are repeated until all the coins are fed out from the pooling and feeding apparatus 30 and are sent to the coin dispensing opening 18, the respective storing and feeding apparatuses 50 or the overflow box 180 ("NO" in STEP 16 of FIG. 14). After all the coins have been fed out from the pooling and feeding apparatus 30 and have been sent to the coin dispensing opening 18, the respective storing and feeding apparatuses 50 or the overflow box 180 ("YES" in STEP 16 of FIG. 14), the coin depositing operation in the coin depositing and dispensing machine 110 is ended.

Next, a dispensing operation for dispensing a coin from the coin depositing and dispensing machine 110 is described. When a coin is dispensed from the coin depositing and dispensing machine 110, a coin to be dispensed is fed out from the storing and feeding apparatus 50 corresponding to a denomination of the coin to be dispensed so as to be sent to the coin-to-be-dispensed transport unit 70. More specifically, the coin having been fed out from one of the storing and feeding apparatuses 50 drops, by an own weight thereof, onto the endless belt 70*p* in the first coin-to-be-dispensed portion 70*a*. At this time, the coin is fed out from the storing and feeding apparatus 50 in the right direction in FIG. 12.

When a coin is dispensed from the coin depositing and dispensing apparatus 110, the endless belt 70*p* of the coin-to-be-dispensed transport unit 70 is cyclically moved in the counterclockwise direction in FIG. 11. Thus, the coin having been fed out from one of the storing and feeding apparatuses 50 drops, by an own weight thereof, onto the endless belt 70*p* in the first coin-to-be-dispensed transport portion 70*a*, and the coin on the endless belt 70*p* is sent from the first coin-to-be-dispensed transport unit 70*a* to the second coin-to-be-dispensed transport unit 70*b*. Then, the coin caught by one of the projecting members of the endless belt 70*p* in the second coin-to-be-dispensed transport portion 70*b* is moved upward in FIG. 11 so as to be finally sent from the upper end portion of the second coin-to-be-dispensed transport portion 70*b* to the coin dispensing opening 18. In this manner, after coins of a predetermined amount have been fed out from the storing and feeding apparatus 50 so as to be sent to the coin dispensing opening 18 through the coin-to-be-dispensed transport unit 70, the coin dispensing operation in the coin depositing and dispensing machine 110 is ended.

According to the coin depositing and dispensing machine 110 in this embodiment, there is provided the overflow box 180 configured to store an overflow coin which cannot be stored in the storing and feeding apparatuses 50, and a collection coin which is to be collected from the coin depositing and dispensing machine 110. The control unit 190 is configured to selectively perform any one of the first mode in which a collection coin is sent from the deposited-coin transport unit 20 to the overflow box 180, and the second mode in which a collection coin is sent from the deposited-coin transport unit 20 to the coin dispensing opening 18. Thus, installation of a collection box can be omitted. Since the control unit 190 performs the second mode in which a collection coin is sent from the deposited-coin transport unit 20 to the coin dispensing opening 18, a collection operation for collecting a collection coin other than an overflow coin can be suitably performed. Namely, upon replenishment of the respective storing and feeding apparatuses 50 with an overflow coin in the overflow box 180, when the control unit 190 performs the second mode, there is no possibility that a collection coin is again returned to the overflow box 180. Thus, even when a replenishing operation for replenishing the respective storing and feeding apparatuses 50 with an overflow coin in the overflow box 180 is performed plural times, it can be prevented that a collection collection remains forever in the overflow box 180.

In addition, in the coin depositing and dispensing machine 110 in this embodiment, the control unit 190 is configured to usually control the deposited-coin transport unit 20 by the first mode. On the other hand, when a coin having been stored in the overflow box 180 is put into the coin receiving opening 14, the control unit 190 is configured to control the deposited-coin transport unit 20 by the second mode. Thus, when a coin in the overflow box 180 is put into the coin receiving opening 14 to replenish the storing and feeding apparatus 50, since a collection coin in the overflow box 180 is sent to the coin dispensing opening 18, the collection coin can be reliably collected.

In addition, in the coin depositing and dispensing machine 110 in this embodiment, as described above, in the control unit 190, a type of a collection coin has been set beforehand.

In addition, in the the coin depositing and dispensing machine 110 in this embodiment, there is provided the mode input unit 193 for inputting which of the first mode or the second mode to be performed to the control unit 190. Thus, an operator can select one of the first mode and the second mode to be performed through the mode input unit 193, so that whether a collection coin is sent to the coin dispensing opening 18 or to the overflow box 180 can be set. When a performance of the second mode is inputted to the control unit 190 through the mode input unit 193, a type of a collection coin to be sent from the deposited-coin transport unit 20 to the coin dispensing opening 18 is inputted to the control unit 190 through the type input unit 194. Thus, when the control unit 190 performs the second mode, a type of a collection coin to be sent to the coin dispensing opening 18 can be set.

In addition, in the coin depositing and dispensing machine 110 in this embodiment, there is provided the card reader 195 (operator-information input unit) for inputting ID information of an operator to the control unit 190. Only when ID information of an operator that has been read by the card reader 195 and inputted to the control unit 190 satisfies a predetermined condition preset in the control unit 190, a performance of the second mode can be inputted to the control unit 190 through the mode input unit 193. Thus, only when an operator has a predetermined authority, a performance of the second mode can be inputted to the control unit 190 through the mode input unit 193, whereby a collection coin can be collected. Namely, an operator who does not have a predetermined authority cannot input a performance of the second mode to the control unit 190 through the mode input unit 193. In this case, since only the first mode can be performed, a collection coin cannot be collected. A method for confirming information of an operator (specifically, whether an operator has a predetermined authority or not) is not limited to the method in which an ID card of the operator is read by the card reader 195. As an alternative method, for example, an operator may input his/her ID information through the operation display unit 192, and the control unit 190 may determine whether the inputted operator's ID information satisfies a predetermined condition or not.

In addition, in the coin depositing and dispensing machine 110 in this embodiment, in a case where the first mode is performed by the control unit 190, when a collection coin is sent to the overflow box 180, the operation display unit 192 is configured to display that the collection coin has been sent to the overflow box 180. Alternatively, in a case where the second mode is performed by the control unit 190, when a collection coin is sent to the coin dispensing opening 18, the operation display unit 192 is configured to display that the collection coin has been sent to the coin dispensing opening 18. That is to say, the operation display unit 192 functions as an notifying unit which is configured, when a collection coin is sent to the overflow box 180 or the coin dispensing opening 18, to notify an operator that the collection coin has been sent to the overflow box 180 or the coin dispensing opening 18. When a collection coin is sent to the overflow box 180 or the coin dispensing opening 18, since the operation display unit 192 displays that the collection coin has been sent to the overflow box 180 or the coin dispensing opening 18, an operator can confirm a destination of a collection coin having been put into the coin depositing and dispensing machine 110 by the display of the operation display unit 192.

In addition, in the coin depositing and dispensing machine 110 in this embodiment, the overflow box 180 is removable from the housing 12 of the coin depositing and dispensing machine 110. Further, the deposited-coin transport unit 20 is provided with the overflow-coin sorting unit 124*b*, so that an overflow coin and a collection coin can be directly sent from the deposited-coin transport unit 20 to the overflow box 180 by the overflow-coin sorting unit 124*b*.

Figure 15:
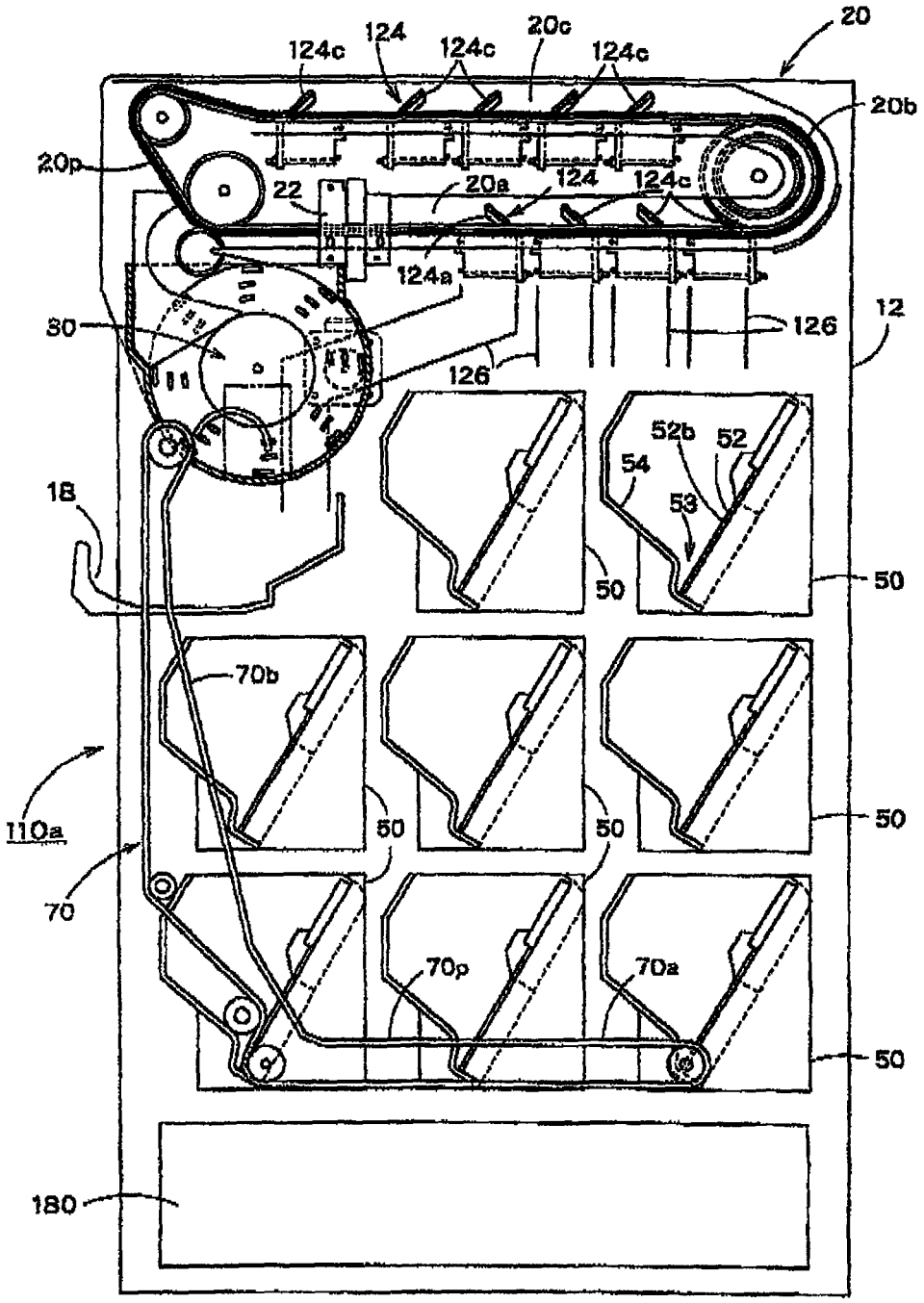
FIG. 15 is a side view schematically showing an inside structure of the coin depositing and dispensing machine of another structure in the second embodiment of the present invention.

The coin depositing and dispensing machine 110 in this embodiment is not limited to the above manner, and can be variously modified. Another structure of the coin depositing and dispensing machine in this embodiment is described with reference to FIGS. 15 and 16. FIG. 15 is a side view schematically showing an inside structure of the coin depositing and dispensing machine 110*a* in alternative example, and FIG. 16 is a front view schematically showing the inside structure of the coin deposing and dispensing machine 110*a* shown in FIG. 15.

Figure 16:
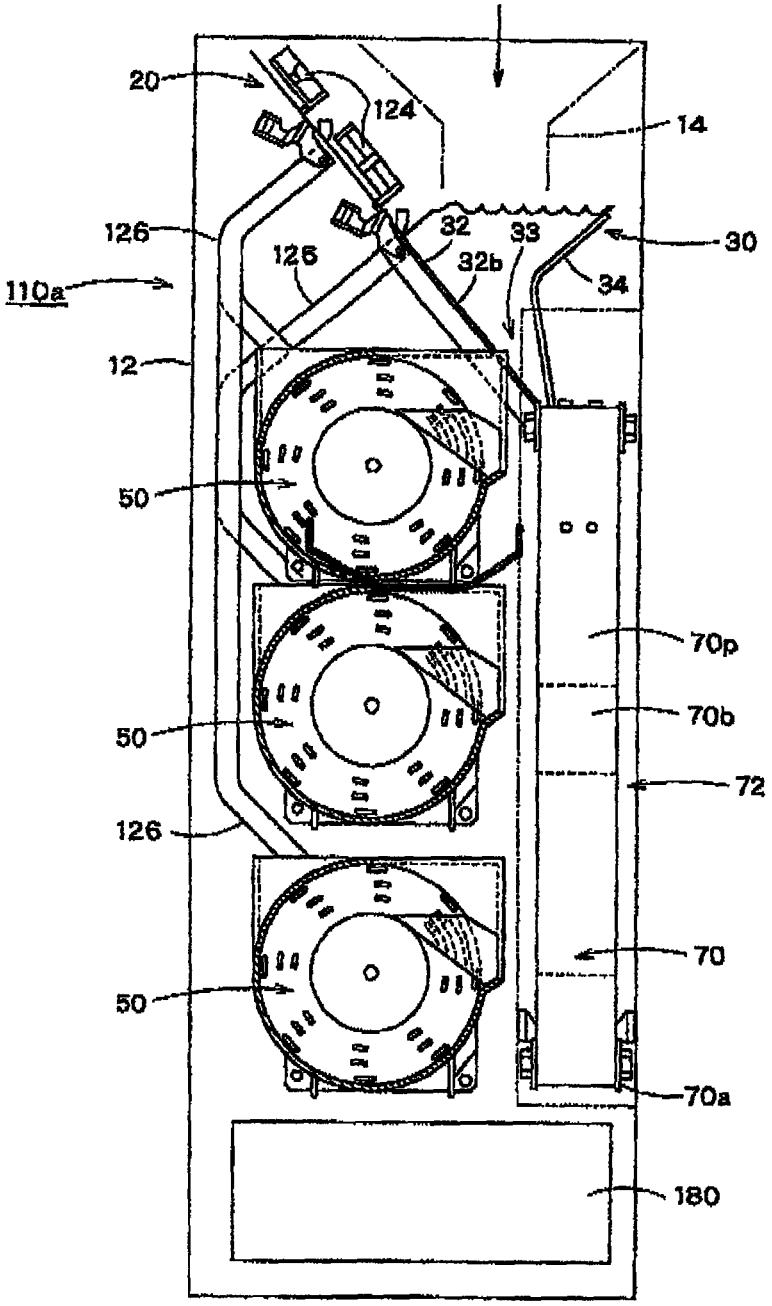
FIG. 16 is a front view schematically showing an inside structure of the coin deposing and dispensing machine shown in FIG. 15.

The coin depositing and dispensing machine 110*a* shown in FIGS. 15 and 16 differs from the coin depositing and dispensing machine 110 shown in FIGS. 11 to 14 only in that there is not provided the overflow-coin sorting unit 124*b* configured to directly send an overflow coin and a collection coin from the deposited-coin transport unit 20 to the overflow box 180. The other structures are substantially the same as those of the coin depositing and dispensing machine 110 shown in FIGS. 11 to 14.

In the coin depositing and dispensing machine 110*a* shown in FIGS. 15 and 16, one or more storing and feeding apparatus(es) 50 among the eight storing and feeding apparatuses 50 is(are) used as an escrow unit(s) configured to temporarily store a collection coin (or collection coins) and an overflow coin (overflow coins). When the first mode is performed by the control unit 190, a coin that has been recognized as a collection coin or an overflow coin by the recognition unit 22 is sorted by the sorting unit 124*c* so as to be sent from the deposited-coin transport unit 20 to the storing and feeding apparatus 50 serving as the escrow unit. After all the coins have been fed out from the pooling and feeding apparatus 30 so as to be sent to the coin dispensing opening 18 and the respective storing and feeding apparatuses 50, a collection coin (or collection coins) and an overflow coin (overflow coins) are fed out from the storing and feeding apparatus 50 serving as the escrow unit, so as to be sent to the coin-to-be-dispensed transport unit 70. At this time, the endless belt 70*p* of the coin-to-be-dispensed transport unit 70 is cyclically moved in the clockwise direction in FIG. 15. Thus, the collection coin(s) and the overflow coin(s) having been fed out from the storing and feeding apparatus 50 drop, by own weights thereof, onto the endless belt 70*p* in the first coin-to-be-dispensed transport unit 70*a*, and the coins on the endless belt 70*p* are then sent to the overflow box 180. In this manner, a collection coin (or collection coins) and an overflow coin (overflow coins) are stored in the overflow box 180.

Alternatively, when the second mode is performed by the control unit 190, a coin that has been recognized as a collection coin by the recognition unit 22 is sent to the coin dispensing opening 18 by the reject-coin sorting unit 124*a*, while a coin that has been recognized as an overflow coin by the recognition unit 22 is sorted by the sorting unit 124*c* so as to be sent from the deposited-coin transport unit 20 to the storing and feeding apparatus 50 serving as the escrow unit. Then, after all the coins have been fed out from the pooling and feeding unit 30 so as to be sent to the coin dispensing opening 18 and the respective storing and feeding apparatuses 50, an overflow coin is fed out from the storing and feeding apparatus 50 serving as the escrow unit so as to be sent to the coin-to-be-dispensed transport unit 70. At this time, the endless belt 70*p* of the coin-to-be-dispensed transport unit 70 is cyclically moved in the clockwise direction in FIG. 15. Thus, the overflow coin having been fed out from the storing and feeding apparatus 50 drops, by an own weight thereof, onto the endless belt 70*p* in the first coin-to-be-dispensed transport portion 70*a*, and the coin on the endless belt 70*p* is then sent to the overflow box 180. In this manner, the overflow coin is stored in the overflow box 180.

As a further alternative example, in place of the overflow box 180, one or more storing and feeding apparatus(es) 50 among the eight storing and feeding apparatuses 50 may be used as an overflow unit(s) configured to store an overflow coin (or overflow coins) and a collection coin (or collection coins). In this case, when the first mode is performed by the control unit 190, a coin that has been recognized as an overflow coin or a collection coin by the recognition unit 22 is sorted by the sorting unit 124*c* so as to be sent from the deposited-coin transport unit 20 to the storing and feeding apparatus 50 serving as the overflow unit. Alternatively, when the second mode is performed by the control unit 190, a coin that has been recognized as a collection coin by the recognition unit 22 is sent to the coin dispensing opening 18 by the reject-coin sorting unit 124*a*, while a coin that has been recognized as an overflow coin by the recognition unit 22 is sorted by the sorting unit 124*c* so as to be sent from the deposited-coin transport unit 20 to the storing and feeding apparatus 50 serving as the overflow unit.

Figure 17:
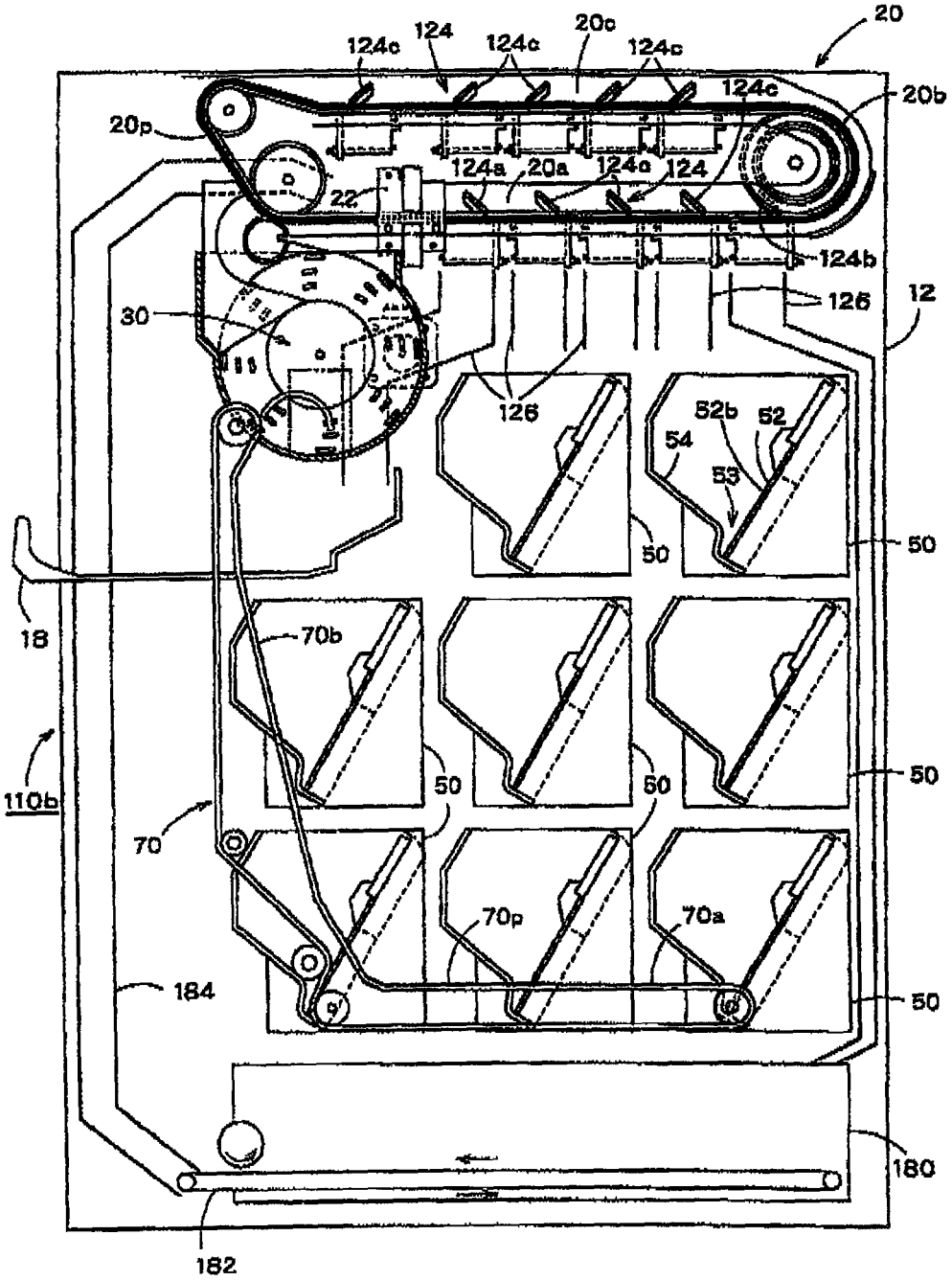
FIG. 17 is a side view schematically showing an inside structure of the coin depositing and dispensing machine of yet another structure in the second embodiment of the present invention.

In yet another alternative example, as shown in FIG. 17, the overflow box 180 is not removable from the housing 12, but the overflow box 180 has a feeding unit 182 configured to feed out coins stored in the overflow box 180 from the overflow box 180. In this case, there is provided a replenishment transport unit 184 configured to send coins having been fed out by the feeding unit 182 to the deposited-coin transport unit 20 (more specifically, a position that is upstream of the recognition unit 22 in the deposited-coin transport unit 20). According to such a coin depositing and dispensing machine 110*b*, an overflow coin (or overflow coins) and a collection coin (or collection coins) stored in the overflow box 180 can be automatically sent to the deposited-coin transport unit 20. Thus, it is not necessary for an operator to manually put a coin (or coins) stored in the overflow box 180 into the coin receiving opening 14.

In addition, in the second embodiment, the coin depositing and dispensing machine for performing a coin depositing operation and a coin dispensing operation is not limited to be used as a money handling apparatus. In the second embodiment, a money handling apparatus such as a banknote handling apparatus may be used. When a banknote handling apparatus is used in the second embodiment, an overflow banknote (or overflow banknotes), which cannot be stored in the respective storing and feeding units, and a collection banknote (or collection banknotes), which is to be collected from the banknote handling apparatus, are stored in the overflow unit such as the overflow box. The control unit for controlling the transport unit is configured to selectively perform any one of the first mode in which a collection banknote is sent from the transport unit to the overflow unit, and the second mode in which a collection banknote is sent from the transport unit to the banknote dispensing opening.

Third Embodiment

Figure 18:
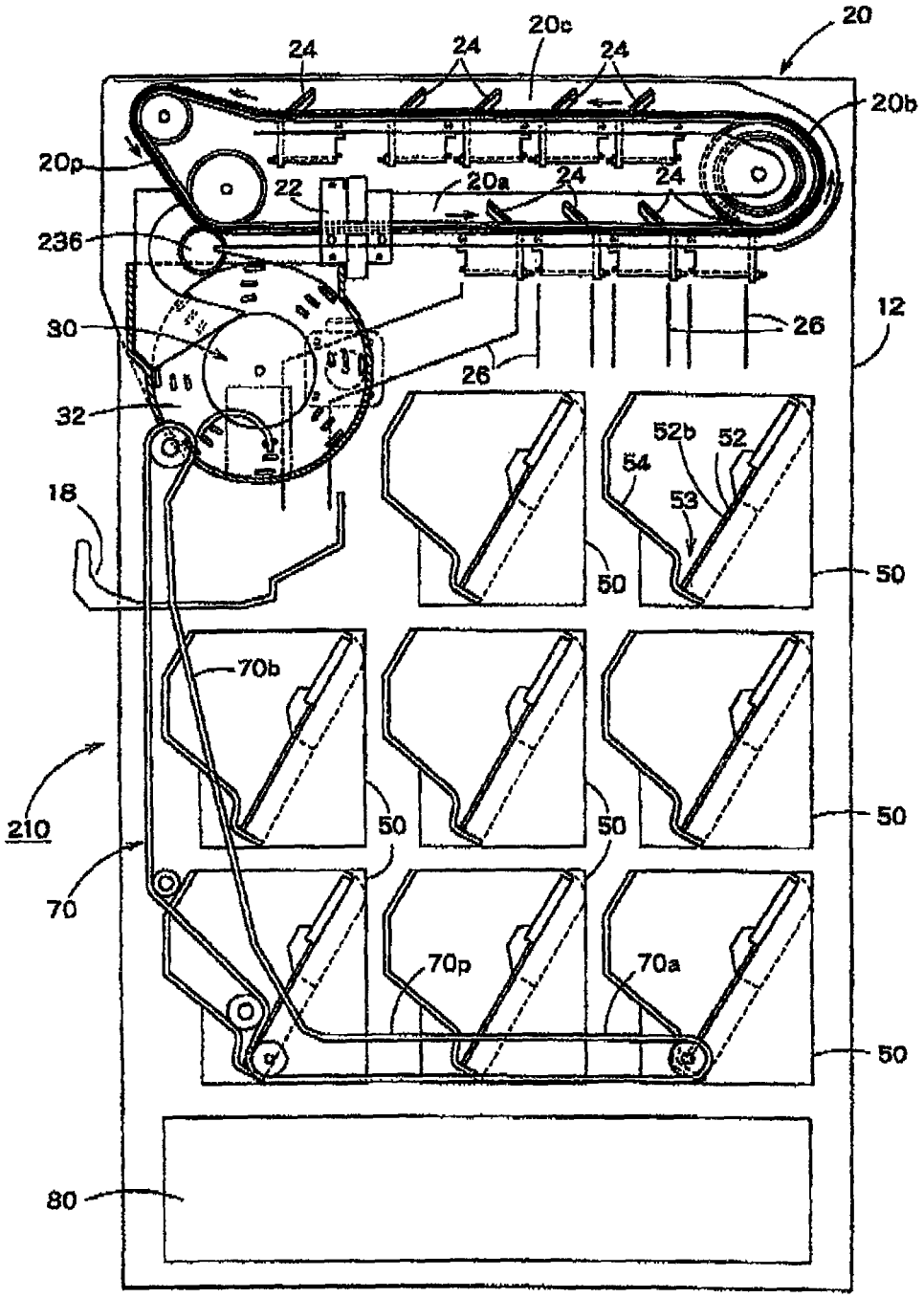
FIG. 18 is a side view schematically showing an inside structure of the coin depositing and dispensing machine in a third embodiment of the present invention.
Figure 19:
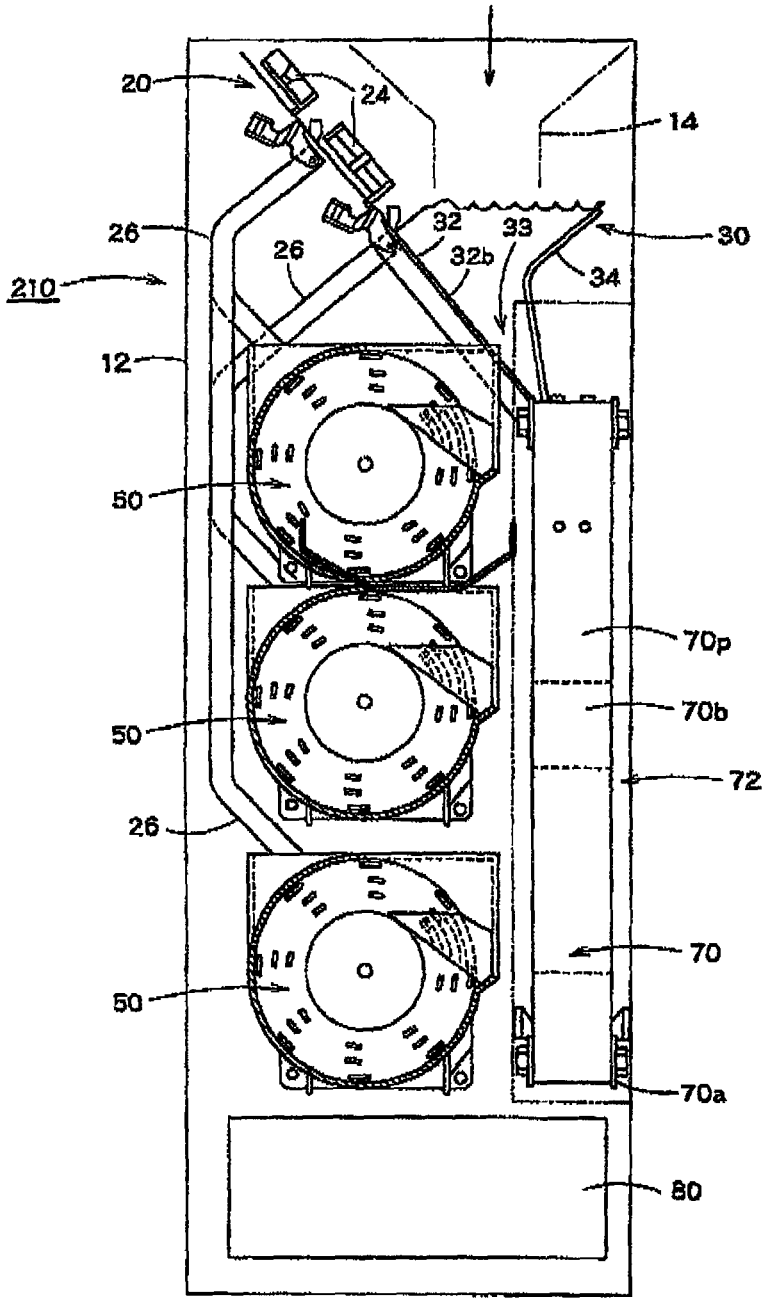
FIG. 19 is a front view schematically showing the inside structure of the coin depositing and dispensing machine shown in FIG. 18.
Figure 20:
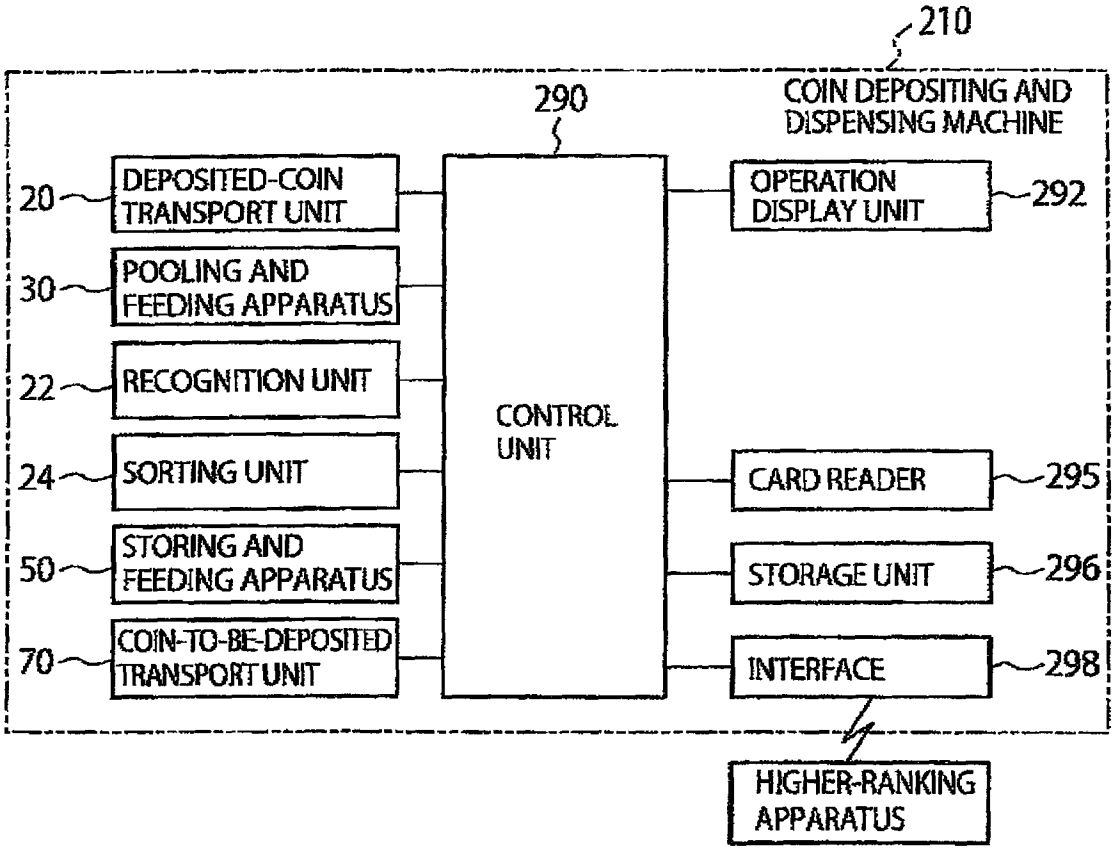
Figure 21:
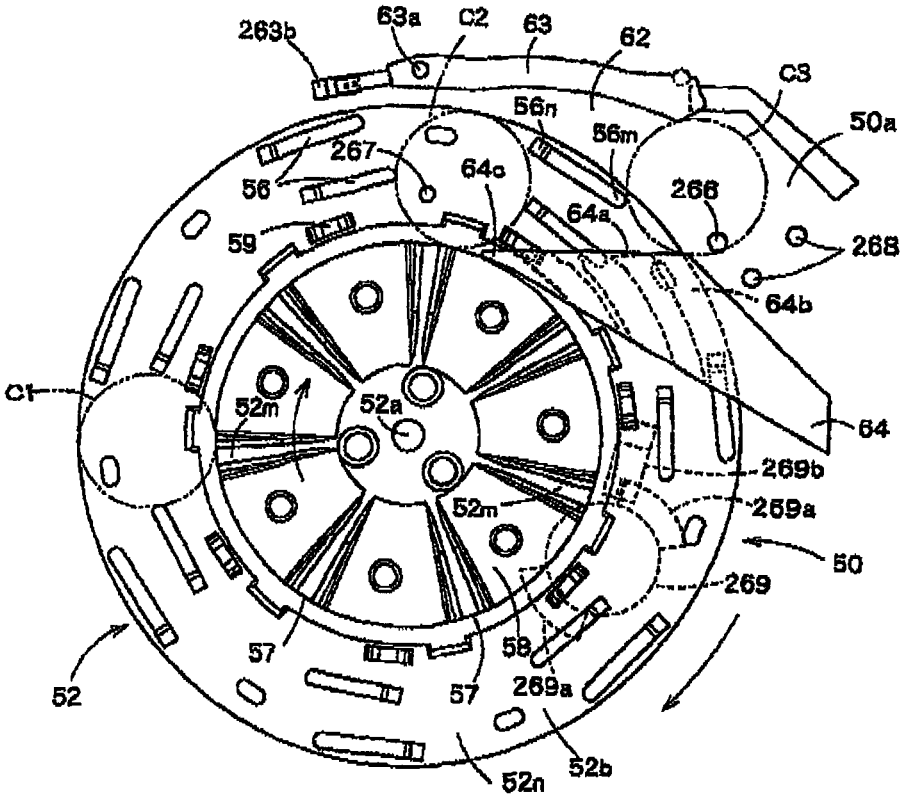
Figure 22:
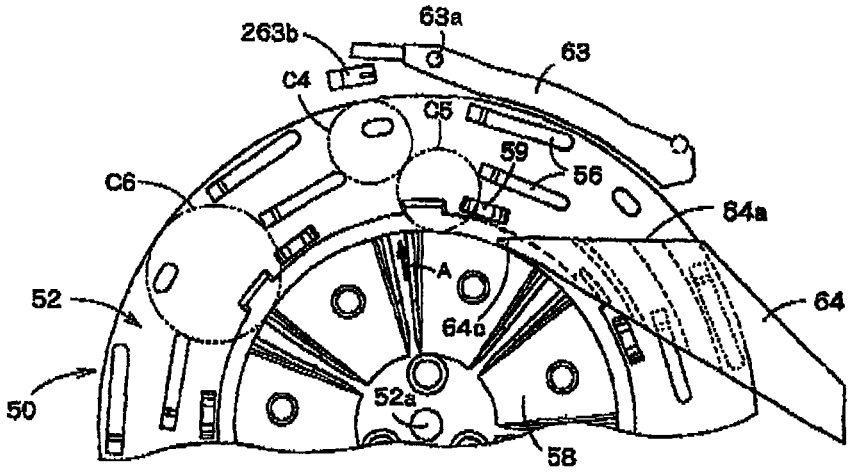
FIG. 22 is a view showing a state where two coins are caught by one transport projecting member in the storing and feeding apparatus shown in FIG. 21.
Figure 23:
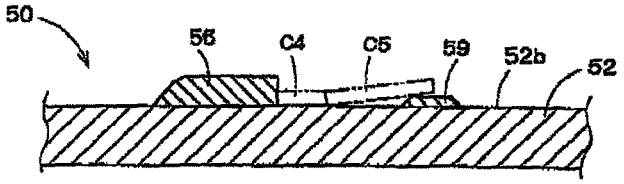
FIG. 23 is a vertical sectional view showing an elimination projecting member and so on taken in a direction A in FIG. 22.
Figure 24:
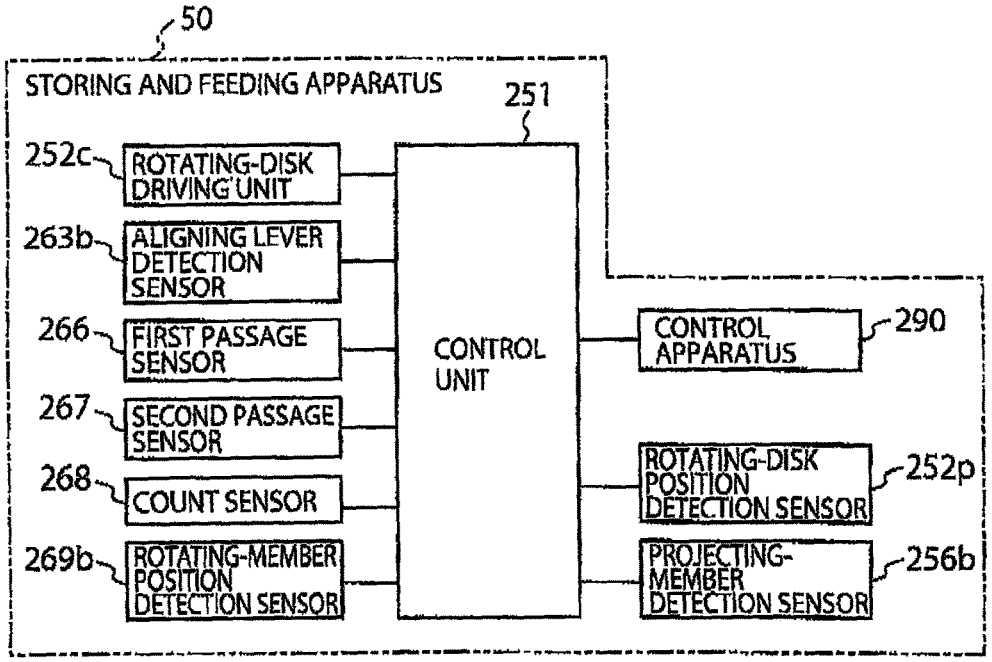

A third embodiment of the present invention will be described herebelow with reference to the drawings. FIGS. 18 to 25 are views showing a coin depositing and dispensing machine in the third embodiment. FIG. 18 is a side view schematically showing an inside structure of the coin depositing and dispensing machine in the third embodiment. FIG. 19 is a front view schematically showing the inside structure of the coin depositing and dispensing machine shown in FIG. 18. FIG. 20 is a functional block view of the coin depositing and dispensing machine shown in FIG. 18 and so on. FIGS. 21 to 23 are structural views showing a structure of a storing and feeding apparatus in the coin depositing and dispensing machine shown in FIG. 18 and so on. FIG. 24 is a functional block view of the storing and feeding apparatus shown in FIG. 21 and so on. In describing the coin depositing and dispensing machine in the third embodiment, a constituent element identical to that of the coin depositing and dispensing machine in the first embodiment is shown by the same reference symbol and description thereof is omitted.

As shown in FIGS. 18 and 19, a coin depositing and dispensing machine 210 includes: a housing 12 of substantially a parallelepiped shape, a coin receiving opening 14 configured to receive coins from an outside of the housing 12; and a pooling and feeding apparatus 30 to which the coin having been received through the coin receiving opening 14 is sent to be pooled therein, the pooling and feeding apparatus 30 configured to feed out, one by one, coins pooled therein. In the housing 12, there is provided a deposited-coin transport unit 20 configured to transport, one by one, the coins having been fed out from the pooling and feeding apparatus 30. The deposited-coin transport unit 20 is provided with a recognition unit 22 configured to recognize each of the coins transported by the deposited-coin transport unit 20.

As shown in FIG. 18, in the pooling and feeding apparatus 30, disposed above a rotating disk 32 is a delivery disk 236 having a diameter smaller than that of the rotating disk 32. A coin having been transported from a lower area of the rotating disk 32 to an upper area thereof is fed out to the deposited-coin transport unit 20 by the delivery disk 236.

In the coin depositing and dispensing machine 210, there is provided a control apparatus 290 configured to control the respective constituent elements of the coin depositing and dispensing machine 210. A structure of the control apparatus 290 is described with reference to FIG. 20. As shown in FIG. 20, the control apparatus 290 is connected to the deposited-coin transport unit 20, the pooling and feeding apparatus 30, the recognition unit 22, the sorting units 24, the storing and feeding apparatuses 50, the coin-to-be-dispensed transport unit 70 and so on. A coin recognition result by the recognition unit 22 is sent to the control apparatus 290. The control apparatus 290 is configured to give respective commands to the deposited-coin transport units 20, the pooling and feeding apparatus 30, the sorting unit 24, the storing and feeding apparatus 50, the coin-to-be-dispensed transport unit 70 and so on, so as to control these constituent elements.

In addition, an operation display unit 292 (not shown in FIGS. 18 and 19) is provided on an upper surface or a front surface of the housing 12 of the coin depositing and dispensing machine 210. The operation display unit 292 is connected to the control apparatus 290. The operation display unit 292 is formed of a display of a touch-panel type, for example. Information inputted by an operator through the operation display unit 292 is transmitted to the control apparatus 290. In addition, the control apparatus 290 transmits information to the operation display unit 292 so as to cause the operation display unit 292 to display various information. In addition, a card reader 295 (not shown in FIGS. 18 and 19) is provided on the upper surface or the front surface of the housing 12 of the coin depositing and dispensing machine 210. ID information of an ID card brought by an operator is read by the card reader 295. The card reader 295 is connected to the control apparatus 290, so that the ID information of the operator read by the card reader 295 is transmitted to the control apparatus 290. Further, a storage unit 296 is connected to the control apparatus 290. The storage unit 296 is configured to store various setting information of the coin depositing and dispensing machine 210 and storing information such as the number of coins for each denomination stored in the respective storing and feeding apparatuses 50. Furthermore, an interface 298 is connected to the control apparatus 290. Through the interface 298, the control apparatus 290 can transmit and receive information to and from an external apparatus (e.g., higher-ranking apparatus) other than the coin depositing and dispensing machine 210.

Next, a structure of the storing and feeding apparatus 50 is described in detail with reference to FIGS. 18 and 21 to 23.

As shown in FIG. 18, the storing and feeding apparatus 50 includes: a rotating disk 52 that is inclined at a predetermined angle relative to the vertical direction, and is configured to be rotated in an inclined posture; and a cover member 54 forming a coin storing space 53 for storing a coin, between the surface 52*b* of the rotating disk 52 and the cover member 54. As shown in FIG. 21, the rotating disk 52 has a rotating shaft 52*a*. The rotating disk 52 is configured to be rotated about the rotating shaft 52*a* in the clockwise direction in FIG. 21 (direction shown by the arrow in FIG. 19) in a state where the rotating disk 52 is inclined at a predetermined angle relative to the vertical direction. A rotating-disk drive unit 252*c* (not shown in FIG. 21) formed of, e.g., a stepping motor or the like is connected to the rotating shaft 52*a*. When the rotating shaft 52*a* is driven in rotation by the rotating-disk drive unit 252*c*, the rotating disk 52 is rotated.

An aligning lever 63 is located on one peripheral side of an outlet 50*a* of the storing and feeding apparatus 50. The aligning lever 63 is configured to be swung about a shaft 63*a*. When no force is applied to the aligning lever 63, a force is urged by a torsion spring (not shown) disposed on the shaft 63*a* to the aligning lever 63 in the clockwise direction about the shaft 63*a*. At this time, the aligning lever 63 is maintained at a position shown in FIG. 22. On the other hand, when a coin passes through the guide channel 62, the aligning lever 63 is configured to be pushed by the coin in the counterclockwise direction about the shaft 63*a* against the force applied by the torsion spring (see coin C3 in FIG. 21). In addition, as shown in FIG. 22, an aligning lever detection sensor 263*b* is disposed near to the aligning lever 63. The aligning lever detection sensor 263*b* is configured to detect that, when the aligning lever 63 is pressed by a coin and is moved from the position shown in FIG. 22, the aligning lever 63 has been pressed by a coin and is moved from the position shown in FIG. 22.

A passage sensor 266 and a pair of count sensors 268 are disposed on the outlet 50*a* of the storing and feeding apparatus 50. When a coin, which has been brought up from the lower area of the rotating disk 52 to the upper area thereof so as to be sent to the outlet 50*a* of the storing and feeding apparatus 50, passes the passage sensor 266, the passage sensor 66 is configured to detect that the coin has passed through the first passage sensor 266. Meanwhile, the pair of count sensors 268 are configured to count the number of coins fed out from the outlet 50 of the storing and feeding apparatus 50.

A second passage sensor 267 configured to detect a coin transported on the rotating disk 52 is disposed near to the rotating disk 52. The second passage sensor 267 is located apart from the rotating disk 52, so that the second passage sensor 267 is not moved even when the rotating disk 52 is rotated. The second passage sensor 267 is configured to detect that, when a coin on the rotating disk 52 is transported by one of the transport projecting members 56 to reach the position of the second passage sensor 267, the coin on the rotating disk 52 has been transported by one of the transport projecting members 56 to reach the position of the second passage sensor 267.

In addition, as shown in FIG. 21, near to the rotating disk 52 in the storing and feeding apparatus 50, there is disposed a rotating member 269 (shown by dotted lines in FIG. 21) configured to be rotated synchronically with the rotating disk 52 in the counterclockwise direction in FIG. 21. More specifically, when the rotating disk 52 is rotated by a distance corresponding to a distance between two adjacent projection assemblies (as described above, each projection assembly is a combination of a pair of transport projecting members 56 and one elimination projecting member 59), the rotating member 269 is configured to be rotated a half circle. Namely, each time when a coin is fed out from the outlet 50*a* of the storing and feeding apparatus 50 by each projection assembly of the rotating disk 52, the rotating member 269 is rotated a half circle. A pair of rotation detection light-shielding plates 269*a* are attached to an outer periphery of the rotating member 269. In addition, a rotating-member position detection sensor 269*b* is disposed near to the rotating member 269. The rotating-member position detection sensor 269*b* is formed of, e.g., an optical sensor. The rotating-member position detection sensor 269*b* is configured to detect the rotation detection light-shielding plate 269*a*, when the rotation detection light-shielding plate 269*a* attached to the rotating member 269 reaches the rotating-member position detection sensor 269*b*. In this manner, the rotating-member position detection sensor 269*b* is configured to detect a rotating position of the rotating member 269.

The storing and feeding apparatus 50 is provided with a control unit 251 configured to control the respective constituent elements of the storing and feeding apparatus 50. A structure of the control unit 251 is described with reference to FIG. 24. As shown in FIG. 24, the control unit 251 of the storing and feeding apparatus 50 is connected to the rotating-disk drive unit 252*c*, the aligning lever detection sensor 263*b*, the first passage sensor 266, the second passage sensor 267, the count sensors 268, the rotating-member position detection sensor 269 and so on. The control unit 251 is connected to the control apparatus 290. The control unit 251 is configured to transmit and receive a signal to and from the control apparatus 290. The control unit 251 is configured to control the rotating-disk drive unit 252*c* based on a command transmitted from the control apparatus 290. Detection results by the respective sensors 263*b*, 266, 267, 268, 269*b* are transmitted from the control unit 251 to the control apparatus 290. As another embodiment, the control unit 251 may not be disposed on the storing and feeding apparatus 50, and the rotating-disk drive unit 252*c* and the respective sensors 263*b*, 266, 267, 268 and 269*b* may be directly connected to the control apparatus 290.

Next, an operation of the coin depositing and dispensing machine 210 as structured above is described. The below-described operation of the coin depositing and dispensing machine 210 is performed by the control apparatus 290 that controls the respective constituent elements of the coin depositing and dispensing machine 210.

When an operator puts a coin into the coin receiving opening 14 of the coin depositing and dispensing machine 210, the coin drops, by an own weight thereof, to be sent to the pooling and feeding apparatus 30. Then, when the rotating disk 32 is rotated in the counterclockwise direction in FIG. 18 in the pooling and storing apparatus 30, a coin pooled in the coin pooling space 33 to be present in the lower area of the rotating disk 32 is brought up from the lower area of the rotating disk 32 to the upper area thereof. Thereafter, the coin having been brought up to the upper area of the rotating disk 32 is pushed out toward the outlet of the pooling and feeding apparatus 30 so as to be finally sent by the delivery disk 236 to the endless belt 20*p* of the deposited-coin transport unit 20. In this manner, coins pooled in the pooling and feeding apparatus 30 are fed out, one by one, to the deposited-coin transport unit 20.

The coin having been fed out from the pooling and feeding apparatus 30 to the deposited-coin transport unit 20 is transported by the endless belt 20*p* of the deposited-coin transport unit 20. Specifically, the coin is firstly recognized by the recognition unit 22. A coin that has been recognized as a reject coin is sorted by the sorting unit 24 functioning as the reject sorting unit, which is located on the most upstream position in the first deposited-coin transport portion 20*a*, so as to be sent to the coin dispensing opening 18.

On the other hand, a coin that is not a reject coin but a normal coin is sorted by denomination by one of the sorting units 24 based on a coin denomination having been recognized by the recognition unit 22, so as to be sent to the storing and feeding apparatus 50 corresponding to the sorting unit 24.

When a coin is dispensed or collected from the coin deposition and dispensing machine 210, a coin to be dispensed or collected is fed out from the storing and feeding apparatus 50 corresponding to a denomination of the coin to be dispensed or collected, so as to be sent to the coin-to-be-dispensed transport unit 70. Specifically, when the rotating disk 52 is rotated in the storing and feeding apparatus 50 in the clockwise direction in FIG. 21, a coin stored in the coin storing space 53 to be present in the lower area of the rotating disk 52 is brought up from the lower area of the rotating disk 52 to the upper area thereof, in such a manner that the coin is held, one by one, between one of the transport projecting members 56 on the inner circumferential side and the cover member 54. Thereafter, the coin is delivered to the transport projecting member 56 on the inner circumferential side and the coin-periphery holding unit 57. The coin, which has been brought up to the upper area of the rotating disk 52 by the transport projecting member 56 on the inner circumferential side, is pushed out toward the outlet 50*a* of the storing and feeding apparatus 50 by one of the transport projecting members 56 on the outer circumferential side (see coin C3 in FIG. 21) so as to be sent to the guide channel 62. At this time, the coin present on the surface 52*b* of the rotating disk 52 is guided by the guide member 64 so as to be fed to the outside of the rotating disk 52. Then, the coin, which has been sent from the guide channel 62 to the outlet 50*a* of the storing and feeding apparatus 50, drops, by an own weight thereof, onto the endless belt 70*p* in the first coin-to-be-dispensed transport portion 70*a*, through the coin dispensing space 72. At this time, the coin is fed out from the storing and feeding apparatus 50 in the right direction in FIG. 19.

When a coin is fed out from the storing and feeding apparatus 50, if two or more coins are caught by one of the transport projecting members 56 on the inner circumferential side, only one of the coins (see coin C4 in FIGS. 22 and 23) caught by the transport projecting member 56 does not float up from the surface 52*b* of the rotating disk 52, and one or more coins other than the only one coin (see coin C5 in FIGS. 22 and 23) are caused to float up by the elimination projecting member 59 from the surface 52*b* of the rotating disk 52. When the two or more coins caught by the one transport projecting member 56 on the inner circumferential side reach the guide member 64, the coin that does not float up from the surface 52*b* of the rotating disk 52 (coin C4 in FIGS. 22 and 23) is guided to the outlet 50*a* of the storing and feeding apparatus 50 along the upper peripheral portion 64*a* of the guide member 64. On the other hand, since the front part of each of the second coin (coin C5 in FIGS. 22 and 23) and a coin (or coins) succeeding thereto, which floats up from the surface 52*b* of the rotating disk 52, is caught by the distal end portion 64*c* of the guide member 64, the coin is not fed out to the outside of the rotating disk 52 by the guide member 64 but drops, by an own weight of the coin, to the lower area of the rotating disk 52. In this manner, it can be prevented that two or more coins are simultaneously fed out by the guide member 64 from the rotating disk 52 to the outlet 50*a* of the storing and feeding apparatus 50 through the guide channel 62.

When a coin is dispensed from the coin depositing and dispensing machine 210, the endless belt 70*p* of the coin-to-be-dispensed transport unit 70 is cyclically moved in the counterclockwise direction in FIG. 18. Thus, a coin having been fed out from one of the coin storing and feeding apparatuses 50 drops, by an own weight thereof, onto the endless belt 70*p* in the first coin-to-be-dispensed transport portion 70*a*, through the coin dispensing space 72. Thereafter, the coin on the endless belt 70*p* is sent from the first coin-to-be-dispensed transport portion 70*a* to the second coin-to-be-dispensed transport portion 70*b*. The coin caught by one of the projecting members of the endless belt 70*p* in the second coin-to-be-dispensed transport portion 70*b* is moved upward in FIG. 18 so as to be finally sent from the upper end portion of the second coin-to-be-dispensed transport portion 70*b* to the coin dispensing opening 18.

On the other hand, when a coin is collected from the coin depositing and dispensing machine 210, the endless belt 70*p* of the coin-to-be-dispensed transport unit 70 is cyclically moved in the clockwise direction in FIG. 18. Thus, a coin having been fed out from one of the storing and feeding apparatuses 50 drops, by an own weight of the coin, onto the endless belt 70*p* in the first coin-to-be-dispensed transport portion 70*a*, through the coin dispensing space 72. Thereafter, the coin on the endless belt 70*p* is sent from the first coin-to-be-dispensed transport portion 70*a* to the collection box 80 so as to be stored in the collection box 80. After the coin has been stored in the collection box 80, an operator takes out the collection box 80 from the housing 12, so that the coin together with the collection box 80 is collected.

In the storing and feeding apparatus 50 in this embodiment, while coins are fed out from the storing and feeding apparatus 50, when coins of the preset number have been dispensed to the outside through the outlet 50*a* of the storing and feeding apparatus 50, the rotating disk 52 is stopped at a position where one of the transport projecting members 56 blocks the outlet 50*a*. More specifically, when coins of the preset number have been dispensed to the outside through the outlet 50*a* of the storing and feeding apparatus 50, the rotating disk 52 is stopped at a position where the transport projecting member having transported the coin of an order equal to the preset number blocks the outlet 50*a*.

Figure 25:
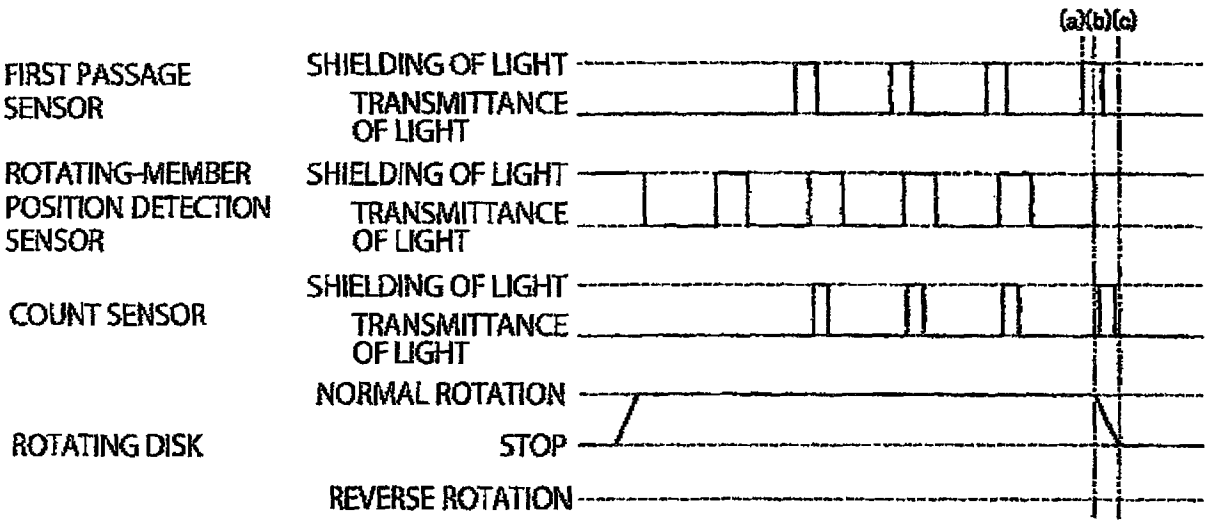
FIG. 25 is a sequence diagram showing detection conditions of a first passage sensor, a rotating-member position detection sensor and a count sensor, and a rotating and driving operation of the rotating disk by a rotating-disk drive unit.

Herebelow, there is described an operation for rotating and driving the rotating disk 52 by the rotating-disk drive unit 252*c*, when coins of the preset number have been dispensed to the outside from the coin storing space 53 through the outlet 50*a* of the storing and feeding apparatus 50, with reference to FIG. 25. FIG. 25 is a sequence diagram showing detection conditions of the first passage sensor 266, the rotating-member position detection sensor 269*b* and the count sensors 268, and a rotating and driving operation of the rotating disk 52 by the rotating-disk drive unit 252*c*.

When a coin is fed out to the outside from the storing and feeding apparatus 50, the rotating disk 52 is normally rotated (see FIG. 25) by the rotating-disk drive unit 252*c* formed of a stepping motor or the like. Specifically, the rotating disk 52 is rotated in the clockwise direction in FIG. 21. Then, while the rotating disk 52 is being normally rotated, the rotating member 26 is rotated synchronically with the rotating disk 52. More specifically, when the rotating disk 52 is rotated by a distance corresponding to the distance between the two adjacent projection assemblies, the rotating member 269 is rotated a half circle. Then, for each time when the rotating member 269 is rotated a half circle, light emitted toward the rotating-member position detection sensor 269*b* formed of an optical sensor or the like is shielded by the rotation detection light-shielding plate 269*a* of the rotating member 269. Thus, the rotating-member position detection sensor 269*b* can detect the rotation detection light-shielding plate

269*a* of the rotating member 269. As another embodiment, the rotating member 269 may be rotated by the rotating-disk drive unit 252*c*, and the rotating disk 52 may be rotated in accordance with the rotation of the rotating member 269. Also in this case, when the rotating member 269 is rotated a half circle, the rotating disk 52 is rotated by a distance corresponding to the distance between the two adjacent projection assemblies.

As described above, a coin having been fed out from the outlet 50*a* of the storing and feeding apparatus 50 is detected by the first sensor 266, and is then counted by the count sensors 268.

In the sequence diagram shown in FIG. 25, when the number of coins to be fed out from the storing and feeding apparatus 50 is four, for example, the number "four" is the preset number. After the fourth coin has been detected by the first passage sensor 266 (see state (a) in FIG. 25), when the rotating-member position detection sensor 269*b* detects the rotation detection light-shielding plate 269*a* of the rotating member 269 (see state (b) in FIG. 25), the rotating disk 52 starts to be decelerated by the rotating-disk drive unit 252*c*. In this manner, the rotating disk 52 is stopped, after a predetermined period of time has passed from when the rotating-member position detection sensor 269*b* detected the rotation detection light-shielding plate 269*a* of the rotating member 269 (see state (c) in FIG. 25). When the rotating disk 52 is stopped, the transport projecting member 56 having transported the fourth coin is located at a position where the transport projecting member 56 blocks the outlet 50*a* of the storing and feeding apparatus 50, whereby no more coin is dispensed to the outside from the outlet 50*a*.

Figure 26:
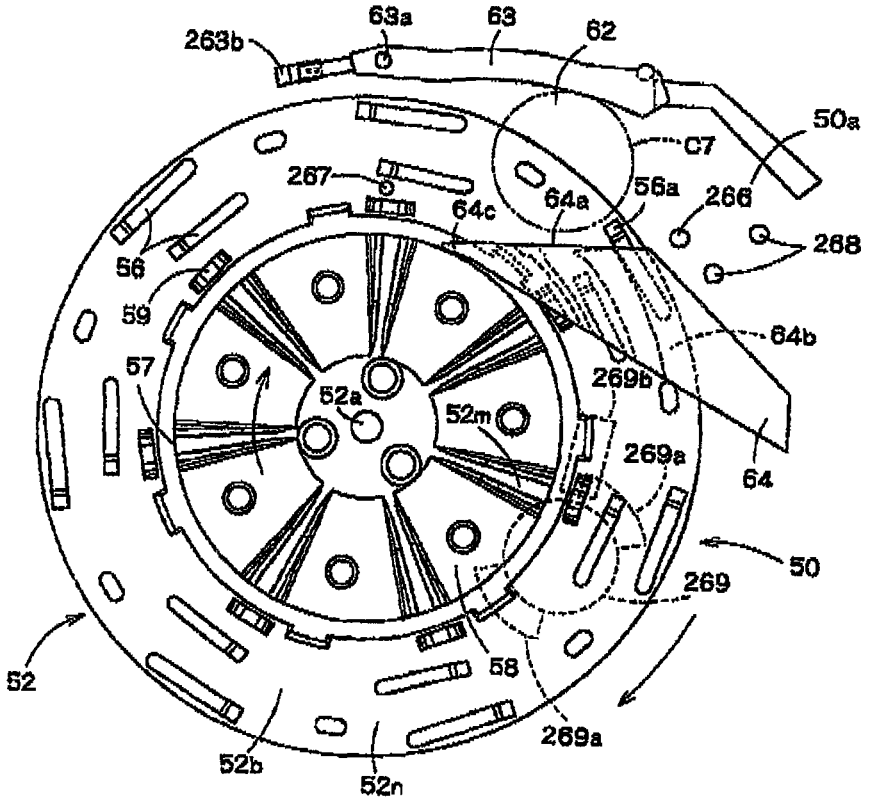
FIG. 26 shows a state where the rotating disk of the storing and feeding apparatus is stopped and the transport projecting member is located at a position where the transport projecting member blocks an outlet of the storing and feeding apparatus.

FIG. 26 shows a state where the rotating disk 52 is stopped and the transport projecting member 56 having transported the coin of an order equal to the preset number blocks the outlet 50*a* of the storing and feeding apparatus 50. In FIG. 26, the transport projecting member having transported the coin of an order equal to the preset number is indicated by the reference symbol 56*a*. In addition, a coin succeeding to the coin of a order equal to the preset number (i.e., a coin that should not be fed out from the outlet 50*a* of the storing and feeding apparatus 50) is indicated by the reference symbol C7.

As shown in FIG. 26, when the coin C7 succeeding to the coin of an order equal to the preset number is transported by one of the transport projecting members 56 to reach the vicinity of the outlet 50*a*, since the transport projecting member 56*a* having transported the coin of an order equal to the preset number blocks the outlet 50*a*, the coin C7 cannot enter the outlet 50*a* of the storing and feeding apparatus 50. In this manner, when the coin of an order equal to the preset number has been dispensed from the coin storing space 53 to the outside through the outlet 50*a* of the storing and feeding apparatus 50, the rotating disk 52 is stopped at a position where the transport projecting member 56*a* having transported the coin of an order equal to the preset number blocks the outlet 50*a*. Thus, it can be prevented that a coin is fed out any more from the outlet 50*a* of the storing and feeding apparatus 50.

In addition, in the storing and feeding apparatus 50 in this embodiment, since the rotating disk 52 is stopped after a predetermined period of time (time between the states (b) and (c) in FIG. 25) has passed from when the rotating-member position detection sensor 269*b* detected the rotation detection light-shielding plate 269*a* of the rotating member 269, the rotating disk 52 is configured to be stopped at the same rotating position regardless of the diameter length of a coin. This mechanism is described in more detail with reference to FIGS. 27(A) and 27(B).

Figure 27B:
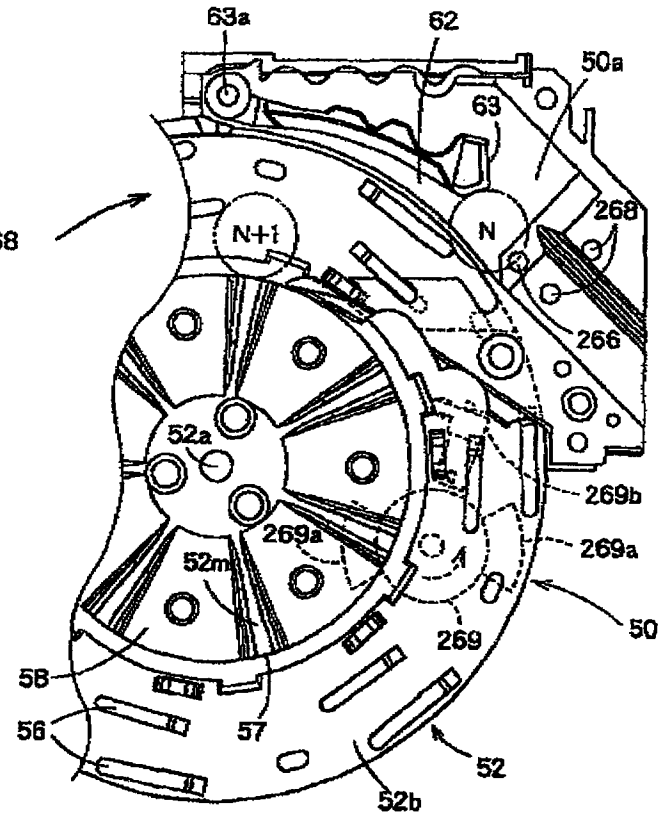
FIG. 27(B) is a view showing a state where a coin of an order equal to the preset number (N-th coin) is detected by the first passage sensor, when a diameter of the coin is relatively small.
Figure 27A:
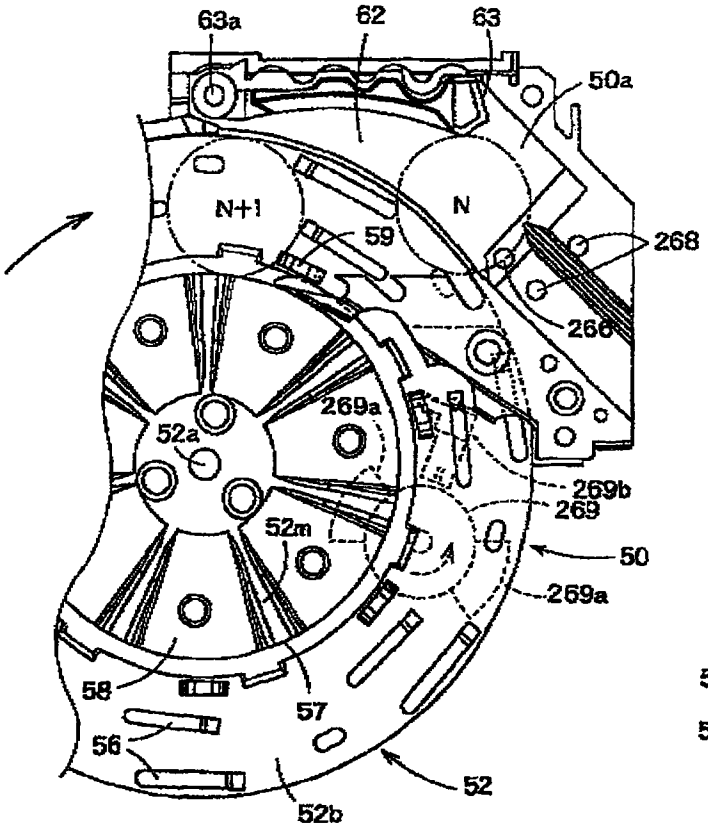
FIG. 27(A) is a view showing a state where a coin of an order equal to the preset number (N-th coin) is detected by the first passage sensor, when a diameter of the coin is relatively large.

FIG. 27(A) is a view showing a state where a coin of an order equal to the preset number (N-th coin) is detected by the first passage sensor, when a diameter of the coin is relatively large (specifically, the coin has a diameter of 26.5 mm). FIG. 27(B) is a view showing a state where a coin of an order equal to the preset number (N-th coin) is detected by the first passage sensor, when a diameter of the coin is relatively small (specifically, the coin has a diameter of 16.25 mm). As shown in FIGS. 27(A) and 27(B), when coins are different in diameter length, the positions of the transport projecting member 56 upon detection of coins of an order equal to the preset number (N-th coins) differ from each other. Thus, in a case where the rotating disk 52 starts to be decelerated by the rotating-disk drive unit 252*c* upon detection of the coin of an order equal to the preset number by the first passage sensor 266, a rotating position at which the rotating disk 52 is stopped differs depending on a diameter length of a coin. Thus, a position where the transport projecting member 56 blocks the outlet 50*a* of the storing and feeding apparatus 50 differs, whereby there is a possibility that the transport projecting member 56 could not completely close the outlet 50*a* depending on a diameter length of a coin, so that (N+1)th coin might be fed out from the outlet 50*a* of the storing and feeding apparatus 50 to the outside. On the other hand, in a case where the rotating disk 52 is stopped after a predetermined period of time has passed from when the rotating-member position detection sensor 269*b* detected the rotation detection light-shielding plate 269*a* of the rotating member 269, a rotating position at which the rotating disk 52 is stopped is the same regardless of a diameter length of a coin. Thus, the transport projecting member 56 can reliably close the outlet 50*a* regardless of a diameter length of a coin.

As described above, according to the storing and feeding apparatus 50 in this embodiment, the control unit 251 controlling the rotating-disk drive unit 252*c* is configured to control the rotating-disk drive unit 252*c* such that the rotating disk 52 is stopped at a position where one of the transport projecting members 56 blocks the outlet 50*a*, as shown in FIG. 26, when coins of the preset number have been dispensed from the coin storing space 53 to the outside through the opening 50*a* of the storing and feeding apparatus 50. Since the rotating disk 52 is stopped at a position where one of the transport projecting members 56 disposed on the rotating disk 52 blocks the outlet 50*a* when coins of the preset number have been dispensed to the outside through the outlet 50*a* of the storing and feeding apparatus 50, the transport projecting member 56 does not allow a coin to be sent from the coin storing space 53 to the outlet 50*a*, whereby a coin in excess of the preset number can be reliably prevented from being dispensed from the outlet 50*a* to the outside. Thus, an excessive coin can be prevented from being fed out from the storing and feeding apparatus 50 to the outside, by a simple structure without providing any additional member such as a delivery disk.

In addition, in the storing and feeding apparatus 50 in this embodiment, as described above, when coins of the preset number have been dispensed from the coin storing space 53 to the outside through the outlet 50*a* of the storing and feeding apparatus 50, the rotating disk 52 is stopped at a position where the transport projecting member 56 having transported the coin of an order equal to the preset number blocks the outlet 50*a*.

In addition, in the storing and feeding apparatus 50 in this embodiment, there are provided the rotating member 269 configured to be rotated synchronically with the rotating disk 52, and the rotating-member position detection sensor 269*b* configured to detect a rotating position of the rotating member 269. The control unit 251 is configured to control the rotating-disk drive unit 252*c* such that the rotating disk 52 is stopped, after a predetermined time period has passed from when the rotating-member position detection sensor 269*b* detected that the rotating member 269 reached a predetermined rotating position, after coins of the preset number had been dispensed from the coin storing space 53 to the outside through the outlet 50*a* of the storing and feeding apparatus 50. In this case, a rotating position at which the rotating disk 52 is stopped is the same position regardless of a diameter length of a coin. Thus, the transport projecting member 56 can reliably close the outlet 50*a* regardless of a diameter length of a coin.

Figure 28:
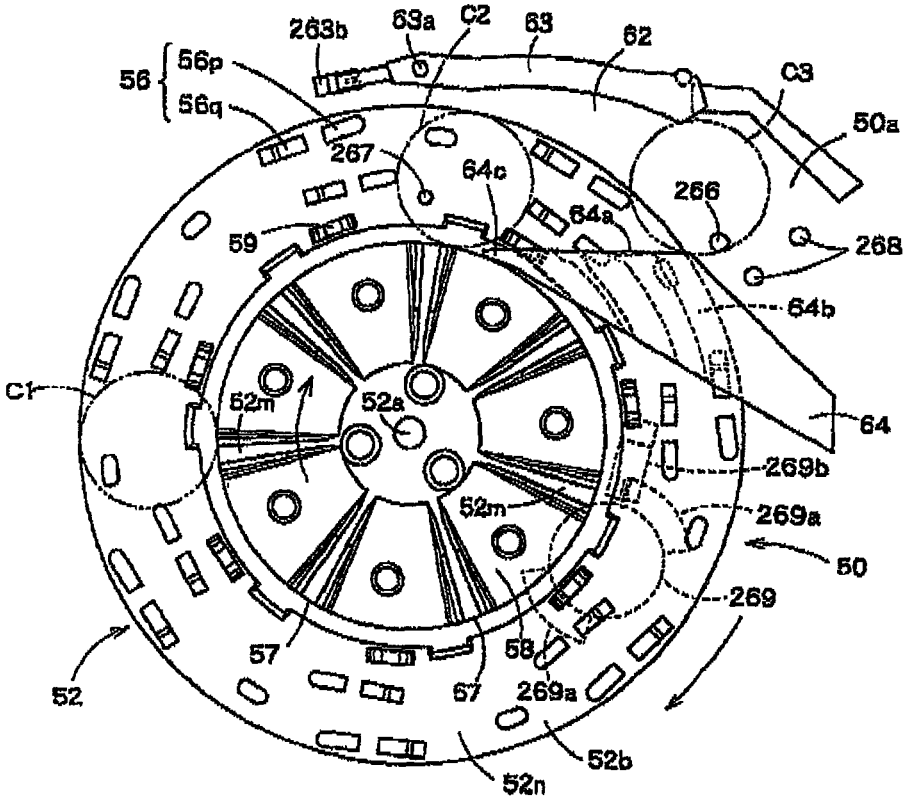
FIG. 28 is a structural view showing another structure of the transport projecting member disposed on the storing and feeding apparatus.

In addition, as shown in FIG. 21, a front end portion 56*m* of each of the transport projecting members 56 functions as a projecting portion for transporting configured to catch a coin on the surface 52*b* of the rotating disk 52 and to transport the coin. Meanwhile, a rear end portion 56*n* of each of the transport projecting members 56 functions as a projecting portion for closing configured to close the outlet 50*a* of the storing and feeding apparatus 50. In the example shown in FIG. 21, the front end portion 56*m* functioning as the projecting portion for transporting and the rear end portion 56*n* functioning as the projecting portion for closing are integrally provided. However, as shown in FIG. 28, a projecting portion for transporting 56*p* and a projecting portion for closing 56*q* of each of the transport projecting members 56 may be separately provided from each other.

In addition, as described above, although the rotating-disk drive unit 252*c* is formed of a stepping motor, the present invention is not limited thereto. The rotating-disk drive unit 252*c* may be formed of a motor of another type, such as a DC motor.

The coin depositing and dispensing machine 210 in this embodiment is not limited to the above manner, but can be variously modified.

For example, the rotating-disk drive unit 252*c* configured to drive the rotating disk 52 in rotation may be directly controlled by the control apparatus 290, instead of the control unit 251 of the storing and feeding apparatus 50.

In addition, when denominations of coins to be fed out from the respective storing and feeding apparatuses 50 are identical, installation of the aligning lever 63 can be omitted. In this case, a channel width of the guide channel 62 for guiding a coin from the upper area of the rotating disk 52 toward the outlet 50*a* of the storing and feeding apparatus 50 is adjusted depending on the denomination of coins, instead of providing the aligning lever 63.

In addition, the transport member 56 that blocks the outlet 50*a* of the storing and feeding apparatus 50, after coins of the preset number have been dispensed from the coin storing space 53 to the outside through the outlet 50*a* of the storing and feeding apparatus 50 and the rotating disk 52 has been stopped, is not limited to a transport projecting member 56 that has transported the coin of an order equal to the preset number.

In addition, in another alternative example, the control unit 251 of the storing and feeding apparatus 50 may be configured to control the rotating-disk drive unit 252*c* such that the rotating disk 52 is stopped after a predetermined period of time has passed from when the coin of an order equal to the preset number was detected by the first passage sensor 266.

Alternatively, the control unit 251 of the storing and feeding apparatus 50 may be configured to control the rotating-disk drive unit 252*c* such that the rotating disk 52 is stopped after a predetermined period of time has passed from when the aligning lever detection sensor 263*b* detected that the coin of an order equal to the preset number had come into contact with the aligning lever 63 so that the aligning lever 63 had been moved.

Alternatively, the control unit 251 of the storing and feeding apparatus 50 may be configured to control the rotating-disk drive unit 252*c* such that the rotating disk 52 is stopped after a predetermined period of time has passed from when the coin of an order equal to the preset number was detected by the second passage sensor 267.

In addition, in still another alternative example, the storing and feeding apparatus 50 may be provided with a rotating-disk position detection sensor 252P configured to detect a rotating position of the rotating disk 52 (see FIG. 24). The control unit 251 may be configured to control the rotating-disk drive unit 252*c* such that the rotating disk 52 is stopped after a predetermined period of time has passed from when the rotating-disk position detection sensor 252*p* detected that the rotating disk 52 reached a predetermined rotating position, after coins of the preset number had been dispensed from the coin storing space 53 to the outside through the outlet 50*a* of the storing and feeding apparatus 50. In this case, a rotating position at which the rotating disk 52 is stopped is the same position regardless of a diameter length of a coin. Thus, the transport projecting member 56 can reliably close the outlet 50*a* regardless of a diameter length of a coin.

In addition, in yet another alternative example, the storing and feeding apparatus 50 may be provided with a projecting-member detection sensor 256*b* configured to detect the transport projecting member 56 disposed on the rotating disk 52 (see FIG. 24). The control unit 251 may be configured to control the rotating-disk drive unit 252*c* such that the rotating disk 52 is stopped after a predetermined period of time has passed from when the projecting-member detection sensor 256*b* detected that the transport projecting member 56 reached a predetermined position, after coins of the preset number had been dispensed from the coin storing space 53 to the outside through the outlet 50*a* of the storing and feeding apparatus 50. Also in this case, a rotating position at which the rotating disk 52 is stopped is the same position regardless of a diameter length of a coin. Thus, the transport projecting member 56 can reliably close the outlet 50*a* regardless of a diameter length of a coin.

In addition, in yet another alternative example, the control unit 251 of the storing and feeding apparatus 50 may be configured to control the rotating-disk drive unit 252*c* such that, after the rotating disk 52 has been once stopped, the rotating disk 52 is rotated reversely to the coin feeding direction, so that the rotating disk 52 is moved to a position where the transport projecting member 56 blocks the outlet 50*a* of the storing and feeding apparatus 50.

In the third embodiment, the rotating disk of the storing and feeding apparatus is not necessarily limited to a rotating disk that is inclined at a predetermined angle relative to the vertical direction, and is configured to be rotated in an inclined posture. There may be used a rotating disk that is horizontally extended and is configured to be rotated along a horizontal plane. In this case, the coin storing space for storing a coin is formed above the rotating disk. In addition, a member that moves a coin on the rotating disk is not limited to a projecting member, and a mere guide member may guide a coin on the rotating disk. In this case, the control unit controlling the rotating-disk drive unit is configured to control the rotating-disk drive unit such that the rotating disk is stopped at a position where the guide member blocks the outlet, when coins of the preset number have been dispensed from the coin storing space to the outside through the outlet of the storing and feeding apparatus.

In the coin depositing and dispensing machine 210 shown in FIG. 18, there is a case in which a transparent or translucent resin coin is received through the coin receiving opening 14 and is temporarily pooled in the pooling and feeding apparatus 30. Specifically, in Europe, for example, a transparent coin is used for managing shopping carts in shopping centers, and such a transparent coin may be put into the coin depositing and dispensing machine 210. When such a transparent or translucent resin coin is fed out from the pooling and feeding apparatus 30 to the deposited-coin transport unit 20 so as to be transported by the endless belt 20*p*, even an existence of the resin coin may not be detected by the recognition unit 22. In this case, there is a possibility that the transparent or translucent coin is not sorted by the sorting unit 24 so as to be sent to the coin dispensing opening 18 or one of the storing and feeding apparatuses 50, but that the resin coin is transported to a downstream end of the deposited-coin transport unit 20, resulting in a transport trouble such as jam at the downstream end.

In order to solve such a problem, the following method has been newly contrived. A novel structure and a novel operation of the coin depositing and dispensing machine 210 are described herebelow with reference to FIGS. 29 and 30.

Figure 29:
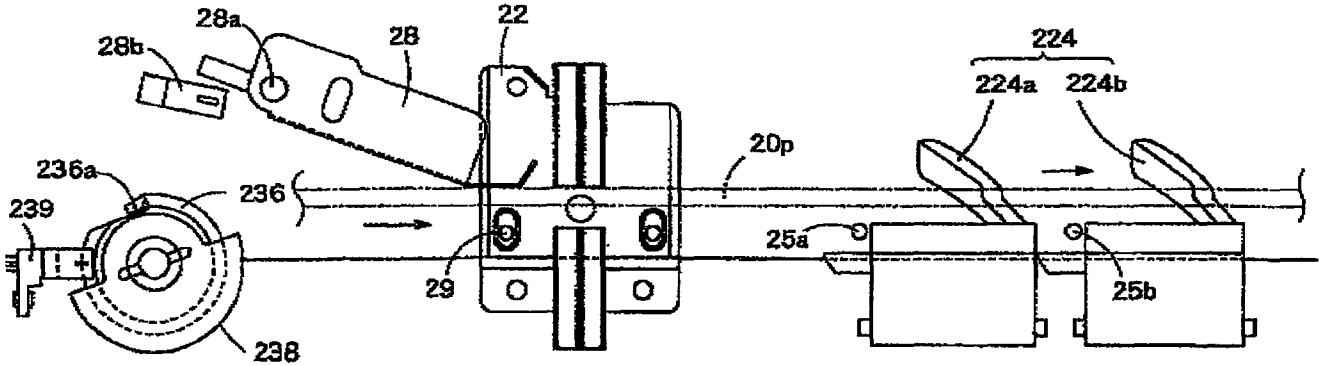

As described above, in the pooling and storing apparatus 30, disposed above the rotating disk 32 is a delivery disk 236 having a diameter smaller than that of the rotating disk 32. A coin having been transported from the lower area of the rotating disk 32 to the upper area thereof is fed out to the deposited-coin transport unit 20 by the delivery disk 236. As shown in FIG. 29, a projection 236*a* is formed on an outer peripheral portion of the delivery disk 236. When the delivery disk 236 is rotated in the clockwise direction in FIG. 29 with a coin being engaged with the projection 236*a*, the coin in the upper area of the rotating disk 32 is sent to the deposited-coin transport unit 20. When the delivery disk 236 is rotated a full circle, one coin is fed out from the rotating disk 32 to the deposited-coin transport unit 20.

As shown in FIG. 29, a rotation detection light-shielding plate 238 is attached to the delivery disk 236. In addition, a delivery-disk position detection sensor 239 is disposed near to the delivery disk 236. The delivery-disk position detection sensor 239 is formed of, e.g., an optical sensor. When the rotation detection light-shielding plate 238 disposed on the delivery disk 236 reaches the delivery-disk position detection sensor 239, the delivery-disk position detection sensor 239 is configured to detect the rotation detection light-shielding plate 238. In this manner, the delivery-disk position detection sensor 239 is configured to detect a rotating position of the delivery disk 236.

In addition, as shown in FIG. 29, in a coin transport path formed by the endless belt 20*p* of the deposited-coin transport unit 20, an aligning lever 28 is provided between the delivery disk 236 and the recognition unit 22. The aligning lever 28 is configured to be swung about a shaft 28*a*. When no force is applied to the aligning lever 28, a force is urged by a torsion spring (not shown) disposed on the shaft 28*a* to the aligning lever 28 in the clockwise direction about the shaft 28*a*. At this time, the aligning lever 28 is maintained at a position shown in FIG. 29. On the other hand, when a coin passes an area below the aligning lever 28, the aligning lever 28 is configured to be pushed by the coin in the counterclockwise direction in FIG. 29 about the shaft 28*a* against the force applied by the torsion spring. In addition, as shown in FIG. 29, an aligning lever detection sensor 28*b* is disposed near to the aligning lever 28. The aligning lever detection sensor 28*b* is configured to detect that, when the aligning lever 28 is pushed by a coin so that the aligning lever 28 is swung about the shaft 28*a* from the position shown in FIG. 29 in the counterclockwise direction, the aligning lever 28 has been pushed by the coin so that the aligning lever 28 has been swung about the shaft 28*a* from the position shown in FIG. 29 in the counterclockwise direction.

In addition, a timing sensor 29 is disposed on an inlet side portion of the recognition unit 22. The timing sensor 29 is formed of, e.g., an optical sensor. When a coin passes through the timing sensor 29, light emitted toward the timing sensor 29 is shielded by the coin.

In addition, as described above, the recognition unit 24, which is located on the most upstream position in the first deposited-coin transport portion 20*a*, is configured to function as a reject sorting unit 224*a* for sending a reject coin to the coin dispensing opening 18. The other sorting units 24 (e.g., sorting units 224*b* and the like in FIG. 29) are configured to function as denomination sorting units 224*b* for sending coins by denomination to the respective storing and feeding apparatuses 50 through the chutes 26.

In addition, as shown in FIG. 29, passage sensors 25*a* and 25*b* are located on an upstream side of the respective sorting units 24 in the coin transport direction.

Next, operations of the delivery disk 236 and the deposited-coin transport unit 20 as structured above are described with reference to a sequence diagram shown in FIG. 30. The below-described operations are performed by the control apparatus 290 of the coin depositing and dispensing machine 210 that controls the respective constituent elements.

When a coin having been fed out from the pooling and feeding apparatus 30 is fed out to the deposited-coin transport unit 20 through the delivery disk 236, the delivery disk 236 is configured to be invariably rotated at a constant speed in the clockwise direction in FIG. 29. Thus, in the pooling and feeding apparatus 30, a coin having been transported from the lower area of the rotating disk 32 to the upper area thereof is engaged with the projection 236*a* of the delivery disk 236. Then, the delivery disk 236 is rotated with the coin being engaged with the projection 236*a*, so that the coin is delivered from the upper area of the rotating disk 32 to the endless belt 20*p* of the deposited-coin transport unit 20. In addition, as shown in FIG. 30, in accordance with the rotation of the delivery disk 236, since light emitted toward the delivery-disk position detection sensor 239 is shielded by the rotation detection light-shielding plate 238 attached to the delivery disk 236, the light emitted toward the delivery-disk position detection sensor 239 is shielded and transmitted repeatedly.

The coin having been delivered by the delivery disk 236 to the endless belt 20*p* of the deposited-coin transport unit 20 is transported by the endless belt 20*p* in the right direction in FIG. 29, and is detected by the timing sensor 29. At this time, as shown in FIG. 30, the timing sensor 29 is changed from a light transmitting state to a light shielding state. Thereafter, the coin having passed through the timing sensor 29 is recognized by the recognition unit 22.

When a coin having been recognized by the recognition unit 22 is a normal coin, the coin is sorted by one of the denomination sorting units 224*b* other than the reject sorting unit 224*a* among the respective sorting units 24, so as to be sent to one of the storing and feeding apparatuses 50. More specifically, when the normal coin, which has been recognized by the recognition unit 22, is detected by the passage sensor 25*a* located on the upstream side of the reject sorting unit 224*a*, an opening of the reject sorting unit 224*a* is closed. Thus, the normal coin does not enter the opening of the reject sorting unit 224*a*. On the other hand, when a coin recognized by the recognition unit 22 is a reject coin, the coin is sorted by the reject sorting unit 224*a* among the respective sorting units 24, so as to be sent to the coin dispensing opening 18. More specifically, when the reject coin, which has been recognized by the recognition unit 22, is detected by the passage sensor 25*a* located on the upstream side of the reject sorting unit 224*a*, the opening of the reject sorting unit 24*a* is opened. Thus, the reject coin enters the opening of the reject sorting unit 224*a*.

Figure 30:
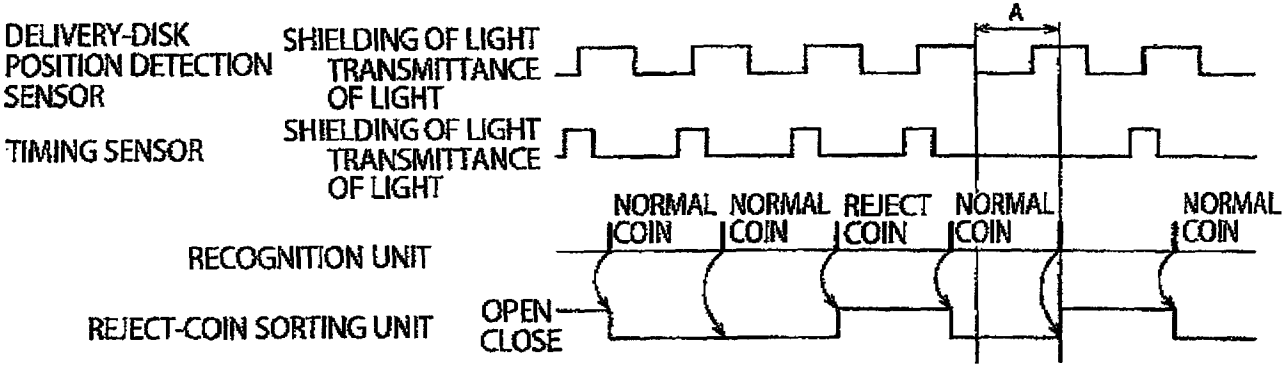
FIG. 30 is a sequence diagram showing operations of the delivery disk and the deposited-coin transport unit shown in FIG. 29.

In addition, according to the present invention, if no coin is detected by the timing sensor 29 until a predetermined period of time A (see FIG. 30) has passed from when the delivery-disk position detection sensor 239 was changed from the light-shielding state to the light-transmitting state, the opening of the reject sorting unit 224*a* is opened (see FIG. 30). Namely, after the delivery-disk position detection sensor 239 has been changed from the light-shielding state to the light-transmitting state, when a coin is detected by the timing sensor 29 during the predetermined period of time A, the opening of the reject sorting unit 224*a* is opened or closed depending on a coin recognition result by the recognition unit 22. On the other hand, after the delivery-disk position detection sensor 239 has been changed from the light-shielding state to the light-transmitting state, when no coin is detected by the timing sensor 29 during the predetermined period of time A, the opening of the reject sorting unit 224*a* is forcibly opened. Thus, even when a transparent or translucent coin has been fed out from the pooling and feeding apparatus 30 to the deposited-coin transport unit 20, and the transparent or translucent coin is not detected by the timing sensor 29 and/or the recognition unit 22, since the opening of the reject sorting unit 224*a* is opened, the transparent or translucent coin enters the opening of the reject sorting unit 224*a* so as to be sent to the coin dispensing opening 18.

Alternatively, in such an invention, a transparent or translucent coin may be detected by the aligning lever 28. Namely, when the aligning lever detection sensor 28*b* has detected that the aligning lever 28 was swung about the shaft 28*a* in the counterclockwise direction in FIG. 29 but no coin has been detected by the timing sensor 29, the opening of the reject sorting unit 224*a* may be opened. Also by this method, even when a transparent or translucent coin has been fed out from the pooling and feeding apparatus 30 to the deposited-coin transport unit 20, since the opening of the reject sorting unit 224*a* is opened, the transparent or translucent coin enters the opening of the reject sorting unit 224*a* so as to be sent to the coin dispensing opening 18. In addition, as an alternative example, a switch (not shown) may project on a coin aligning surface side. Although no coin is detected by the timing sensor 29, when passage of a transparent or translucent coin is detected by the switch, the opening of the reject sorting unit 224*a* may be opened so as to eliminate the transparent or translucent coin.

Figure 31:
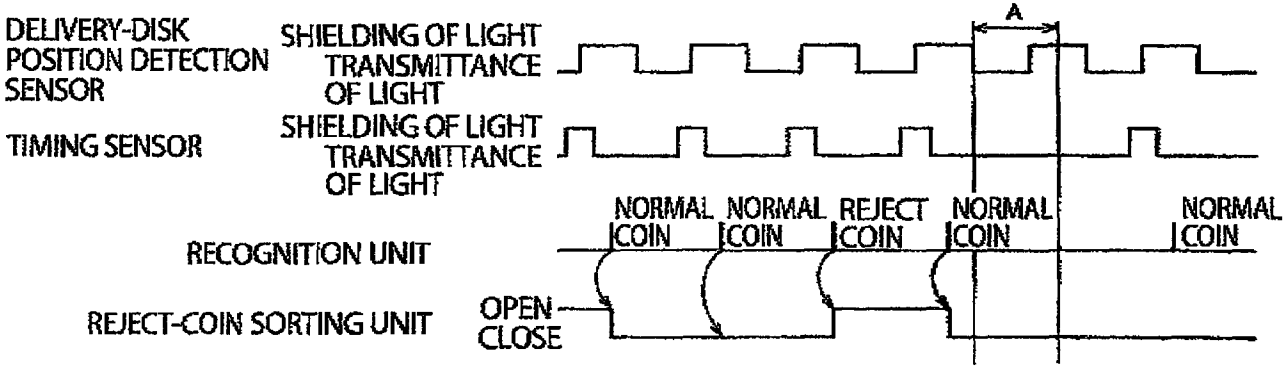
FIG. 31 is a sequence diagram showing operations of the delivery disk and the deposited-coin transport unit in a conventional method as a comparative example of the third embodiment.

A conventional method is described as a comparative example with reference to a sequence diagram shown in FIG. 31. In the conventional method, an opening and closing operation of the opening of the reject sorting unit 224*a* is performed based only on a coin recognition result by the recognition unit 22. Thus, when a coin having been fed out from the pooling and feeding apparatus 30 to the deposited-coin transport unit 20 is not transparent or translucent so that the coin can be detected by the recognition unit 22, the opening of the reject sorting unit 224*a* can be opened or closed depending on the coin recognition result (normal coin or reject coin). However, when a coin having been fed out from the pooling and feeding apparatus 30 to the deposited-coin transport unit 20 is a transparent or translucent coin, such a coin cannot be detected by the timing sensor 29 and the recognition unit 22. Thus, when a coin, which has been recognized by the recognition unit 22 prior to the transparent or translucent coin, is a normal coin, for example, the opening of the reject sorting unit 224*a* is closed. Thus, even when the transparent or translucent coin has reached the reject sorting unit 224*a*, the opening of the reject sorting unit 224*a* remains closed. Thus, the transparent or translucent coin is not sent to the coin dispensing opening 18 by the reject sorting unit 224*a*, but may be transported to the downstream end of the deposited-coin transport unit 20, resulting in a transport trouble such as jam at the downstream end.

As described above, according to the novel method shown in FIGS. 29 and 30, in a coin handling apparatus including: a transport unit configured to transport a coin (e.g., deposited-coin transport unit 20), a first coin detection unit (e.g., delivery-disk position detection sensor 239 or aligning lever detection sensor 28*b*) configured to detect a member (e.g., delivery disk 236 or aligning lever 28) that comes into contact with a coin to be sent to the transport unit and/or a coin transported by the transport unit; a second coin detection unit (e.g., timing sensor 29 formed of an optical sensor or the like) disposed on a downstream side of the first coin detection unit, and configured to optically detect a coin; a recognition unit (e.g., recognition unit 22) disposed on the transport unit and configured to recognize a coin; a reject sorting unit (e.g., reject sorting unit 224*a*) disposed on the downstream side of the recognition unit in the coin transport direction and configured to sort and discharge a reject coin; and a control unit (e.g., control apparatus 290) configured to control the reject sorting unit; the control unit is configured to control the reject sorting unit such that, when no coin is detected by the second coin detection unit during a predetermined period of time (e.g., time period indicated by the reference symbol A in FIG. 30) after the member in contact with a coin has been detected by the first coin detection unit, the coin transported by the transport unit is sorted by the reject sorting unit so as to be discharged. Thus, even when a coin transported by the transport unit is a transparent or translucent coin and thus could not be detected by the second coin detection unit and the recognition unit, such a transparent or translucent coin can be sorted by the reject sorting unit so as to be discharged.

What is claimed is:

1. A coin feeding apparatus comprising:

a rotating disk that is inclined at a predetermined angle relative to a vertical direction, and is configured to be rotated in one direction;

a transport projecting member disposed on an outer portion of a surface of the rotating disk, the transport projecting member and the surface of the rotating disk being configured to catch at least one coin in a lower area of the rotating disk so as to transport the coin to an upper area of the rotating disk by the rotation of the rotating disk in the one direction;

an elimination projection member disposed on an inner portion of the surface of the rotating disk, the inner portion being located closer to a center of the rotating disk than the outer portion in the radial direction of the rotating disk, wherein a leading edge of the transport projecting member extends past a leading edge of the elimination projection member in the one direction of the rotation of the rotating disk;

a guide member opposed to the surface of the rotating disk, and an outlet configured to feed out, to outside, the coin transported to an upper area of the rotating disk by the transport projecting member and the surface of the rotating disk, wherein, the elimination projection member and the guide member are configured such that, when the transport projecting member and the surface of the rotating disk catches one first coin and at least one second coin together by the rotation of the rotating disk in the one direction, the guide member guides the first coin to the outlet, catches the second coin being floated up from the surface of the rotating disk by the elimination projection member and drops the floated-up second coin to the lower area of the rotating disk.

2. The coin feeding apparatus according to claim 1, wherein:

the elimination projection member is configured such that, when one coin having a largest diameter, among coins of various denominations to be fed out by the coin feeding apparatus, is transported by the transport projecting member by rotating of the rotating disk, the coin is caused not to float up from the surface of the rotating disk.

3. The coin feeding apparatus according to claim 1, wherein:

the elimination projection member is located closer to a center of the rotating disk than the transport projecting member.

4. The coin feeding apparatus according to claim 1, wherein:

the elimination projection member is configured such that, when the first coin and the second coin are transported to the upper area of the rotating disk together by the transport projection member, the first coin being guided to the outlet by the guide member does not float up from the surface of the rotating disk and the second coin floats up from the surface of rotating disk and drops to the lower area of the rotating disk.

5. The coin feeding apparatus according to claim 1, wherein:

a plurality of sets of the rotating transport projection members and the elimination projection members are located along a circumferential direction of the rotating disk.

6. The coin feeding apparatus according to claim 1, wherein:

the elimination projection member is configured such that, when the second coin floats up from the surface of the rotating disk, a front part of the second coin floats up in a rotating direction of the rotating disk; and when the front part of the second coin floats up from the surface of the rotating disk, the second coin is dropped to the lower area of the rotating disk without being fed out by the guide member to outside the rotating disk.

7. The coin feeding apparatus according to claim 6, wherein:

a height, at which the front part of the second coin float up from the rotating disk, is larger than a height of a position at which the guide member is to catch the second coin.

8. The coin feeding apparatus according to claim 1, wherein:

the elimination projection member is movable between a projecting position at which the elimination projection member projects from the surface of the rotating disk and a withdrawn position at which the elimination projection member is withdrawn into the rotating disk; and when the elimination projection member comes close to the guide member by rotating the rotating disk, the elimination projection member is moved from the withdrawn position to the projecting position.

* * * * *